United States Patent [19]

Doane et al.

[11] 4,124,102

[45] Nov. 7, 1978

[54] ELEVATOR CONTROL SYSTEM

[75] Inventors: John Charles Doane, Somerset, N.J.; Joseph Bittar, Brooklyn, N.Y.

[73] Assignee: Otis Elevator Company, New York, N.Y.

[21] Appl. No.: 761,503

[22] Filed: Jan. 21, 1977

[51] Int. Cl.[2] ..... B66B 1/18

[52] U.S. Cl. ..... 187/29 R

[58] Field of Search ..... 187/29

[56] References Cited

U.S. PATENT DOCUMENTS 4,029,175 6/1977 Winkler ..... 187/29

*Primary Examiner*—Robert K. Schaefer
*Assistant Examiner*—W. E. Duncanson, Jr.
*Attorney, Agent, or Firm*—Robert T. Mayer

[57] ABSTRACT

An elevator control system having a car processor, its associated car processor memory and car logic circuitry individually associated with each car to apply a first set of car control signals to the car associated control equipment to cause it to operate the car in a particular manner and having a group processor, its associated group memory and group logic circuitry common to each of the cars receiving hall call signals and selected first car control signals and in response thereto applying group control signals to selected car processor circuitry which operates in response thereto to apply second car control signals to its associated car control equipment to cause it to operate its associated car as a member of a supervised group. Whenever the group processor is to receive a first car control signal from or is to transmit a group control signal to the selected car processor circuitry, the group logic circuitry operates to cause the group processor and the selected car processor to suspend their sequence of operations and to cause the signal transfer therebetween.

12 Claims, 24 Drawing Figures

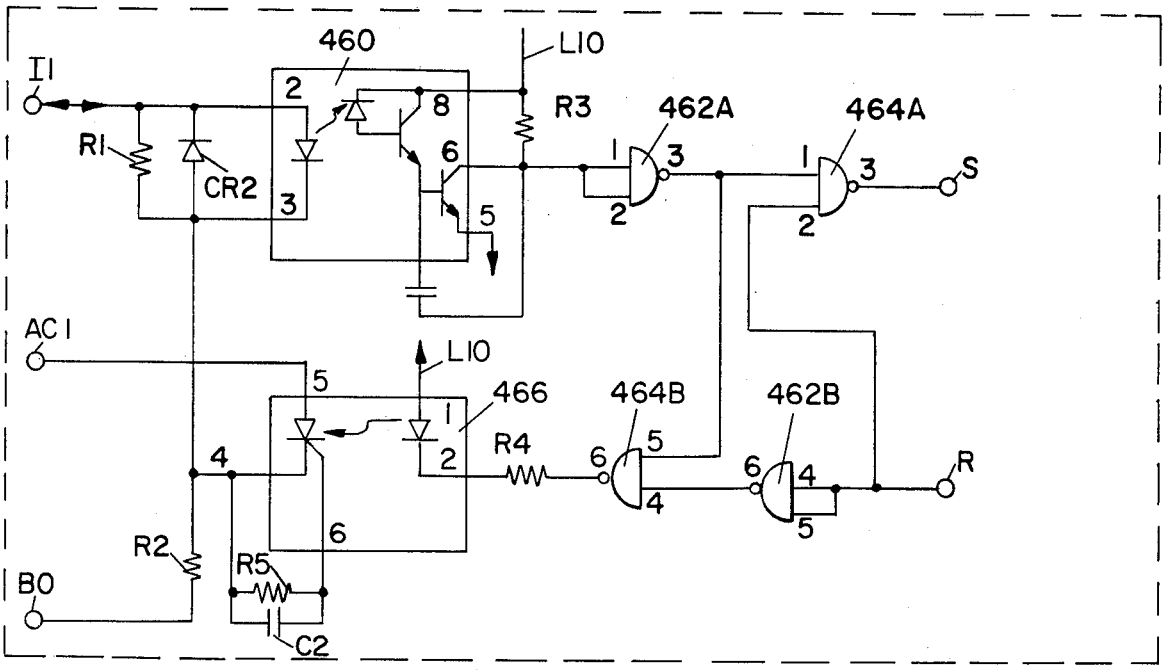
FIG. 18A
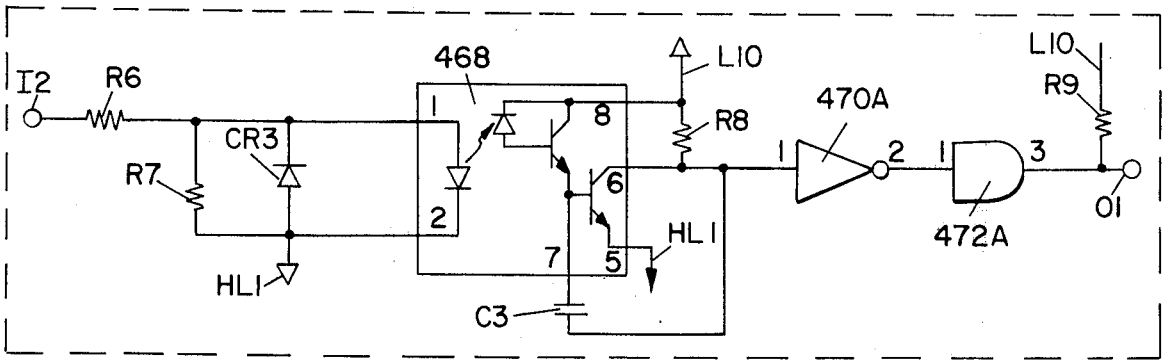
FIG. 18B
FIG. 18C
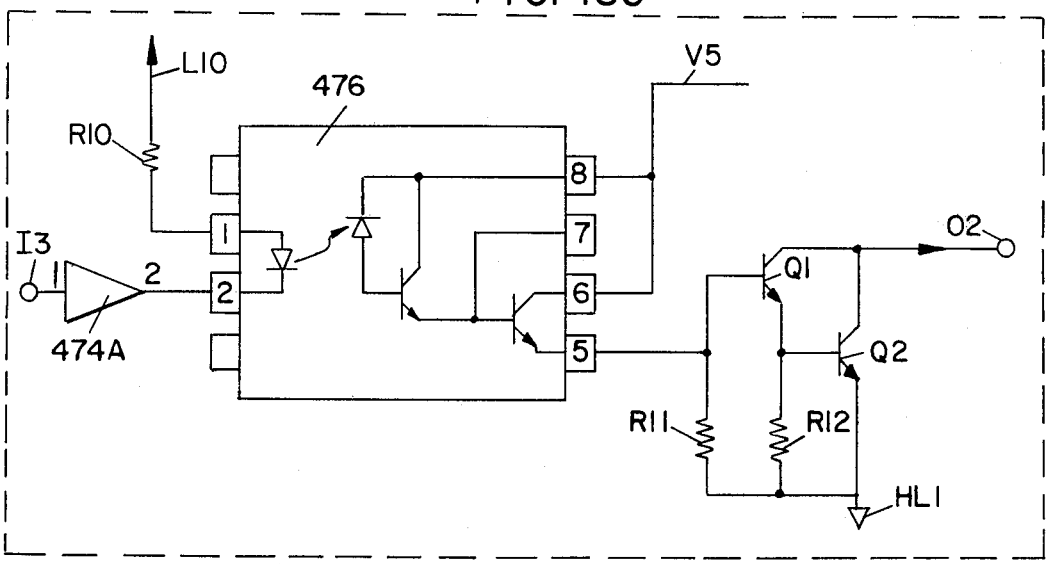

ELEVATOR CONTROL SYSTEM

This invention relates to elevator control systems. More particularly, it concerns a control system for controlling the operation of a plurality of cars of an elevator installation as a supervised group.

Supervisory control systems for groups of elevators normally possess a highly desired advantage of maintaining the car operable to serve the landings of a building notwithstanding the equipment which controls the cars as a supervised group might fail. This advantage is usually accomplished by providing an individual control equipment for each of the cars and common supervisory control equipment separate from the individual control equipment for controlling the cars as a supervised group.

The advent of the general purpose computer having the capability of assuming both the control functions for each car in addition to the supervisory control functions for the group has had little impact on the elevator industry because of the desire to retain the above-mentioned desirable advantage. Cost considerations prevented the utilization of a separate general purpose computer dedicated to each car of the elevator installation for controlling its associated car and an additional computer for controlling the operation of the cars as a supervised group. Furthermore the utilization of separate general purpose computers in an elevator installation in this manner would require a solution to the problem of transmitting control signals between the supervisory computer and each of the car control computers.

More recent developments in the semiconductor industry have led to the low cost production of such devices as microprocessors and semiconductor memories having the capabilities of being programmed for specific uses. As a result a separate microprocessor and memory dedicated to each one of the cars of the group and programmed to direct the operations of its associated car and an additional microprocessor and memory combination programmed to direct the operation of the separate cars as a supervised group is now economically feasible. To be operable such an elevator control system depends on the ability of the processor and memory combination dedicated to direct the supervisory control functions to transmit supervisory signals to and to receive car control signals from the processors and memories associated with each of the cars of the elevator installation.

It is an object of this invention to provide an improved group supervisory elevator control system.

It is another object of this invention to provide an elevator control system employing modern electrical switching equipment.

It is another object of this invention to provide apparatus to enable a group supervisory elevator system comprising a microprocessor and memory combination to transmit signals to and to receive signals from one or more microprocessor and memory combinations associated with the cars of the elevator systems.

In accordance with the invention there is provided a control system for use in an elevator installation having a plurality of cars serving a plurality of floors. The elevator installation includes group control equipment comprising hall registration means for producing hall call signals and car control equipment individual to each of the cars of the elevator installation comprising car operating apparatus, car call registration means and car position signifying means, the latter two producing car call and car position signals respectively. In response to the hall call signals, car call signals and car position signals the control system produces first and second car control signals and group control signals which are applied to the car operating apparatus individually associated with each one of the cars to cause the car operating apparatus to control its associated car as a member of a supervised group. The control system includes car processing means, group processing means and program storage means storing control programs of instructions including a car program of instructions and a group program of instructions. The car processing means in following the car program of instructions in a step by step manner sequentially performs a first set of operations to produce first car control signals in response to the car call and car position signals of a particular car and to apply the first car control signals to the car operating apparatus associated with the particular car to cause it to operate its associated car in a particular manner. The group processing means in following its group program of instructions in a step by step manner sequentially performs a second set of operations to produce group control signals in response to selected first car control signals and hall call signals and to apply the group control signals to the car processing means. In response to the group control signals the car processing means produces second car control signals which are applied to the individual car operating apparatus to cause the car operating apparatus to operate the cars as members of a supervised group.

Other objects, features and advantages of the invention will be apparent to those skilled in the art from the following description and appended claims when considered in conjunction with the accompanying drawing in which:

Figure 2:
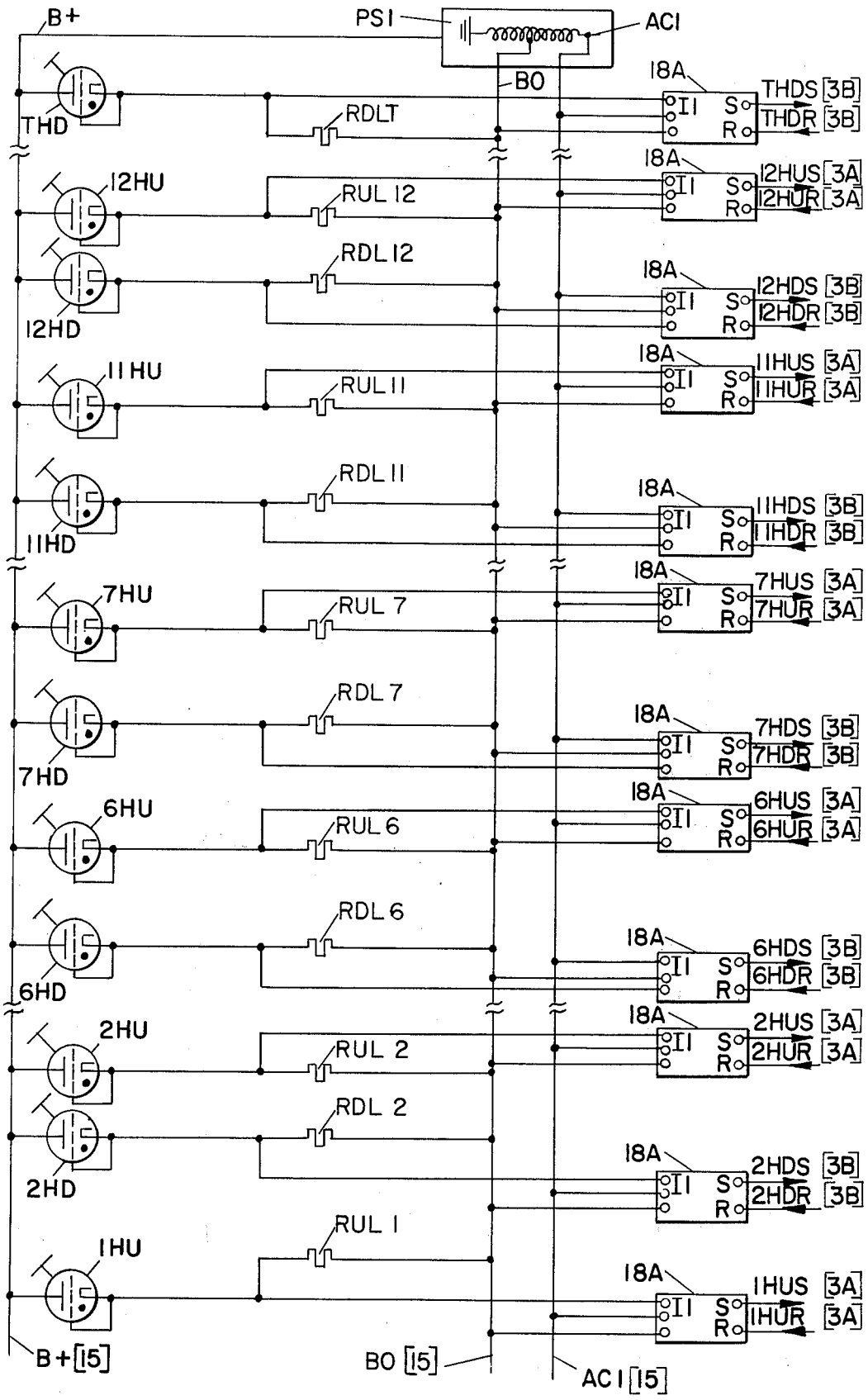
FIG. 2 is a simplified schematic diagram of some of the hall call circuits of the group control equipment of an elevator installation including block diagram representations of hall call interface circuits.
Figure 4:
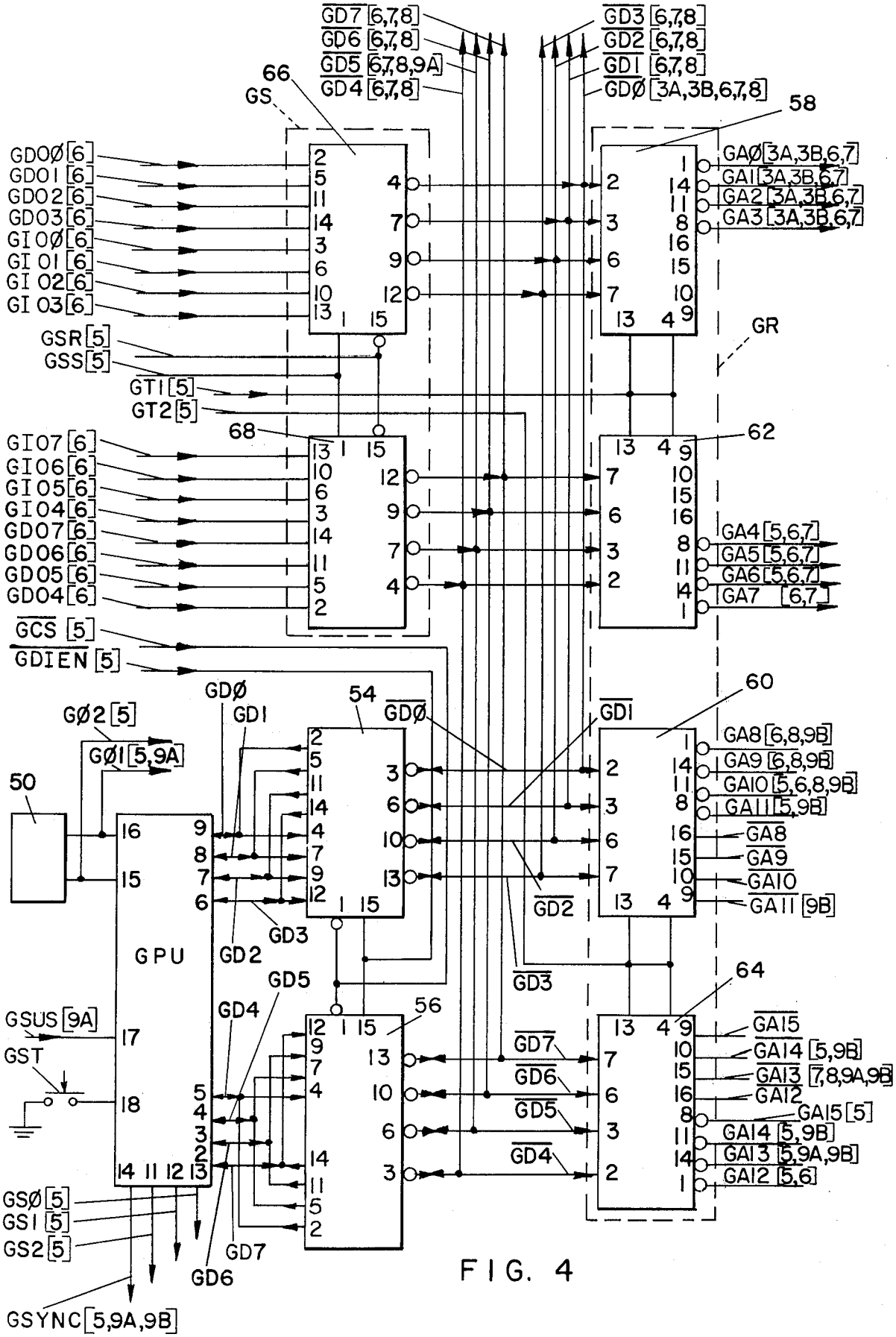
Figure 5:
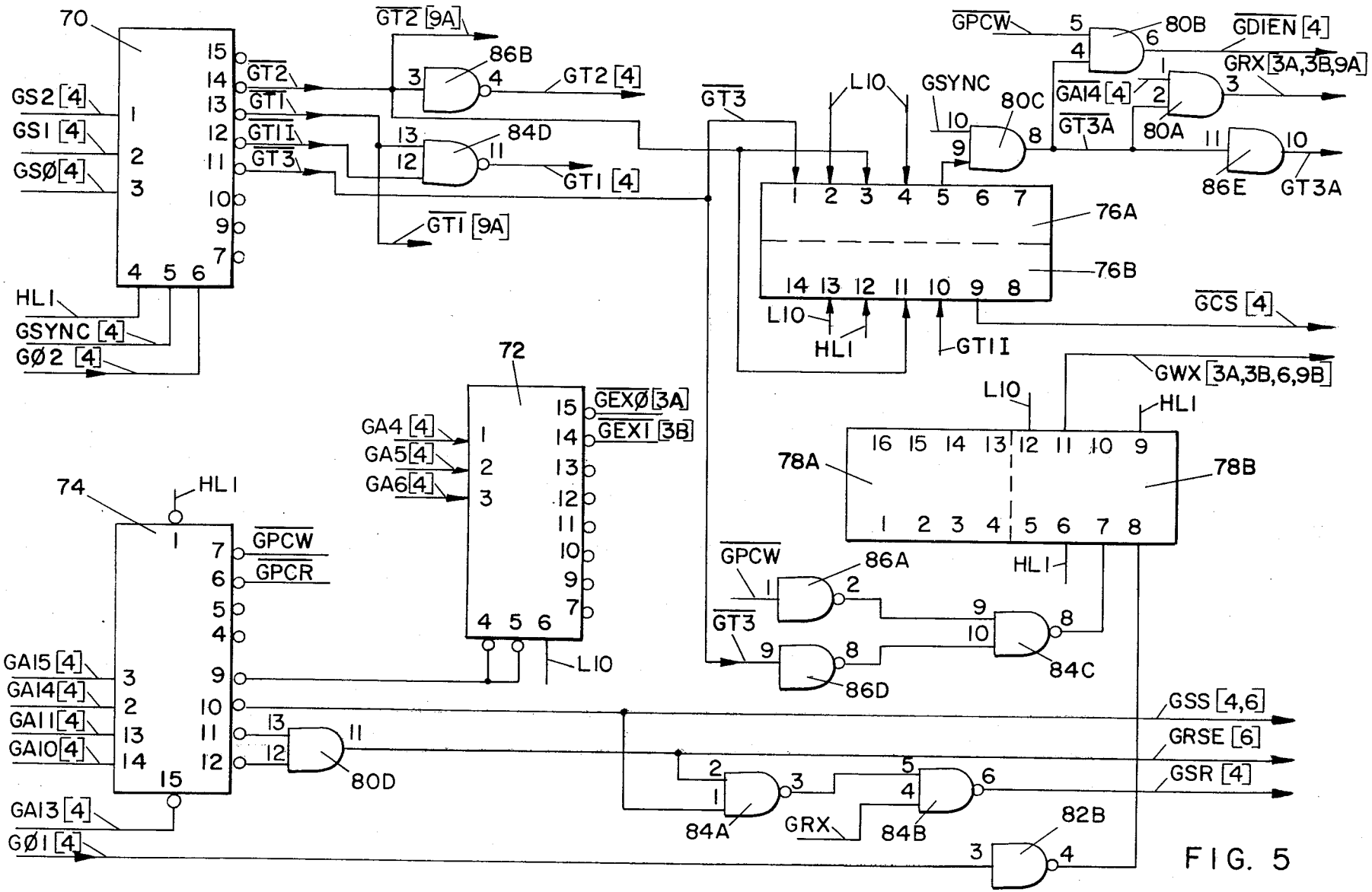
Figure 6:
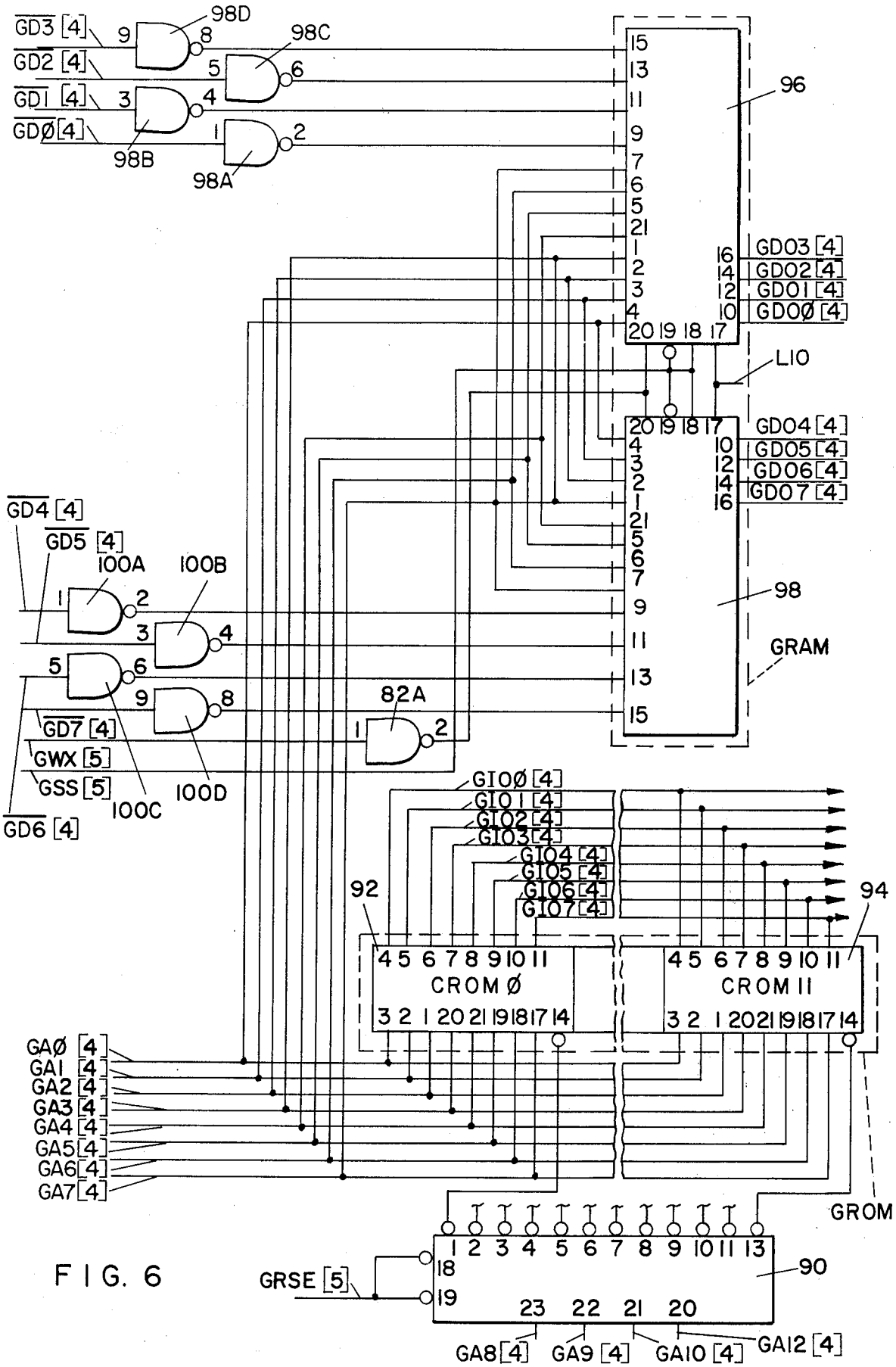
Figure 8:
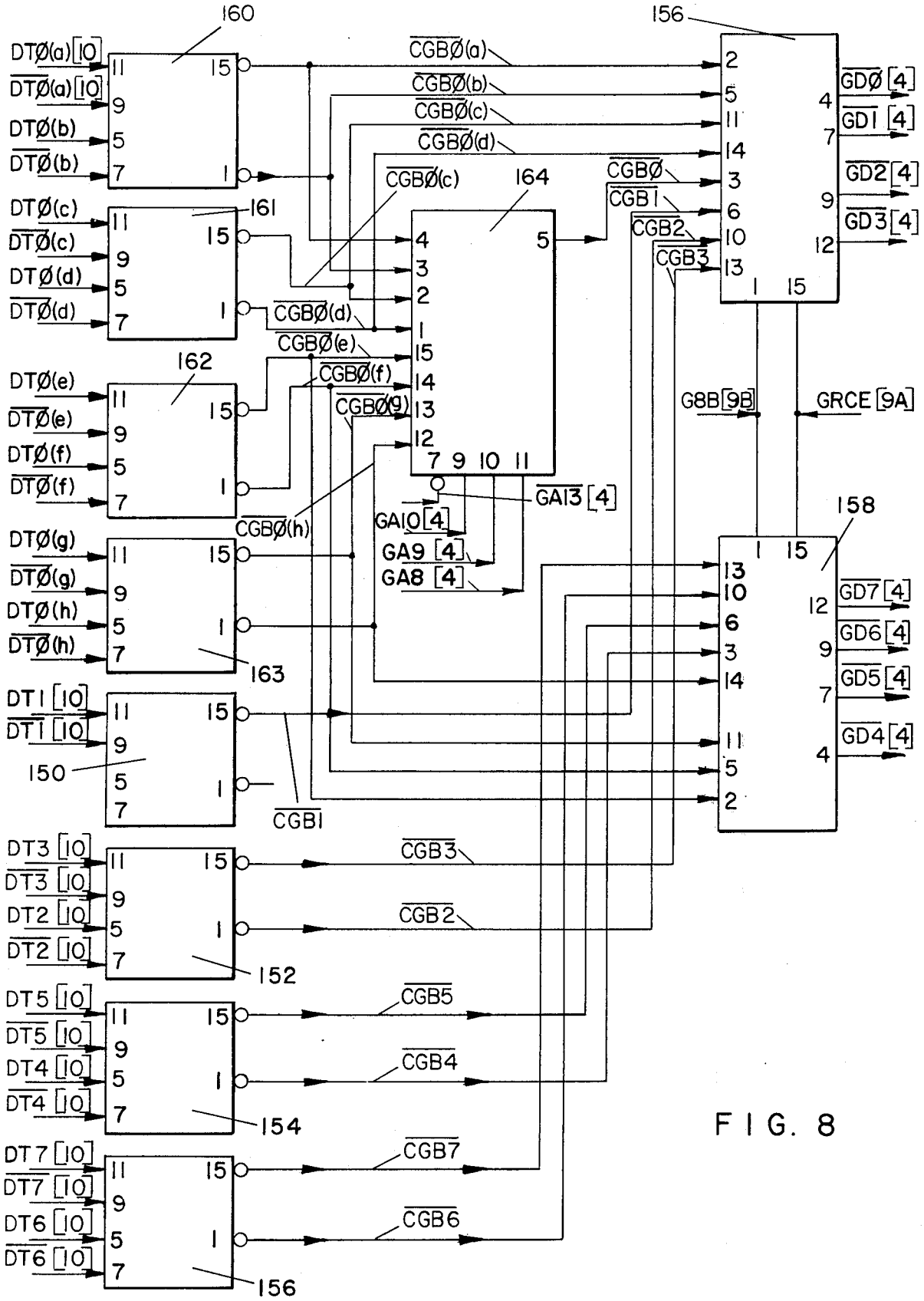
Figure 9A:
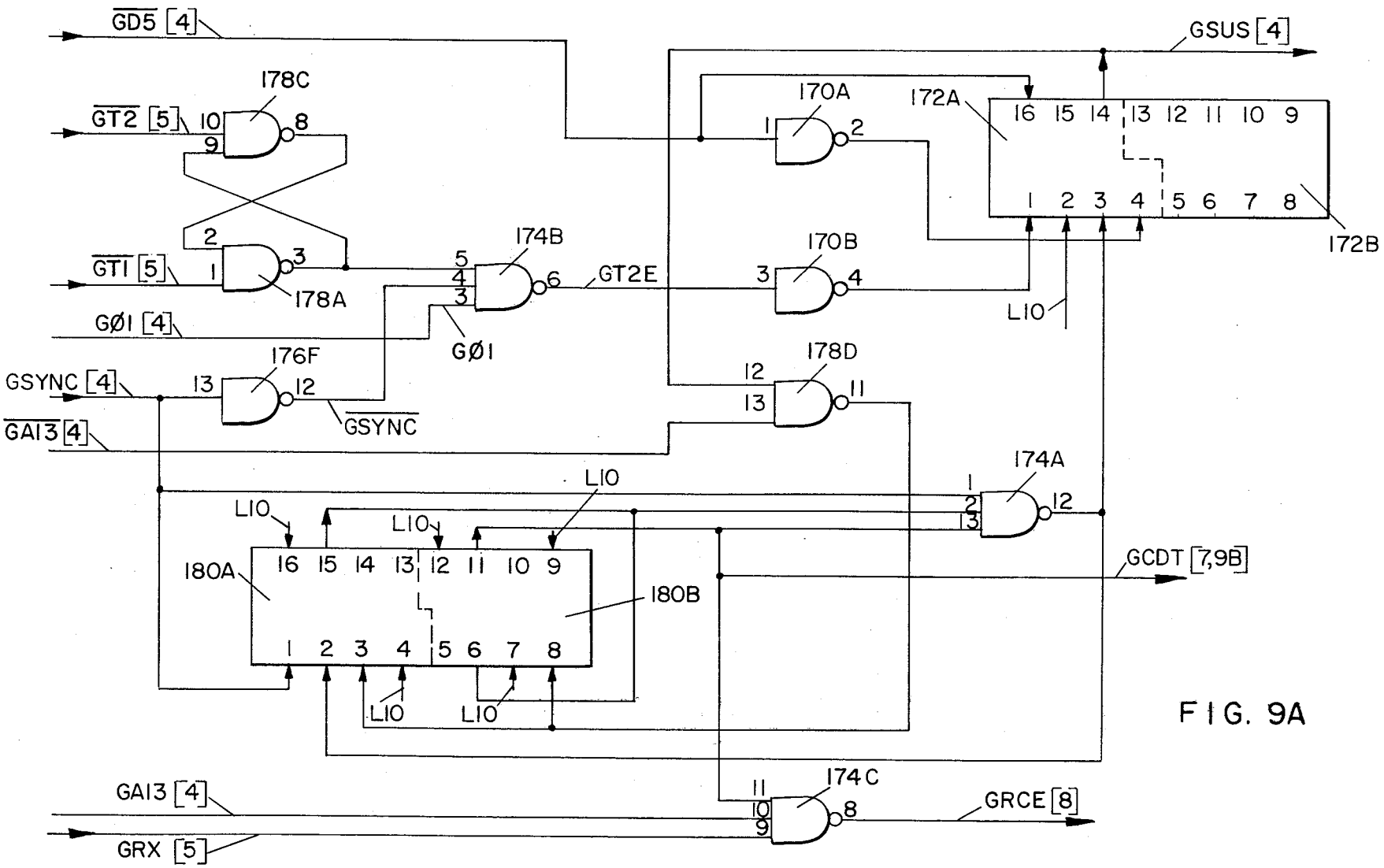
Figure 9B:
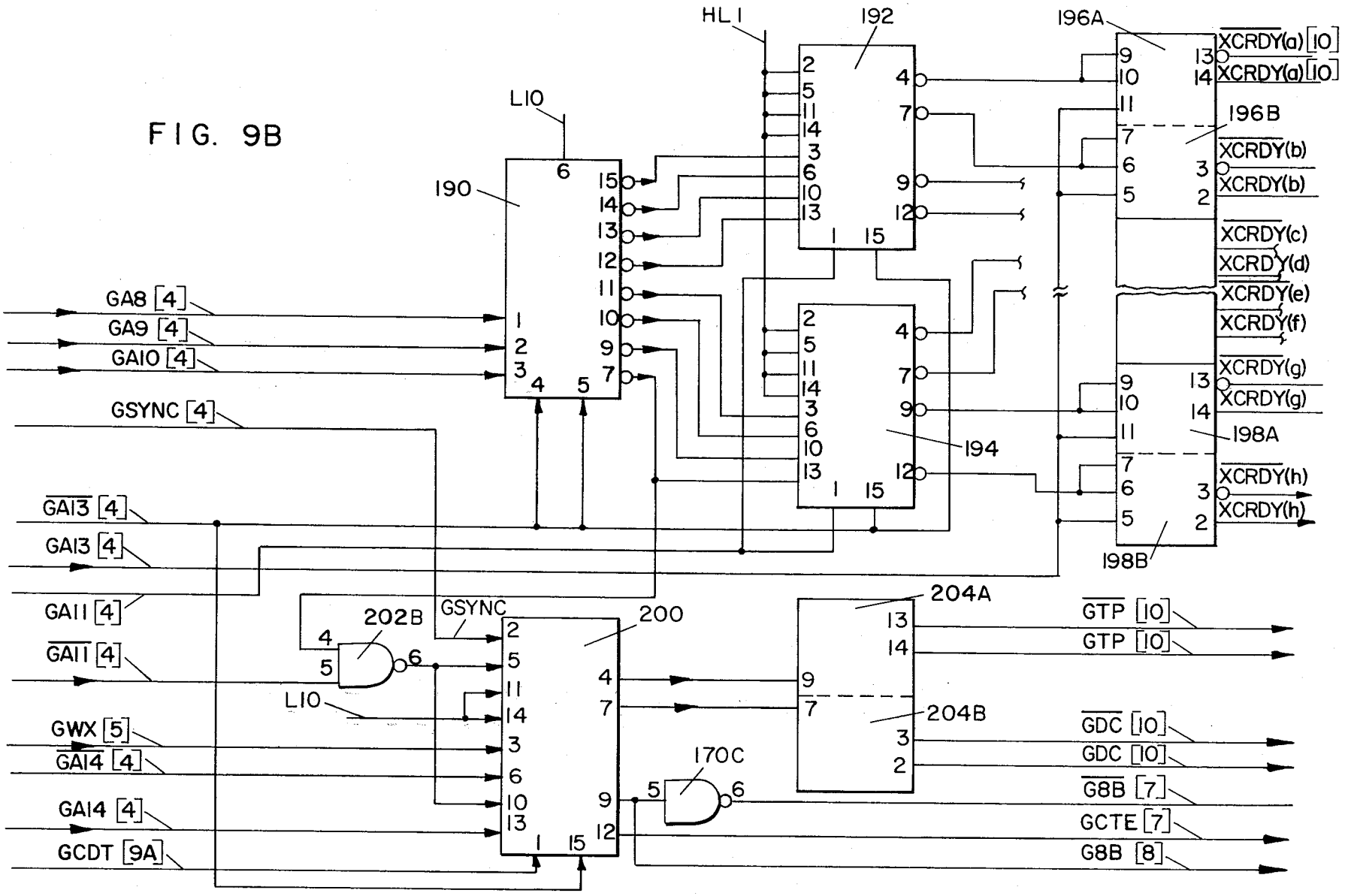
Figure 10:
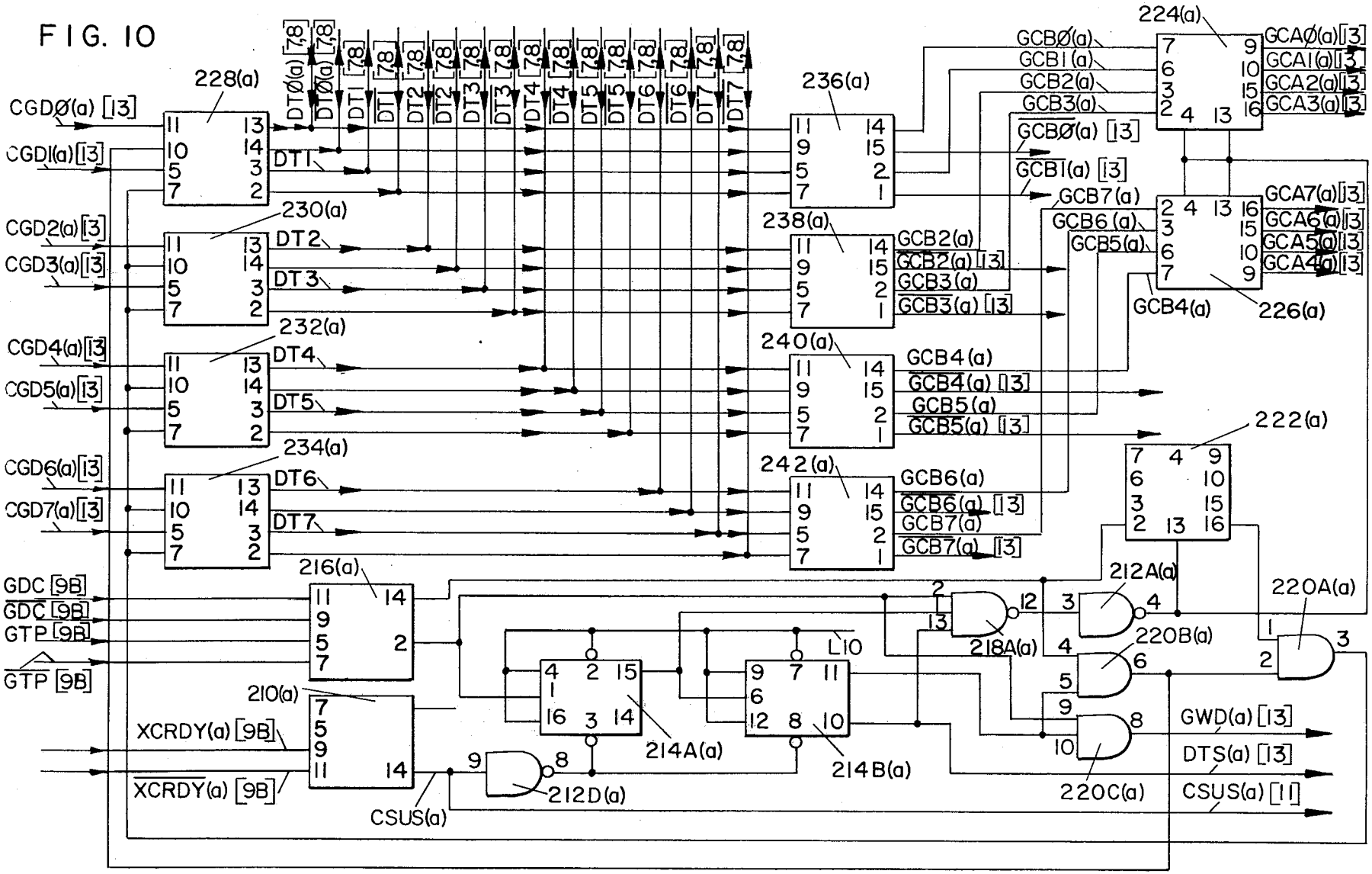
Figure 11:
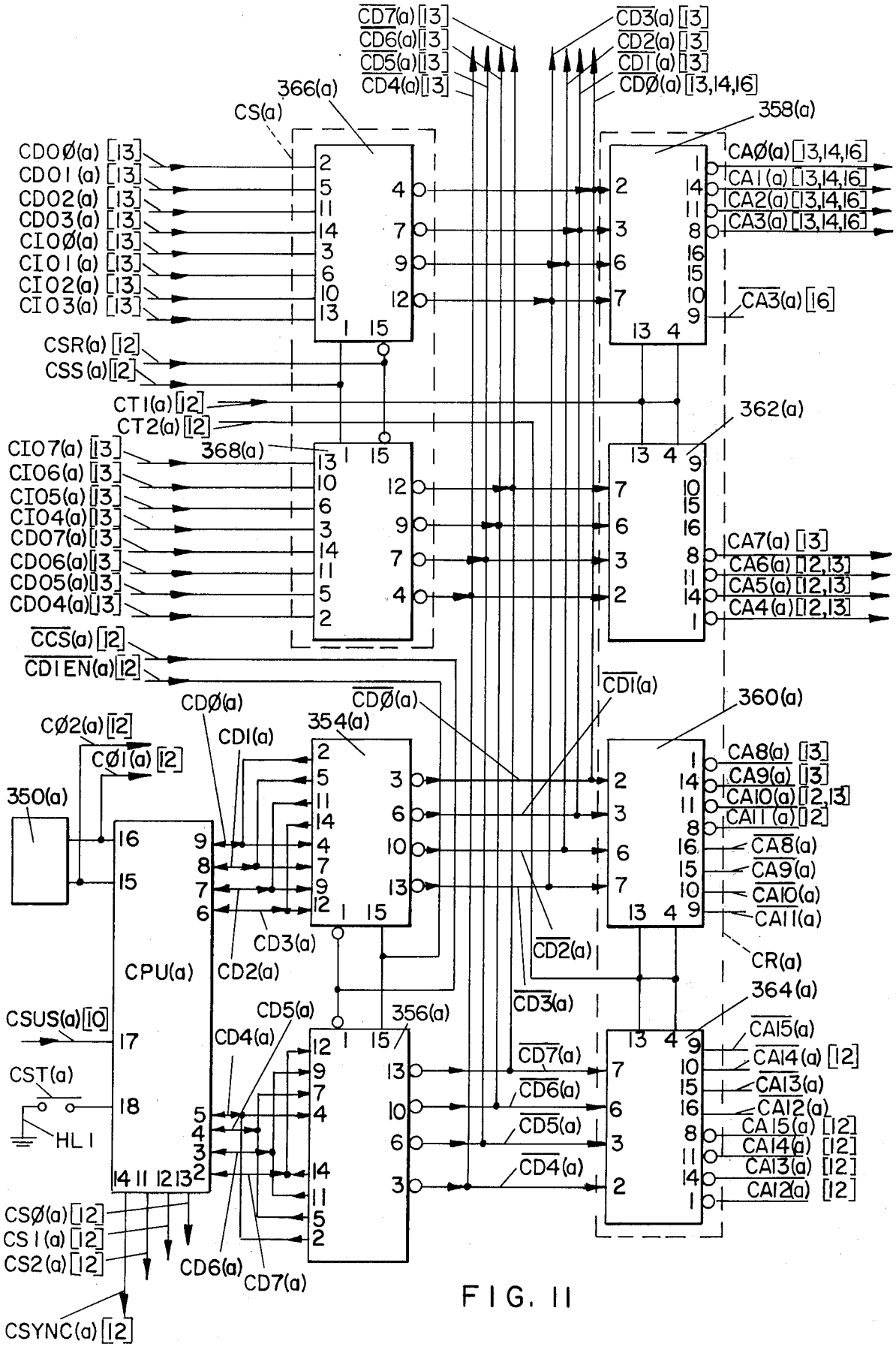
Figure 12:
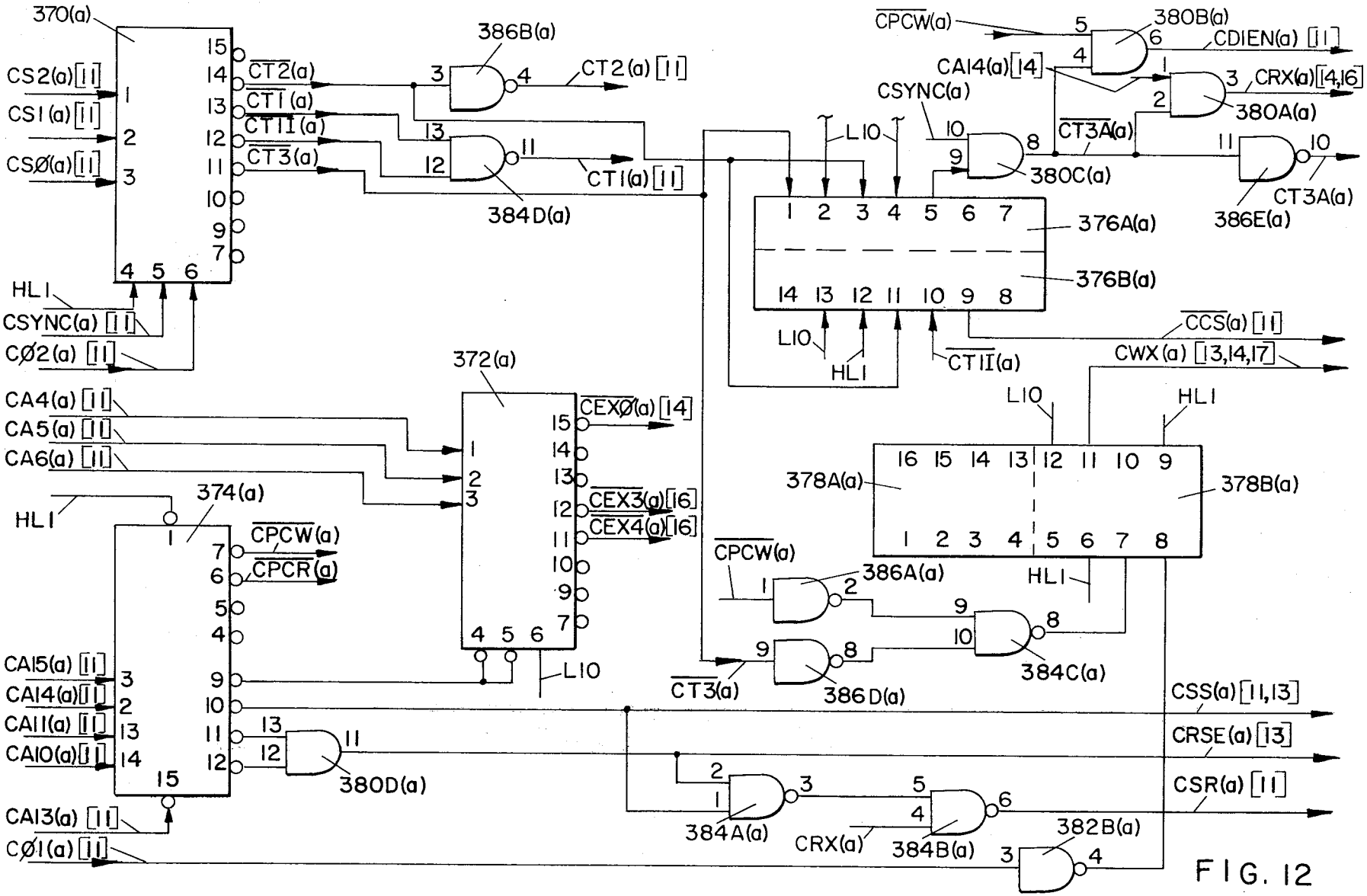
Figure 13:
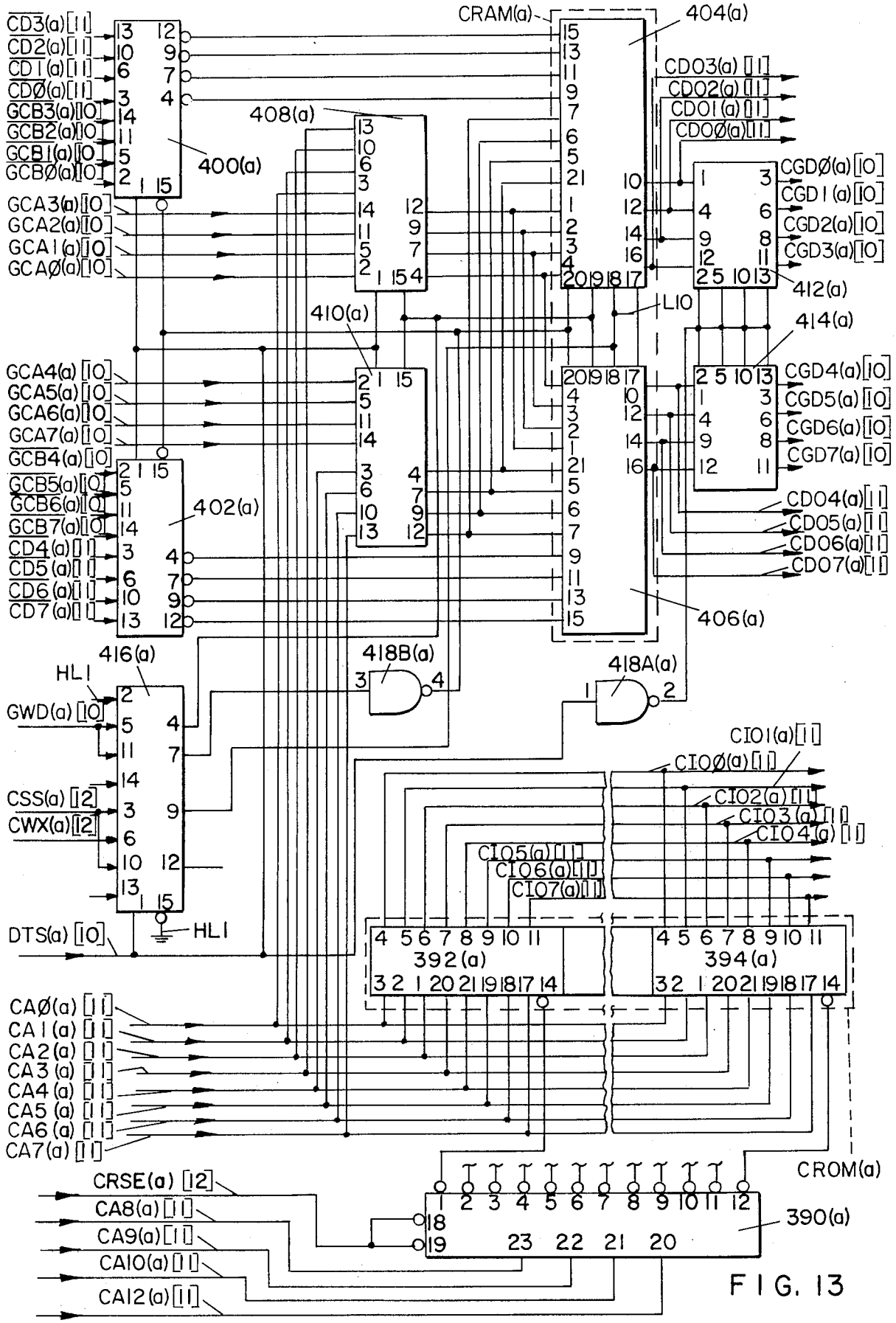
Figure 14:
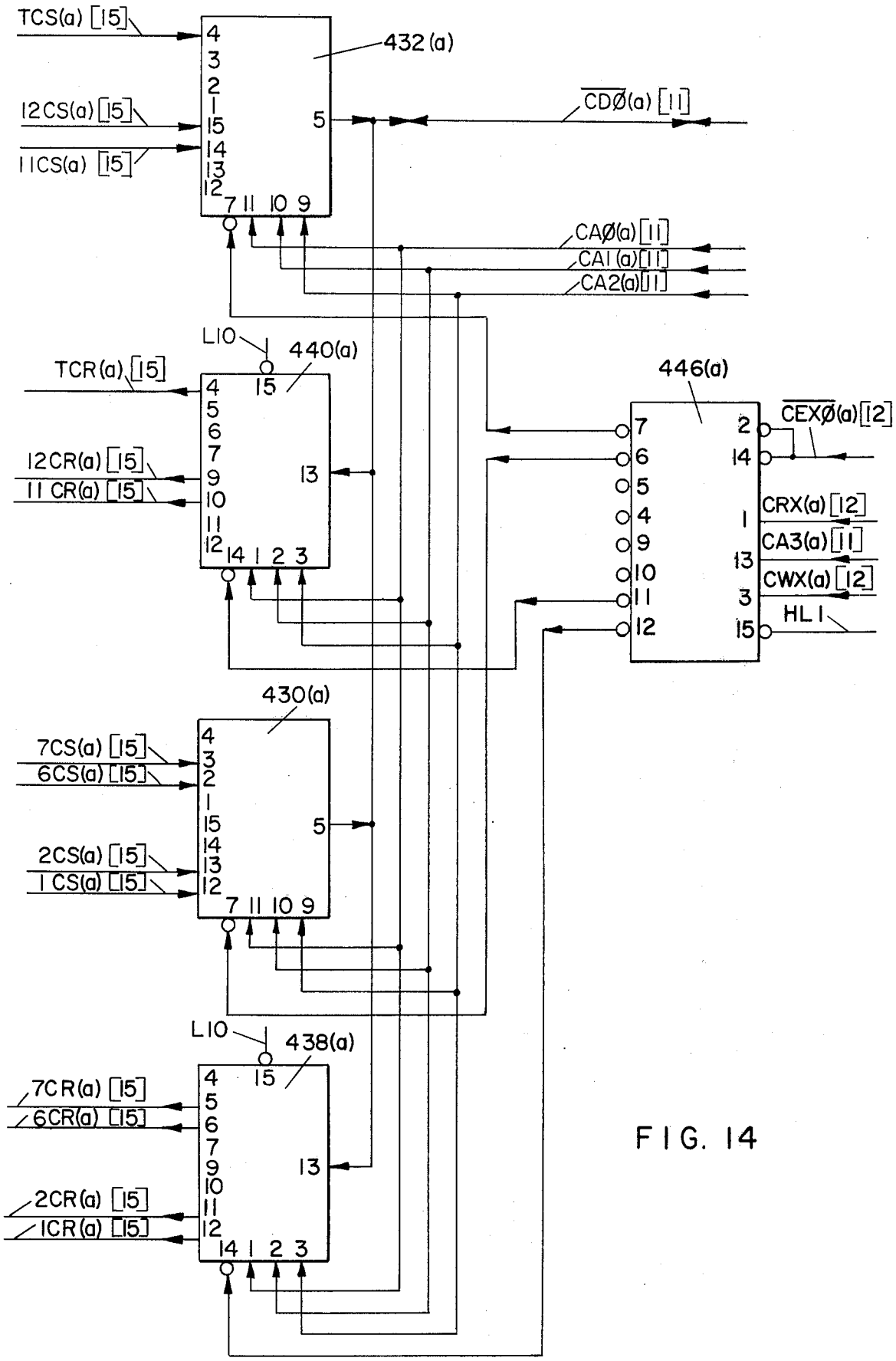
Figure 15:
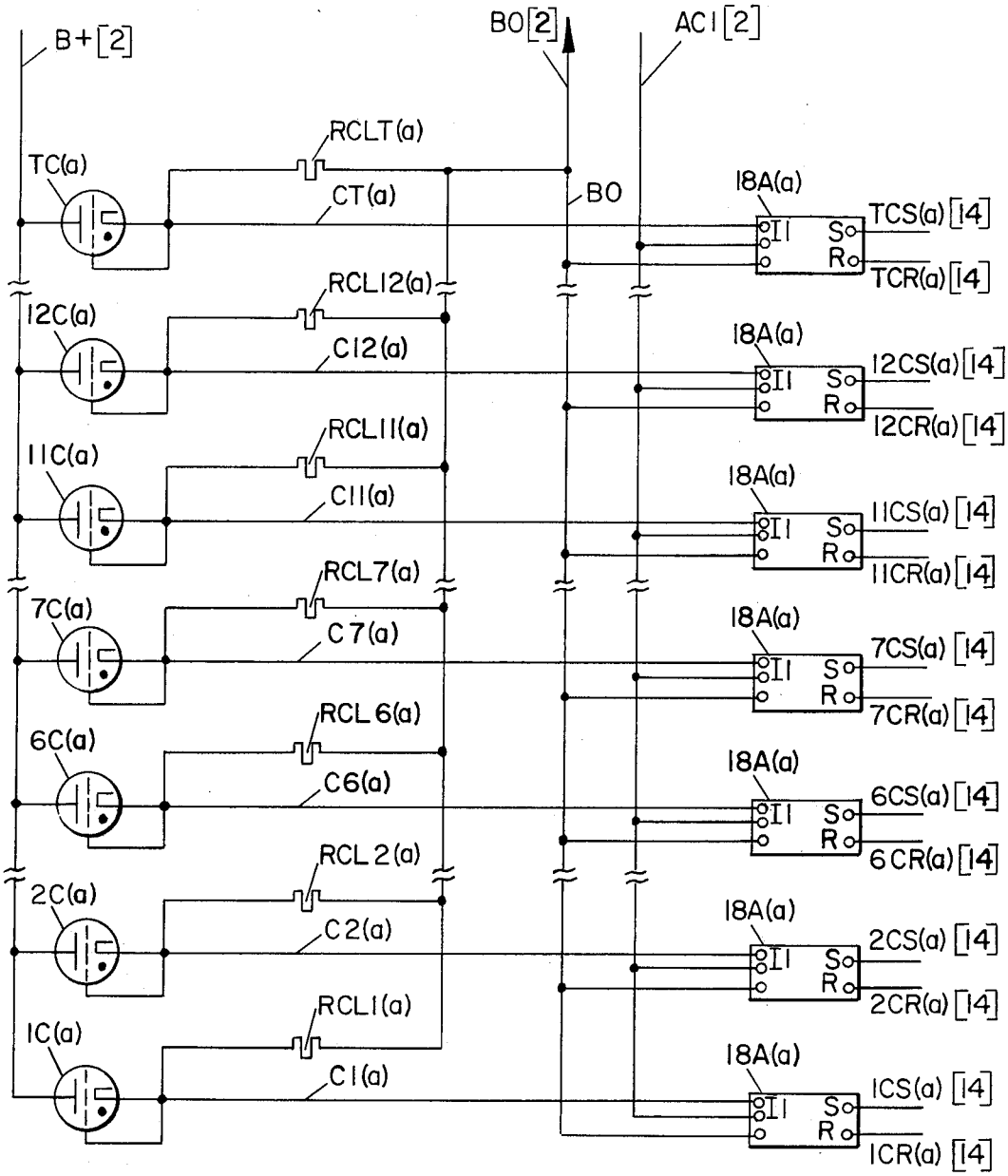
Figure 16:
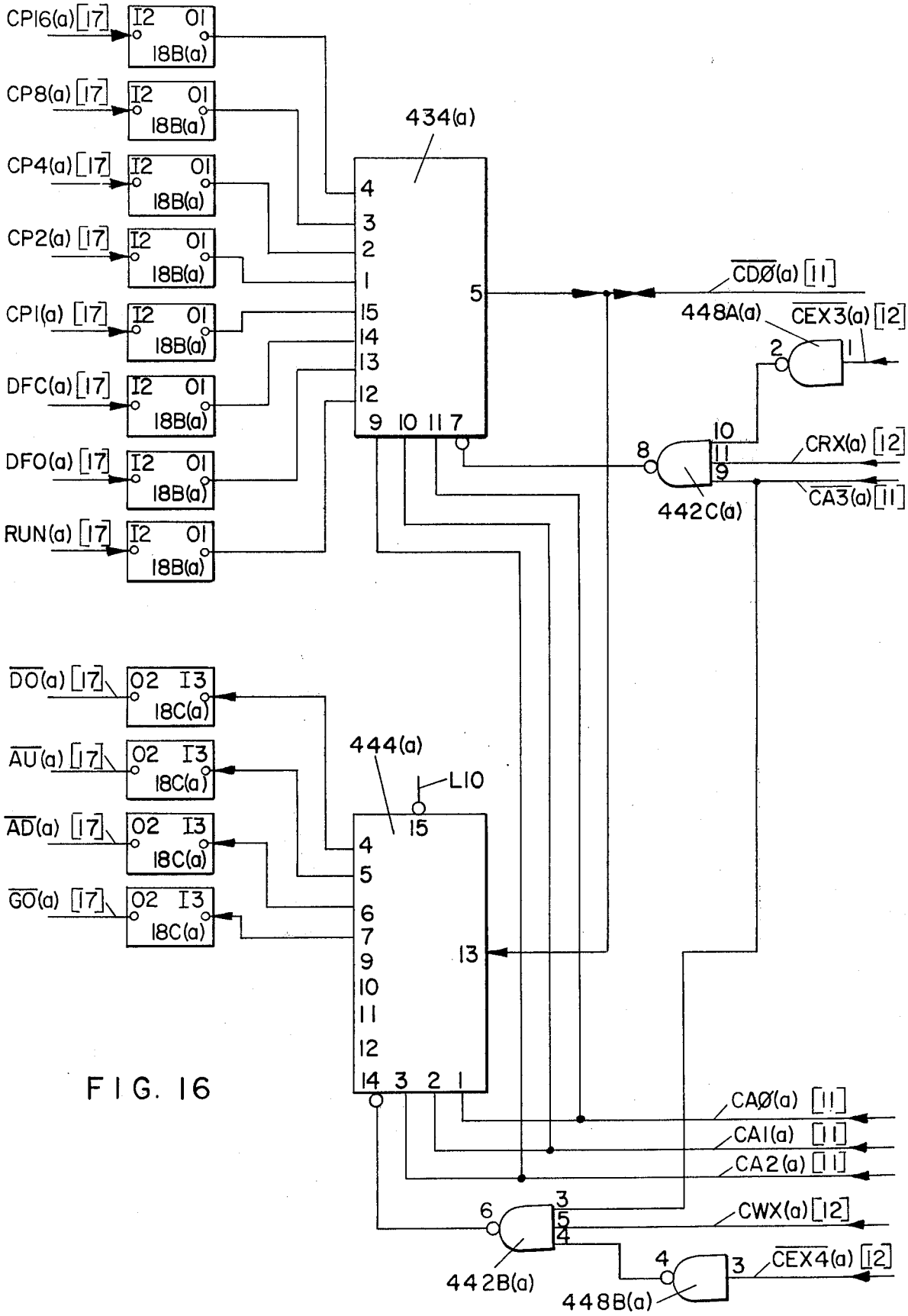
Figure 17:
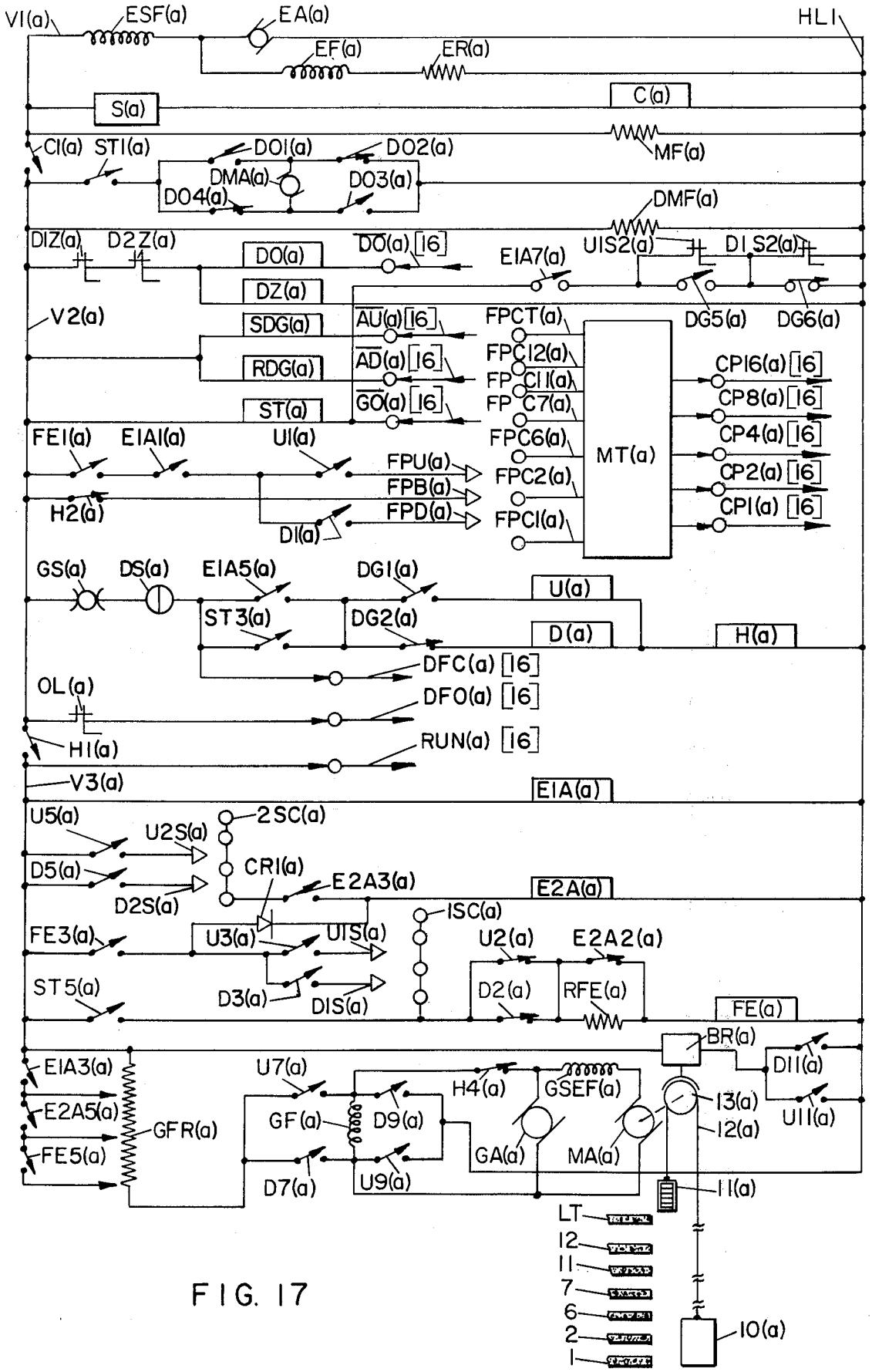
Figure 19:
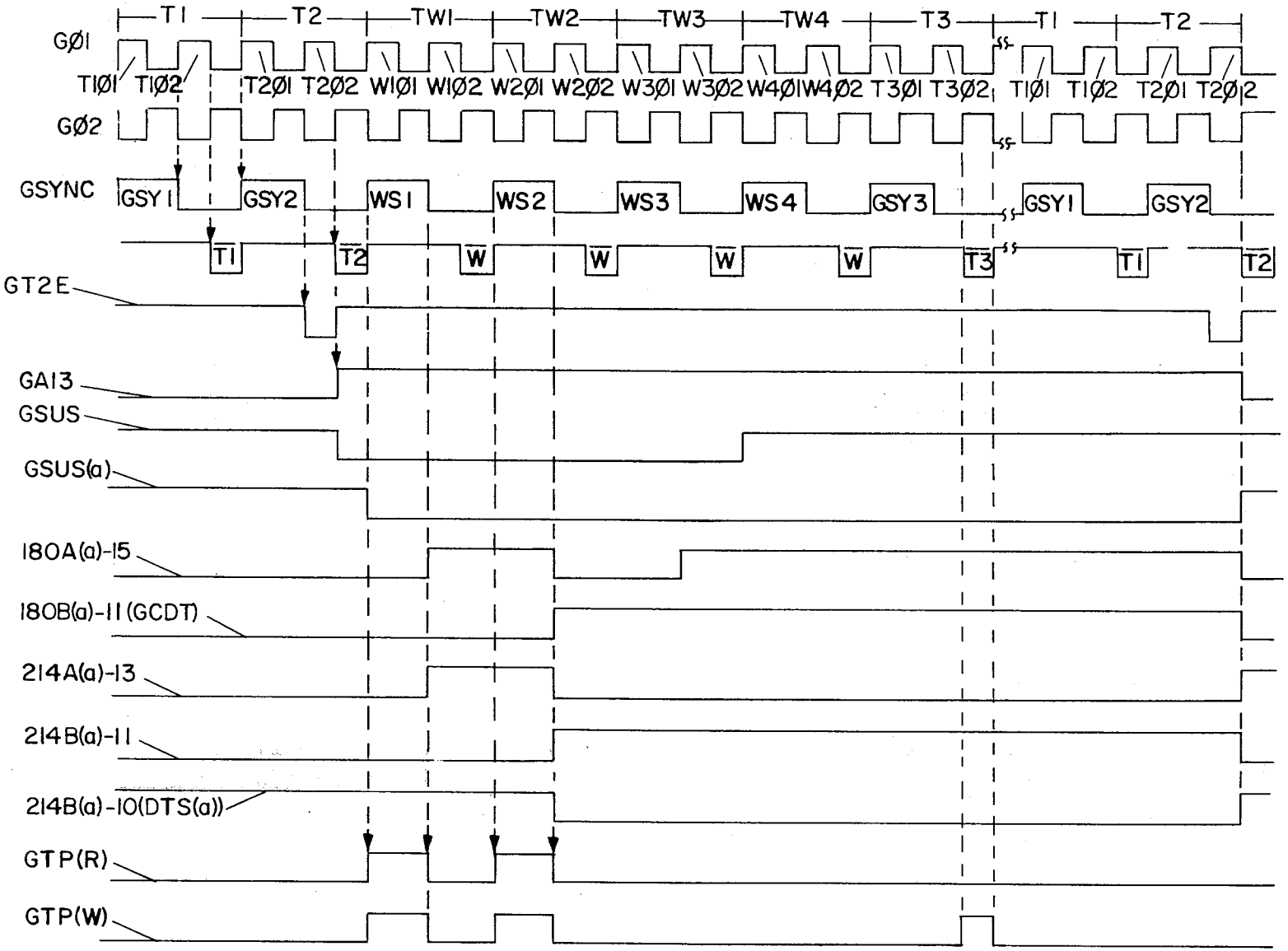

FIGS. 4, 5 and 6 combined are a simplified schematic diagram of a portion of the circuitry of the control system of the invention for producing signals for controlling a plurality of elevator cars as a supervised group;

FIGS. 7, 8, 9A and 9B combined are a simplified schematic diagram of signal transmission circuitry for connecting the portion of the control system shown in FIGS. 4, 5 and 6 and the circuitry associated with each of the cars;

FIG. 10 is a simplified schematic diagram of signal transmission circuitry associated with a single car for connecting the circuitry shown in FIGS. 7, 8, 9A and 9B to its associated car control circuitry;

FIGS. 11, 12 and 13 combined are a simplified schematic diagram of control circuitry associated with a single car for producing signals for controlling its associated car;

FIG. 14 is a simplified schematic diagram of a portion of car call selection circuitry of the control system associated with a single car;

FIG. 15 is a simplified schematic diagram of some of the car call circuits associated with a single car including block diagram representations of car call interface circuits;

FIG. 16 is a simplified schematic diagram of car control signal selection circuitry of the system associated with a single car including block diagram representations of the car operating apparatus interfacing circuitry;

FIG. 17 is a simplified schematic diagram of the car operating apparatus associated with a single car;

FIGS. 18A, 18B and 18C are schematic diagrams of the interface circuitry utilized in each of the blocks shown in FIGS. 2, 15 and 16; and FIG. 19 is a timing diagram illustrating the characteristics of some of the signals generated by the apparatus of this invention.

Figure 1A:
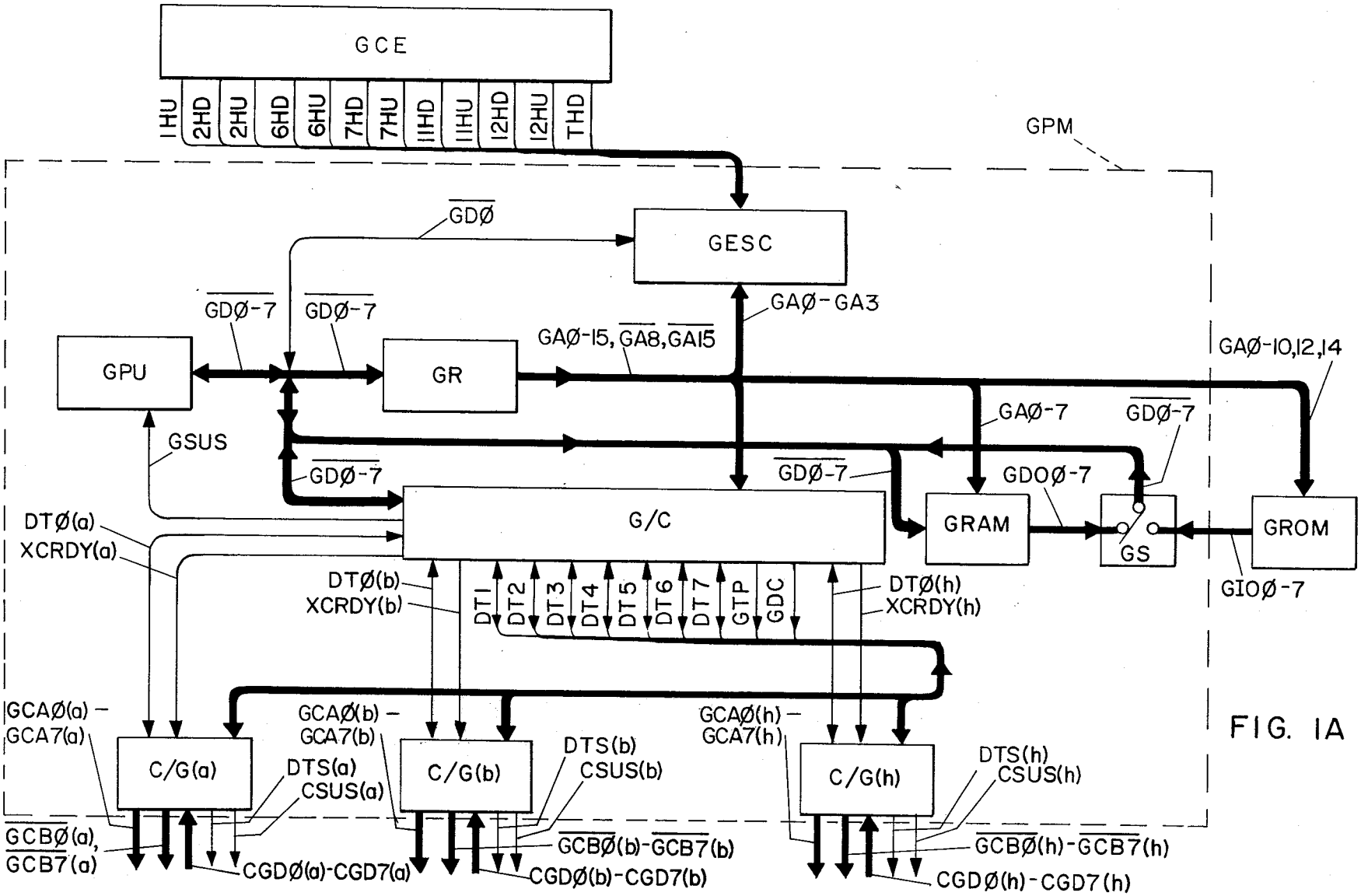
FIG. 1A is a simplified block diagram of a portion of the disclosed embodiment of the invention associated with all of the cars of an elevator installation for controlling them as a supervised group.
Figure 1B:
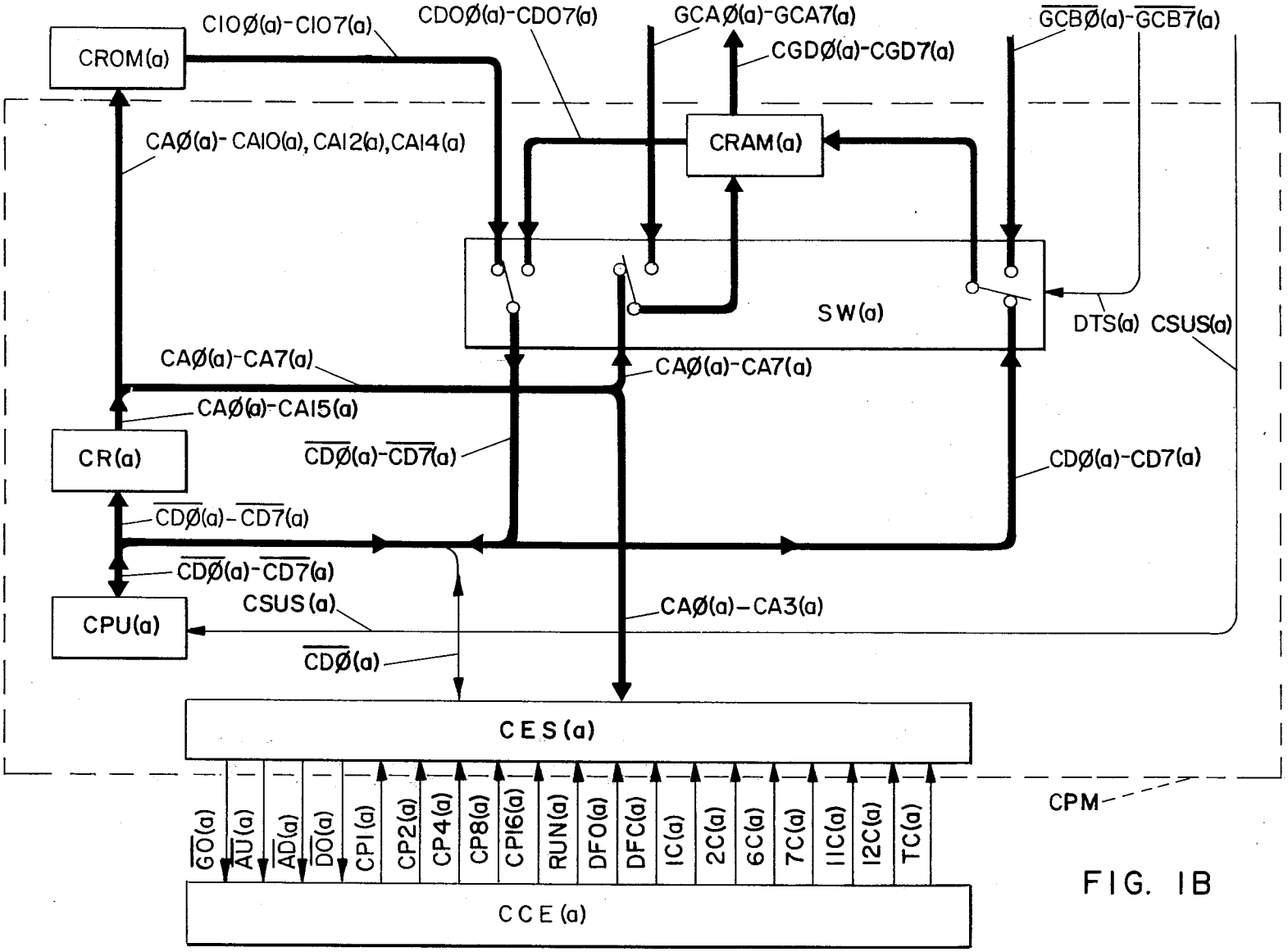
FIG. 1B is a simplified block diagram of a portion of the disclosed embodiment of the invention associated with a single car of an elevator installation for controlling its associated car.

The simplified block diagrams shown in FIGS. 1A and 1B illustrate a control system for use in an elevator installation having a plurality of cars *a, b . . . h* (*c* through *g* not shown) serving a plurality of floors of a building (not shown). The elevator installation includes group control equipment shown as a solid line rectangular block GCE (FIG. 1A) common to the cars *a, b . . . h* and car control equipment shown as a rectanguar block CCE(a) (FIG. 1B) individual to car "a". The control system comprises group processing means GPM (FIG. 1A), car processing means CPM (FIG. 1B) both represented by dashed line rectangular blocks and program storage means shown as separate solid line rectangular blocks GROM and CROM(*a*) (FIGS. 1A & 1B) respectively.

As shown group processing means GPM and car processing means CPM include a plurality of circuits shown as various solid line rectangular blocks interconnected by lines of two thicknesses. The narrower of the two lines represents individual signal line connections between circuits and the broader lines indicate a plurality of signal line connections between circuits. Both types of signal lines shown in FIGS. 1A and 1B have also been shown with appropriate arrowheads to indicate where desirable the direction of signal flow between the various blocks representing the circuits. In viewing the block diagram it should be understood that the blocks having an additional small letter in parenthesis appended to their reference characters represent circuitry individually associated with a respective car of the elevator system. Furthermore in viewing FIG. 1B it is to be understood that the block diagram represents the circuitry associated with car "*a*" and it is also to be understood that similar circuitry is provided for each additional car of an elevator installation. Because the circuitry associated with each of the cars is similar, the herein disclosed embodiment of the invention has been simplified where deemed practical by showing only the circuitry associated with car "*a*" although it is to be understood that the equipment shown is capable of use in a system having up to eight cars, *a – h*.

Group processing means GPM (FIG. 1A) comprising a group processor GPU and associated group logic circuitry shown as a plurality of rectangular blocks in FIG. 1A is shown connected to group program storage means GROM, group control equipment GCE and car processing means CPM (FIG. 1B). As indicated in FIG. 1A bi-directional signal lines $\overline{GD\phi\text{-}7}$ interconnect group processor GPU and its associated group logic circuitry including group to car logic circuitry G/C, group data storage means GRAM and group register GR. The output lines GA$\phi$-15 of the group register GR interconnect group to car logic circuitry G/C, group data storage means GRAM, group program storage means GROM, and group equipment selection circuitry GESC.

Lines GIO-7 and GDO$\phi$-7 connect group program storage means GROM and group data storage means GRAM to the group switching means GS and lines $\overline{GD\phi\text{-}7}$ connect group switching means GS to the group processor GPU.

Individual signal lines 1HU, 2HU . . . THD connect the group control equipment GCE to the group equipment selection circuitry GESC to receive signals representing registered hall calls and apply them along line $\overline{GD\phi}$ to group processor unit GPU. In addition group processor unit GPU applies signals along line $\overline{GD\phi}$ to group equipment selection circuitry GESC to have it transmit hall call reset signals along lines 1HU, 2HD . . . THD, to group control equipment GCE.

As illustrated in FIG. 1A, lines DT$\phi$(a), DT$\phi$(6) . . . DT$\phi$(h) connect the group to car logic circuitry G/C individually to car to group logic circuits also included as part of the group processing means shown as rectangular blocks C/G(*a*), C/G(*b*) and C/G(*h*). Those for cars, *c* through *g* are not shown for simplification purposes. In addition seven signal lines DT1 – DT7 connect the group to car logic circuitry G/C to each of the car to group logic circuits C/G(*a*) etc.

Three additional individual signal lines XCRDY(*a*), XCRDY(*b*) and XCRDY(*h*) are shown in FIG. 1A, it being understood that similar lines for cars *c* through *g* are not shown for simplification. These lines connect the group to car logic circuitry G/C to the car to group logic circuits C/G(*a*) etc. illustrated in FIG. 1A. Group to car logic circuitry G/C is also connected by line GSUS to the group processor GPU (FIG. 1A).

The block diagram representation of the car processing means CPM (FIG. 1B) is shown with reference characters having an appended suffix "(*a*)" representing the circuitry of the control system associated with car "*a*". Because of the similarity of the circuitry associated with each car the following description of FIG. 1B although limited to the circuitry associated with car "*a*" will be understood to be also applicable to the remaining car associated circuits (not shown).

Car processing means CPM comprises a car processor CPU(*a*) and associated car logic circuitry shown as a plurality of rectangular blocks connected between car processor CPU(*a*), car program storage means CROM(*a*), car control equipment CCE(*a*), and car to group logic circuitry C/G(*a*) of group processing means GPM (FIG. 1A).

As shown in FIG. 1B bidirectional signal lines $\overline{CD\phi(a)}$ – $\overline{CD7(a)}$ interconnect car processor CPU(*a*) with car data switching means SW(*a*) and car register CR(*a*). The output lines CA$\phi$(*a*) – CA15 from car register CR(*a*) interconnect it with car data switching means SW(a), car program storage means CROM(*a*), and car equipment selection circuitry CES(*a*). Car data switching means SW(*a*) is also connected to the car to group logic circuitry C/G(a) (FIG. 1A) by means of lines GCA$\phi$(*a*) – GCA7(*a*); $\overline{GCD\phi(a)}$ – $\overline{GCD7(a)}$ and DTS(*a*). In addition car data switching means SW(a) is connected by lines CIOϕ(a) – CIO7(a) to car program storage means CROM(a) and by lines CDOϕ(a) – CDO7(a) to the car data storage means CRAM(a). Car processor CPU(a) is connected to the car to group logic circuitry C/G(a) (FIG. 1A) by means of line CSUS(a).

The schematic diagrams illustrated in a simplified manner in FIGS. 2 to 18 include a plurality of commercially made circuits identified herein by reference numerals which correspond to a particular manufacturer's part number. In this description wherein the commercially available circuitry is used, only certain input, output and control signal connections are described it being understood that those input, output or control connections not described are made in accordance with the manufacturer's standard instructions. It is also to be understood that where a particular manufacturers part number is used that is the part employed in the constructed embodiment disclosed herein. It is contemplated that equivalent parts of other manufacturers could be substituted therefor.

For the purpose of illustrating the typical and, nor, or, nand and inversion functions the standard symbols have been used. However, to identify those circuits which are common to a particular commercial part containing a plurality of such circuits each circuit of the same commercial part is identified by the same reference numeral having an appended suffix letter.

In the following description a continuous binary one level signal or voltage is indicated as being applied along a line identified by the reference characters L10 and a continuous binary level zero signal is represented as being applied along a line identified by the reference characters HL1.

Many of the signal lines are shown in more than one figure. Whenever this occurs a bracketed numeral indicative of the other figure in which the line is also shown is appended to the reference characters which identify the line.

Hall call registration circuits utilizing the well-known cold cathode gas tube touch buttons 1HU, 2HU . . . THD of the RCA type 1C21 or equivalent are shown in FIG. 2 for the main landing and landings 2 – 6, 7 – 11 and 12 – T as similarly shown in U.S. Pat. No. 3,614,995. The operation of the constructed embodiment described herein was patterned on the operation of the system of that patent and its disclosure is incorporated by reference herein for simplification purposes. A complete description of the operation of the buttons is found in that patent. While only certain hall call registration circuits are shown herein it is to be understood that similar circuits are provided for other landings. Each cathode of each tube is connected to terminal I1 of a different optical coupler and level converter 18A having the circuitry shown in FIG. 18A to be more fully described hereinafter. Each optical coupler and level converter 18A is also connected to line BO and line AC1 of power supply PS1. Power supply PS1 applies a potential of approximately 95 volts R.M.S. with respect to line BO along line AC1 and a potential of approximately 150 volts R.M.S. with respect to ground along line BO. For the desired operation of the hall call circuits the potential between lines AC1 and BO and lines BO and ground are 180° out of phase with each other.

Each of the gas tubes is arranged to conduct current from line B+ to BO in response to a person touching the button. This registers a hall call for the corresponding landing by applying an increased voltage from the tube cathode to the input terminal I1 of the associated optical coupler and level converter 18A which applies a binary zero signal to the line connected to the output terminal marked S. In order to cancel a registered hall call a binary zero signal is applied along the reset line 1HUR, 2HUR . . . THDR associated with the reset terminal R of the optical coupler and level converter associated with a conducting gas tube. In response to the binary zero signal applied to its reset terminal, the plate potential across the tube is reduced to a value less than its sustaining value and the tube is extinguished thereby cancelling the registered call.

Up hall call registration signals are applied along lines 1HUS, 2HUS, 6HUS, 7HUS, 11HUS and 12HUS to input pins 12, 13, 2, 3, 14 and 15 of a pair of hall call selection units 30 and 32 (FIG. 3A) of the Signetics type 74251 or equivalent. Similarly, down hall call registration signals are applied along lines 2HDS, 6HDS, 7HDS, 11HDS, 12HDS and THDS to input pins 13, 2, 3, 14, 15, and 4 of another pair of hall call selection units 34 and 36 (FIG. 3B) of the SIgnetics type 74251 or equivalent. Additional hall call registration signals are applied to other input terminals. Each of the output pins 5 of the four hall call selection units 30, 32, 34 and 36 are connected in common to line $\overline{GD\phi}$ to transmit a binary signal to group processor GPU (FIG. 4) corresponding to a selected hall call. The hall call which causes the corresponding binary signal to be transmitted along line $\overline{GD\phi}$ is selected by applying a three bit binary signal along lines GAϕ, GA1 and GA2 to the data selection input pins 9, 10 and 11 of a particular one of four units and a binary zero signal along line $\overline{EU1}$, $\overline{EU2}$, $\overline{ED1}$, or $\overline{ED2}$ to the enable pin 7 of that one of the four units in a manner to be explained hereinafter.

Figure 3A:
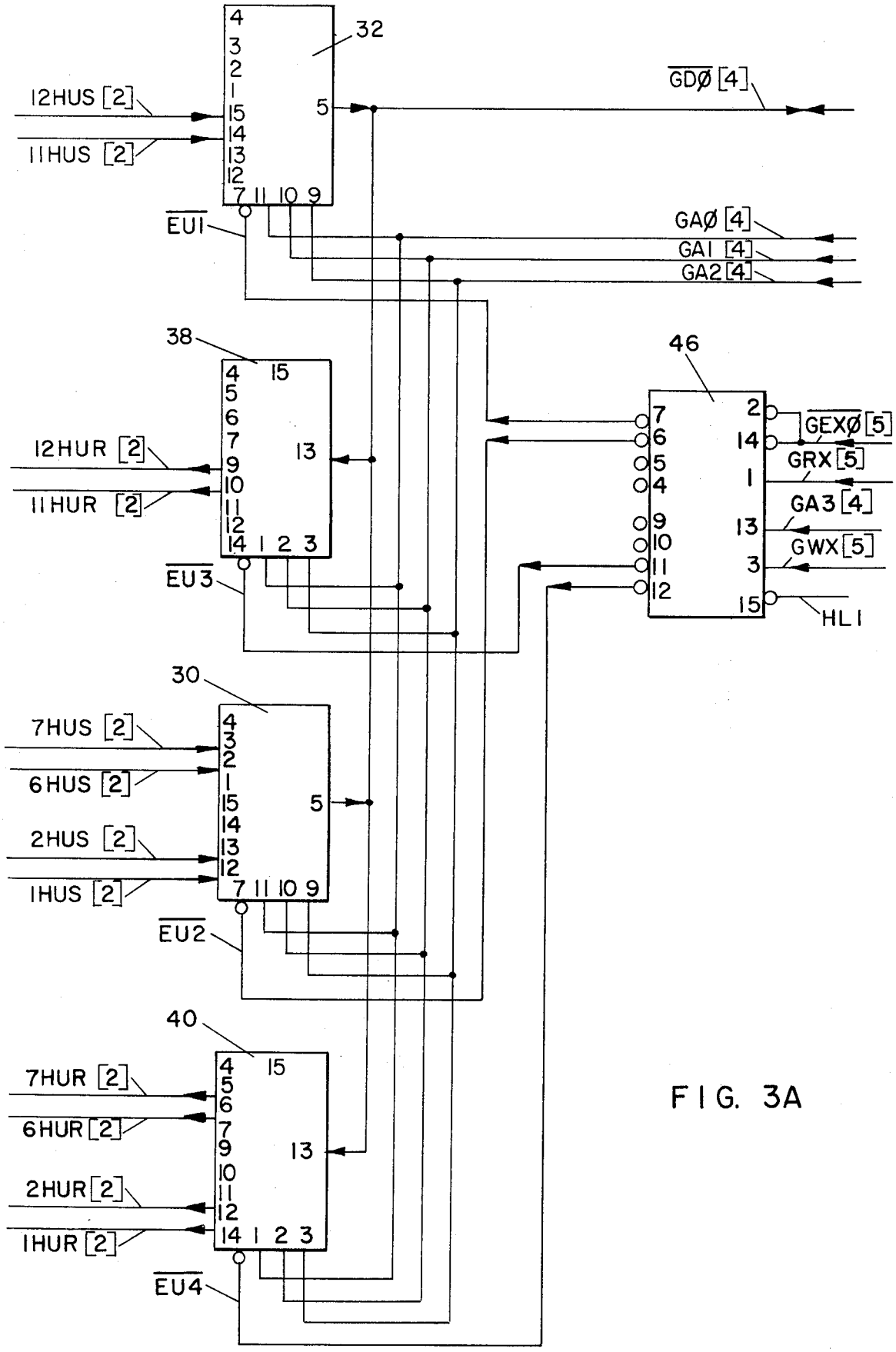
FIG. 3A and 3B are simplified schematic diagrams of a portion of hall call selection circuitry of the control system of the invention associated with the hall call circuits shown in FIG. 2.
Figure 3B:
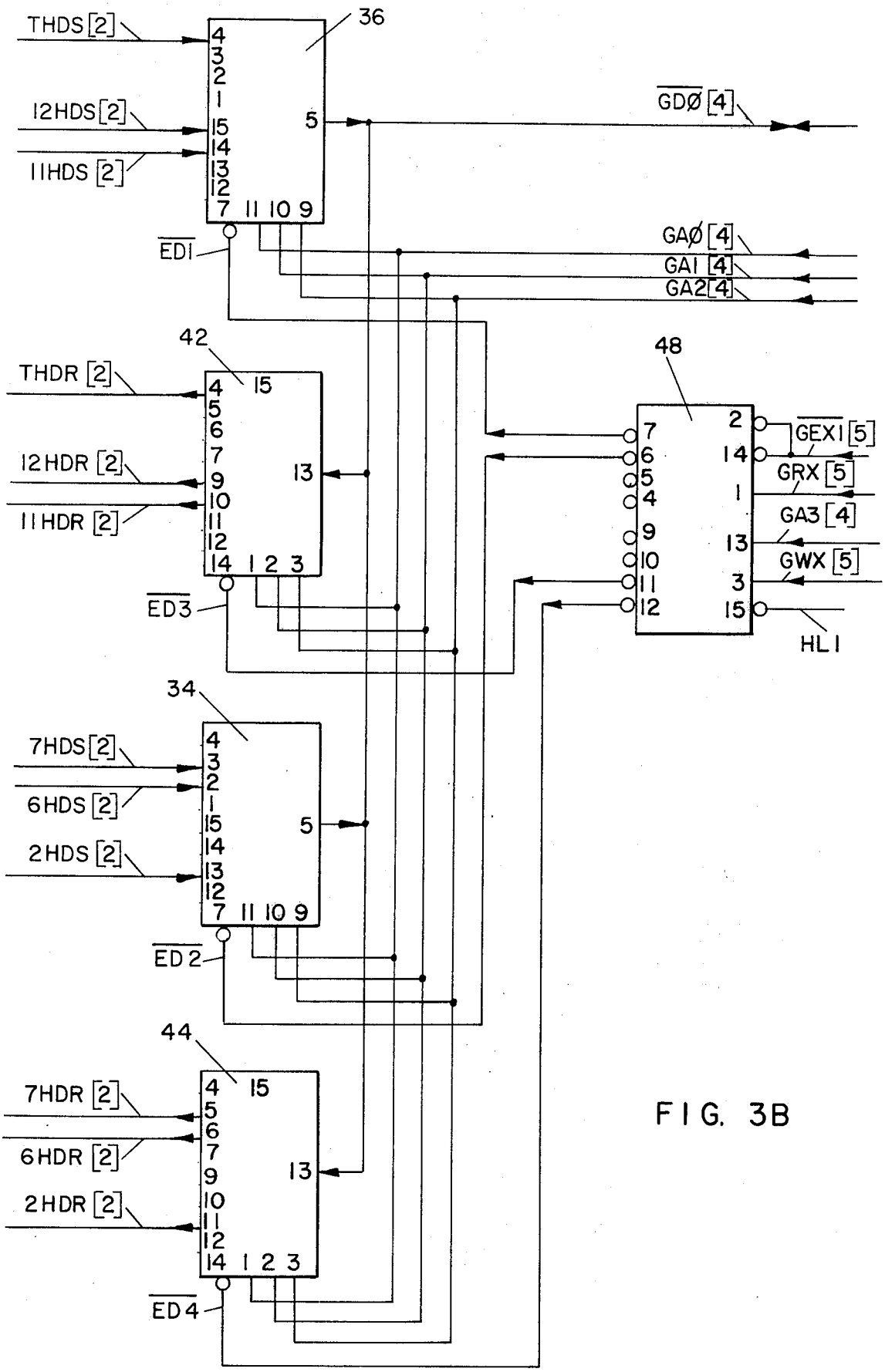

Line $\overline{GD\phi}$ is also common to the input pins 13 of four eight bit addressable latches of the Fairchild type 9334 or equivalent used as hall call reset signal selection units 38, 40, 42 and 44 of FIGS. 3A and 3B. A hall call reset signal is selectively applied from one of the output pins 4, 5, 6, 9, 10, 11 or 12 of one of the four units along line 1HUR, 2HDR . . . THDR to the reset terminal of a selected optical coupler and level converter 18A (FIG. 2) in response to a reset signal being applied to pin 13 of the corresponding unit along line $\overline{GD\phi}$, to three bit binary signal being applied along lines GAϕ, GA1 and GA2 to the data selection pins 1, 2 and 3 of the corresponding reset unit 38, 40, 42 or 44 and a binary zero signal being applied along lines $\overline{EU3}$, $\overline{EU4}$, $\overline{ED3}$ or $\overline{ED4}$ to the enable pin 14 of the selected unit.

Signal transmission of hall call registration and reset signals is enabled by a pair of Dual 2-Line to 4-Line Decoder/Demultiplexer units 46 and 48 used as selection devices of the Signetics type 74155 or equivalent. The first of these units shown as a rectangular block 46 in FIG. 3A has its input pins 2 and 14 connected by line $\overline{GEX\phi}$ to external interface circuit 72 (FIG. 5). As shown lines GRX and GWX connect input pins 1 and 3 to the circuitry shown in FIG. 5 while pin 15 is maintained at ground potential. In addition line GA3 connects input pin 13 of unit 46 to the group register GR (FIG. 4). In response to the signals applied to its input pins unit 46 applies a binary zero signal from its output pins 11 or 12 along the lines $\overline{EU3}$ and $\overline{EU4}$ to pins 14 of hall call reset signal units shown as blocks 38 and 40 (FIG. 3A) respectively or from its output pins 6 and 7 along lines $\overline{EU2}$ or $\overline{EU1}$ to pins 7 of the hall call registration signal units shown as blocks 30 and 32 respectively in FIG. 3A.

The second of Decoder/Demultiplexer units shown as a rectangular block 48 in FIG. 3B is enabled to operate in response to a binary zero signal applied along line $\overline{GEXI}$ from unit 72 of FIG. 5 to its input pins 2 and 14. The input pins 15, 3, 13 and 1 of unit 48 (FIG. 3B) are connected to ground potential along line HLl, line GWX, line GA3 and line GRX respectively. This unit operates in the same manner as unit 46 described above to produce binary zero signals which are applied to pins 7, 6 or 11, 12. Unit 48 applies a binary zero signal from pin 7 or 6 along line $\overline{ED1}$ or $\overline{ED2}$ to input pins 7 of the hall call registration signal units shown as blocks 36 and 34 respectively or from pin 11 or 12 along line $\overline{ED3}$ or $\overline{ED4}$ to pins 14 of the hall reset signal units shown as blocks 42 and 44 respectively in FIG. 3B.

FIGS. 4, 5 and 6 combined show a simplified schematic of the interconnections between the group processor unit GPU and associated circuitry which form a part of the group processing means illustrated in block diagram form in FIG. 1A. Although it is contemplated that equivalent units could be satisfactorily employed, the group processor unit GPU of the constructed embodiment is an Intel Single Chip 8-Bit Parallel Central Processor Unit type 8008 and includes six 8-bit data registers, an 8-bit accumulator, two 8-bit temporary registers, a memory stack for storing program and subroutine addresses and an 8-bit parallel binary arithmetic unit which implements addition, subtraction and logical operations. Each of these operations is performed in a predetermined number of time states or machine cycles T1, T2, T3, T4, T5, T1I, WAIT and STOPPED, each requiring two time periods of a clock pulse signal applied to pins 16 and 15 of the group processor unit GPU by 800K HZ oscillator 50.

Free running oscillator 50 (FIG. 4) may be of any well-known variety which produces a pair of complementary pulsed signals of approximately 800K HZ and having a pulse width of one-half its period. These pulses are applied along lines G$\phi$1 and G$\phi$2 and to input pins 16 and 15 respectively of group processor GPU (FIG. 4). These pulses have the characteristics shown in the timing diagram of FIG. 19, adjacent the reference character G$\phi$1 and G$\phi$2. In response to the 800K HZ pulsed signals applied to it group processor GPU generates a pulse signal of approximately 400K HZ having a pulse width of one-half its period at its output pin 14 along line GSYNC to the external group logic circuitry. The signal applied along line GSYNC has the characteristic shown in the timing diagram of FIG. 19 adjacent reference character GSYNC. Lines GS$\phi$, GS1 and GS2 (FIGS. 4 and 5) connect group processor pins 13, 12, and 11 and pins 3, 2 and 1 respectively of a 3-to-8 line decoder unit 70 of the Signetic type 74S138 (FIG. 5) variety or its equivalent.

A normally open switch GST (FIG. 4) having one terminal connected to line HL1 and its second terminal connected to pin 18 of group processor GPU is manually actuated to its closed position to enable an operator to zero the internal program counter of the group processor. Line GSUS is connected to pin 17 of the group processor GPU and to group logic circuitry of FIG. 9A which will be described hereinafter.

As shown in FIG. 4, lines GD$\phi$, GD1 . . . GD7 connect the group processor data bus pins 9, 8, . . . 2 to a pair of 4-bit parallel bidirectional bus diver units 54 and 56 of the Intel type 8226 variety or their equivalent. The bidirectional data bus pins 3, 6, 10 and 13 of the pair of bus drivers 54 and 56 are connected to lines $\overline{GD\phi}$, $\overline{GD1}$ . . . $\overline{GD7}$ respectively to transmit an eight bit address signal and an eight bit code signal to the D input pins 2, 3, 6 and 7 of four quadruple bistable latches 58, 60, 62 and 64 of the Signetics type 7475 variety of their equivalent. The four latches 58, 60, 62 and 64 correspond to group register GR of FIG. 1A and have been so identified in FIG. 4. Lines $\overline{GD\phi}$, $\overline{GD1}$ . . . $\overline{GD7}$ are also connected to the output pins 4, 7, 9 and 12 of a pair of tristate quad two data selectors/multiplexers 66 and 68 of the Signetics type 74258 variety or their equivalent. These are identified as group control switch GS in FIGS. 1A and 4. They transmit group data signals along lines $\overline{GD\phi}$–$\overline{GD7}$ from the group data storage means GRAM (FIG. 6) and group processor instruction signals from the group program storage means GROM (FIG. 6) to the bidirectional data bus pins 3, 6, 10 and 13 of units 54 and 56. In addition as indicated by the bracket appended to line segments $\overline{GD\phi}$, $\overline{GD1}$ . . . $\overline{GD7}$ shown at the top of FIG. 4, these lines are connected to circuitry to be described and to the input pins of a plurality of inverters shown in FIG. 6 which have their output pins connected to the data storage means GRAM of that Figure.

Quadruple bistable latch units 58 and 62 of group register GR receive the 8-bit address signal applied to their D input pins 2, 3, 6 and 7 and operate to apply the complements of those signals along lines GA$\phi$, GA1 . . . to the circuitry shown in FIG. 6 in response to a binary one level pulsed signal applied along line GT1 to their clock input pins 4 and 13. In addition quadruple bistable latch units 60 and 64 of group register GR receive the 8-bit code signal applied to their D input pins 2, 3, 6 and 7 and operate to apply corresponding and complementary signals along lines GA8, GA9 . . . GA15, $\overline{GA8}$, $\overline{GA9}$ . . . $\overline{GA15}$ to the group logic circuitry of FIGS. 5, 6, 7, 8, 9A and 9B in response to a binary one level pulsed signal applied to their clock input pins 4 and 13 along line GT2.

Lines GSS, GSR, $\overline{GCS}$ and $\overline{GD1EN}$ connected to control pins 1 and 15 of data selectors 66 and 68 and of bus drivers 54 and 56 connect those pins to apparatus of FIG. 5 to be described later.

Group processor GPU applies a 3-bit binary coded timing state identification signal along lines GS$\phi$, GS1 and GS2 from its output pins 13, 12, and 11 respectively to the select input pins 1, 2 and 3 of a decoder/demultiplexer unit 70 (FIG. 5) of the Signetics type 74S183 variety or its equivalent. Decoder 70 used as a 3-to-8 line decoder applies signals along lines $\overline{GT2}$, $\overline{GT1}$, $\overline{GT1I}$ and $\overline{GT3}$ from its output pins 14, 13, 12 and 11 respectively to the group logic circuitry shown in FIGS. 4, 5 and 9A.

Lines GA14 and GA15 connect the select input pins 2 and 3 of 2-to-4 line decoder unit 74 (FIG. 5) to the $\overline{Q}$ output pins 11 and 8 of bistable latch unit 54 (FIG. 4). Decoder 74 is of the Signetics type 74S139 variety or its equivalent. Decoder unit 74 has two additional select input pins 14 and 13 shown connected by lines GA10 and GA11 to the $\overline{Q}$ output pins 11 and 8 respectively of bistable latch 60 (FIG. 4). Enable input pins 1 and 15 of unit 74 are connected by line HL1 to ground and by line GA13 to output pin 14 of bistable latch 64 (FIG. 4) respectively.

Decoder unit 74 applies a group storage selection signal fronm output pin 10 along line GSS to the select input pins 1 of the pair of data selector units 66 and 68 (FIG. 4). Two additional output pins 11 and 12 are shown connected to the input pins 13 and 12 respectively of 2-input And gate 80D which has its output pin 11 connected by line GRSE to two strobe input pins 18 and 19 of a 4-to-16 line decoder/demultiplexer unit 90 (FIG. 6) of the Signetics type 74154 variety or its equivalent.

Output pin 11 of And gate 80D is also connected to input pin 2 of Nand gate 84A which has its second input pin 1 connected to output pin 10 of decoder unit 74. Output pin 3 of Nand gate 84A is connected to input pin 5 of 2-input Nand gate 84B which has its second input pin 4 connected by line GRX to output pin 3 of And gate 80A shown in the upper right hand corner of FIG. 5. Nand gate 84B applies a read group storage signal along line GSR to the control output pins 15 of the pair of data selectors 66 and 68 (FIG. 4).

One-half of dual J-K master slave flip-flop 78B of the Signetics type 7476 variety or its equivalent has its preset input pin 7 connected to the output pin 8 of two input Nand gate 84C which has its input pins 9 and 10 connected to output pins 2 and 8 respectively of a pair of inverters 86A and 86D. Lines $\overline{GPCW}$ and $\overline{GT3}$ connect the input pins 1 and 9 of the two inverters 86A and 86D to the resepective output pin 7 of 2-to-four line decoder unit 74 and output pin 11 of 3-to-8 line decoder unit 70. As shown J-K flip-flop 78B has its clear input pin 8 connected to the output pin 4 of inverter 82B which has its input pin 3 connected by line 6ϕ1 to the output of oscillator 50 (FIG. 4). The J input pin 9 and the clock input pin 6 of J-K flip-flop 78B are amintained at binary level zero represented by the line HL1 and the K input pin 12 is maintained at a binary one level represented by line L10. J-K flip-flop unit 78B applies a write signal from its Q output pin 11 along line GWX to input pins 3 of the selection devices 46 and 48 (FIGS. 3A and 3B) and to inverter 82A (FIG. 6) connected to pins 20 of a pair of read only memory units 96 and 98 (FIG. 6) to be hereinafter described.

A pair of D type flip-flops units 76A and 76B of the Signetics type 7474 dual D-type edge triggered flip-flops or their equivalents is shown in the upper right hand portion of FIG. 5. As show, lines $\overline{GTII}$ and $\overline{GT2}$ respectively connect preset input pin 10 and clock input 11 of flip-flop 76B to output pins 12 and 14 of 3-to-8 line decoder unit 70. Line L10 connects clear input pin 13 to a binary one level signal and line HL1 connects the data input pin 12 to a binary zero level signal. As shown, line $\overline{GCS}$ connects the Q output pin 9 of flip-flop 76B to the select pins 1 of the bidirectional bus driver units 54 and 56 (FIG. 4).

Flip-flop 76A has its clear input pin 1 and its clock input pin 3 connected by lines $\overline{GT3}$ and $\overline{GT2}$ to the output pins 11 and 14 respectively of 3-to-8 line decoder unit 70. The D input pin 2 and the preset input pin 4 are connected to a binary one level signal by means of line L10. As shown, the Q output pin 5 of flip-flop 76A is connected to input pin 9 of 2-input And gate 80C. And gate 80C also receives a pulsed signal applied to its input pin 10 along line GSYNC.

Output pin 8 of And gate 80C is connected to input pin 4 of 2-input And gate 80B, to input pin 2 of And gate 80A and to input pin 11 of inverter 86E. Two input And gate 80B also receives a signal applied to its input pin 5 along line $\overline{GPCW}$ from output pin 7 of 2-to-4 line decoder unit 74 and applies a signal from its output pin 6 along line $\overline{GDIEN}$ to the data in direction enable control pins 15 of bidirectional bus driver units 54 and 56 (FIG. 4). As shown, And gate 80A also receives a second signal applied to its input pin 1 along line $\overline{GA14}$ from output pin 10 of bistable latch unit 64 (FIG. 4) and is connected to apply a signal along line GRX to input pin 4 of And gate 84B.

Three to eight line decoder 72 of the Signetics type 74S138 shown in FIG. 5 has two of its enable input pins 4 and 5 connected to output pin 9 of 2-to-4 line decoder unit 74 and its third enable input pin connected to a binary one level signal represented by the L10. Lines GA4, and GA5 and GA6 connect the output pins 8, 11 and 14 of bistable latch 62 (FIG. 4) to the input pins 1, 2 and 3 respectively of 3-to-8 line decoder to cause it to apply a binary zero level signal along one of the lines $\overline{GEX0}$, $\overline{GEX1}$ . . . $\overline{GEX7}$ connected to its output pins 15, 14, 13, 12, 11, 10, 9 and 7.

That portion of the program storage means associated with group processor GPU (FIG. 4) and identified in FIG. 1B as the group program storage means GROM is shown in FIG. 6 as a pair of read only memory units 92 and 94. It is to be understood that the number of such units varies with the complexity of the stored program and although not shown the constructed embodiment of the invention utilizes twelve 2048 Bit Electrically Programmable Read Only Memory Units of the Intel Silicon Gate MOS type 1702A. Each one of the twelve units has its address input pins 3, 2, 1, 20, 21, 19, 18 and 17 connected in parallel to output pins 1, 14, 11 and 8 of bistable latch unit 58 (FIG. 4) and output pins 1, 14, 11 and 8 of bistable latch unit 62 (FIG. 4) by means of lines GA0, GA1, GA2, GA3, GA4, GA5, GA6, and GA7 respectively in the manner in which the two ROM units 92 and 94 shown in FIG. 6 are connected to units 58 and 62 (FIG. 4).

Each one of the twelve units also has its data output pins 4, 5, 6, 7, 8, 9, 10 and 11 connected in parallel to lines GIO0, GIO1, GIO3, GIO4, GIO5, GIO6 and GIO7 which are connected to the input pins 3, 6, 10 and 13 of the pair of data selector units 66 and 68 (FIG. 4). Additionally each of the twelve ROM units has its selection pin 14 individually connected to a different one of the ouput pins 1, 2, 3, 4, 5, 6, 7, 8, 9, 10, 11 and 13 of a 4-to-16 line decoder demultiplexer unit 90 of the Signetics Type 74154.

The 4-to-16 line decoder/demultiplexer 90 decodes the four binary coded signals applied to its input pins 23, 22, 21 and 20 along lines GA8, GA9, GA10 and GA12 from output pins 1,14 and 11 of bistable latch 60 (FIG. 4) and from output pin 1 of bistable latch 64 (FIG. 4) and applies a binary zero level signal to one of its twelve mutuallly exclusive output pins 1–11 and 13 when a binary zero signal is applied along line GRSE to its strobe input pins 18 and 19 from output pin 11 of And gate 80D (FIG. 5).

Shown in the upper portion of FIG. 6 is that portion of the group logic circuitry referred to hereinafter as group data storage means GRAM comprising a pair of 1024 Bit Static MOS RAMS with separate I/O of the Intel type 8101. Each one of the pair of RAMS identified as units 96 and 98 in FIG. 6 has its address input pins 4, 3, 2, 1, 21, 5, 6 and 7 connected in parallel to group address portion of the group register GR (FIG. 4) by means of lines GA0, GA1, GA2, GA3, GA4, GA5, GA6 and GA7 respectively. The random access memory unit 96 has its data input pins 9, 11, 13, and 15 connected to the output pins 2, 4, 6 and 8 of inverters 98A, 98B, 98C and 98D respectively. Lines $\overline{GD0}$, $\overline{GD1}$, $\overline{GD2}$, and $\overline{GD3}$ connect the input 1, 3, 5 and 9 of inverters 98A, 98B, 98C and 98D to the output pins 3, 6, 10, and 13 of the bidirectional bus driver 54 shown in FIG.

4. Similarly random access memory unit 98 has its input pins 9, 11, 13, and 15 connected to the output pins 2, 4, 6, 8 of inverters 100A. 100B. 100C, and 100D respectively. Lines $\overline{GD4}$, $\overline{GD5}$, $\overline{GD6}$ and $\overline{GD7}$ connect the input pins 1, 3, 5 and 9 of the inverters 100A, 100B, 100C and 100D to the output pins 3, 6, 10 and 13 of the bidirectional bus driver 56 shown in FIG. 4.

The read-write enable input pins 20 of the pair of random access memory units 96 and 98 are connected to the output pin 2 of inverter 82A. Line GWX connects the input pin 1 of inverter 82A to the output pin 11 of J-K flip-flop 78B shown in FIG. 5. The output disable pins 18 and enable pins 19 of each of the units 96 and 98 are both connected to output pin 10 of 2-to-4 line decoder unit 70 (FIG. 5) by means of line GSS. The chip enable pins 17 of units 96 and 98 are connected to a binary one level signal as indicated by line L10.

Figure 7:
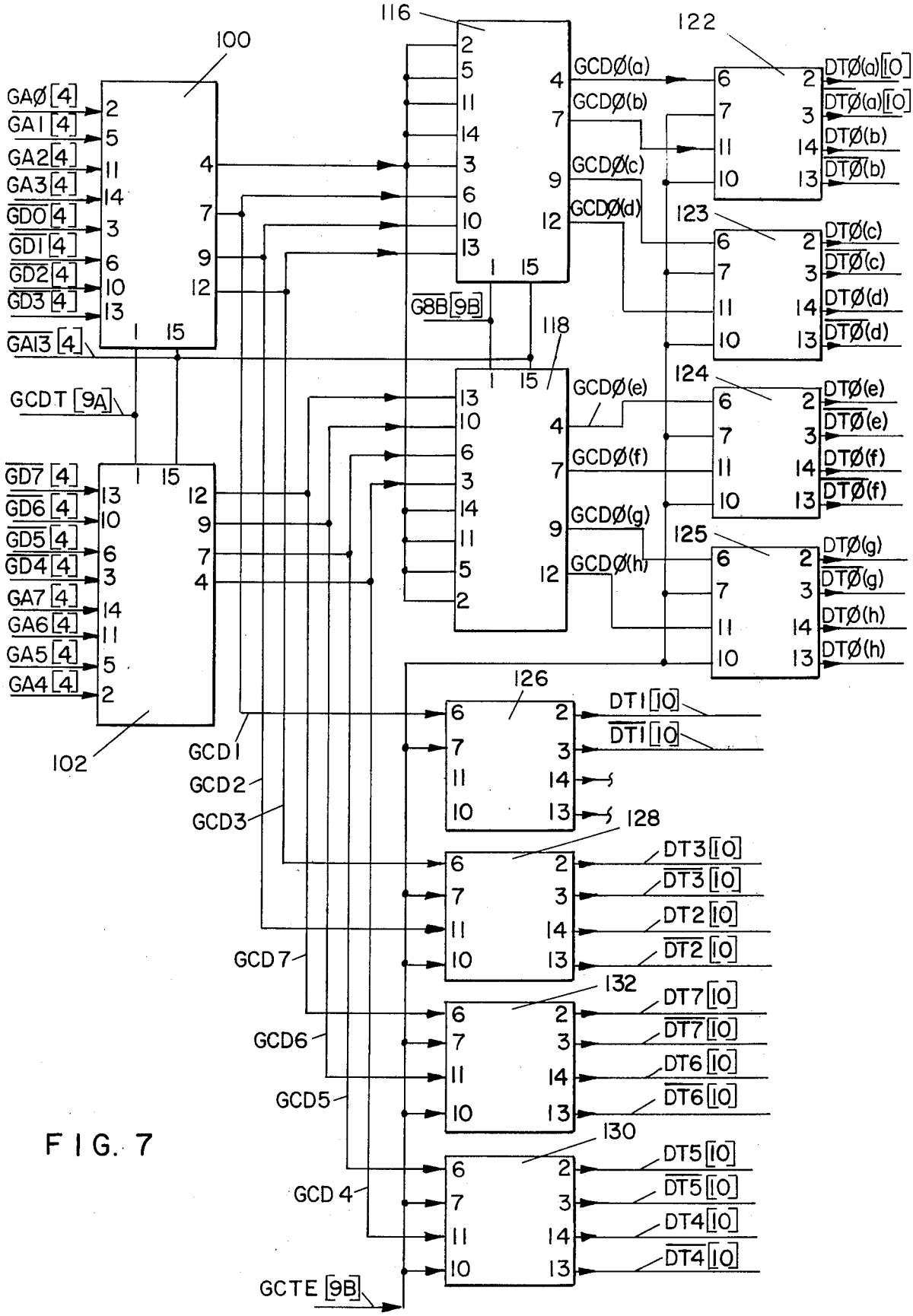

In the upper left hand corner of FIG. 7 is shown a pair of quadruple 2-input data selector/multiplexer units 100 and 102 of the Signetics type 74157. The first pair of quadruple input pins 2, 5, 11 and 14 data selectors 100 and 102 are connected by lines GA0, GA1 . . . GA7 to the output pins 1, 14, 11 and 8 of bistable latch units 58 and 62 shown in FIG. 4. The second pair of quadruple input pins 3, 6, 10 and 13 of data selectors 100 and 102 are connected by lines $\overline{GD0}$, $\overline{GD1}$, . . . $\overline{GD7}$ to the output pins 3, 6, 10 and 13 of bidirectional bus drivers 54 and 56 shown in FIG. 4. Line GCDT connects the select input pins 1 of data selectors 100 and 102 to the output pin 11 of J-K flip-flop 180B (FIG. 9A) forming part of a data transfer signal generator to be hereinafter descirbed.

Output pin 4 of data selector 100 is connected in common to input pins 2, 5, 11 and 14 of each unit of a second pair of quadruple 2-input data selector/multiplexer units 116 and 118 (FIG. 7) also of the Signetics type 74157. Output pin 4 of selector unit 100 is also connected to input pin 3 of selector unit 116. Output pins 7, 9 and 12 of data selector 100 are respectively connected to input pins 6, 10 and 13 of data selector 116. Output pins 4, 7, 9 and 12 of data selector 102 are respectively connected to the second set of quadruple input pins 3, 6, 10 and 13 of data selector 118. Line $\overline{G8B}$ connects the select input pins 1 of data selectors 116 and 118 to the output pin 6 of inverter 170C (FIG. 9B) to be hereinafter described. Line $\overline{GA13}$ connects the strobe input pins 15 of the four data selector units 100, 102, 116 and 118 (FIG. 7) to the output pin 15 of bistable latch 64 (FIG. 4).

The output pins 4 and 7 of data selector 116 (FIG. 7) are connected to input pins 6 and 11 respectively of a dual differential line driver 122 of the Texas Instrument type 75113. The output pins 12 and 9 of data selector 118 are connected to input pins 6 and 11 of a second dual differential line driver 125 of the type 75113. Although it has not been shown in FIG. 7 it is understood that 2 additional differential line drivers of the type 75113 are connected in the same manner to the output pins 9 and 12 of data selector 116 and the output pins 7 and 4 of data selector 118.

The upper half of dual differential line driver 122 applies signals from output pins 2 and 3 along lines DT0(*a*) and $\overline{DT0}$(*a*) which are connected to the input pins 11 and 9 respectively of dual differential line receiver 236 (*a*) (FIG. 10). It is to be understood that the circuitry shown in FIG. 10 is employed with car "*a*" only and that circuitry similar to that of FIG. 10 is provided for each of the cars in the system. Thus, output pins 14 and 13 of dual differential line driver 122 connected to lines DT0(*b*) and $\overline{DT0}$(*b*) are thereby connected to logic circuitry associated with car "*b*" (not shown) but similar to that of FIG. 10 for car "*a*". It is to be understood that similar connections are to be made from the output pins of additional dual differential line drivers, not shown, for cars "*c*", "*d*", "*e*" and "*f*" to those portions of the group logic circuitry associated with those cars which circuitry also is not shown. The dual differential line driver unit 125 has its output pins 2, 3, 14 and 13 connected by bidirectional signal transmission lines DT0(*g*), $\overline{DT0}$(*g*), DT0(*h*) and $\overline{DT0}$(*h*) for cars "*g*" and "*h*" to circuitry associated with cars *g* and *h* (not shown) similar to that of FIG. 10 for car "*a*".

Four additional dual differential line drivers of the type 75113 are also shown in FIG. 7 as a solid line rectangular blocks 126, 128, 130 and 132. As shown input pin 6 of the line driver 126 is connected to output pin 7 of data selector 100. The remaining two output pins 9 and 12 of data selector 100 are respectively connected to input pins 11 and 6 of line driver 128. Output pins 4 and 7 of data selector 102 are connected to the input pins 11 and 6 of line driver 130. Output pins 9 and 12 of data selector 102 are connected to input pins 11 and 6 of line driver 132. The dual differential line drivers 126, 128, 130 and 132, apply signals along the lines DT1, $\overline{DT1}$ . . . DT7 and $\overline{DT7}$ to the input pins of dual differential line receivers 236(*a*), 238(*a*), 240(*a*) and 242(2) shown in FIG. 10 forming part of the group logic circuitry associated with car "*a*". It is to be understood that these lines $\overline{DT1}$ . . . $\overline{DT7}$, DT7 are connected to the circuitry similar to that in FIG. 10 which is individually provided for each of the additional cars of the elevator installation.

Bidirectional signal transmission lines DTϕ, $\overline{DT\phi}$ for each of the cars and lines DT1, $\overline{DT1}$, DT2 . . . DT7, $\overline{DT7}$ common to all of the cars are also connected to the input pins of a plurality of dual differential line receivers 160, 161, 162 and 163, 150, 152, 154 and 156 of the Advanced Micro Devices, type Am2615 shown in FIG. 8. Lines DT1 and $\overline{DT1}$ are connected to input pins 11 and 9 of dual differential line receiver 150. The signal on output pin 15 of differential line receiver 150 is applied to input pin 6 of tri-state quadrupled 2-data selector/multiplexer 156 of the Signetics type 74257. Similarly the signals on lines DT2, $\overline{DT2}$, DT3 and $\overline{DT3}$ are applied to the dual differential line receiver 152 which applies signals to the input pins 10 and 13 of data selector 156. The remaining eight additional signal lines DT4, $\overline{DT4}$, DT5, $\overline{DT5}$, DT6, $\overline{DT6}$, DT7 and $\overline{DT7}$ are connected to the input pins of the dual differential line receiver units 154 and 156 which have their output pins connected to the input pins 3, 6, 10 and 13 of a second tri-state quadrupled 2-data selector/multiplexer 158 as shown in FIG. 8.

Four additional dual differential line receivers 160–163 of the AMD type AM2615 are also shown in the upper left hand corner of FIG. 8. The input pins 11, 9, 5 and 7 of each dual differential line receiver 160 – 163 are connected to the bidirectional signal transmission lines DTϕ and $\overline{DT\phi}$ of two cars.

The differential line receivers 160 – 163 apply the complements of the signals applied to their input pins to a pair of data selectors 156 and 158 shown in FIG. 8. As shown output 15 and 1 of dual differential line receiver 160 are connected to the input pins 2 and 5 of data selector 156. Output pins 15 and 1 of dual differential line receiver 161 are connected to input pins 11 and 14 respectively of data selector 156. Output pins 15 and 1 of dual differential line receiver 162 are connected to the input pins 2 and 5 of the second data selector 158. Additionally dual differential line receiver 163 has its output pins 15 and 1 connected to the input pins 11 and 14 of data selector 158, respectively.

The output signals from the dual differential line receivers 160 - 163 are also applied to the input pins of a 8-line to 1-line data selector/multiplexer 164 (FIG. 8) of the Signetics type 74151. As shown common output pins 15 and 1 of each line receiver are connected to different input pins of selector 164. Output pin 5 of the selector 164 is connected to the input pin 3 of data selector unit 156. Lines GA10, GA9 and GA8 apply a three bit binary coded selection signal from the output pins 11, 14 and 1 respectively of bistable latch 60 shown in FIG. 4 to the select input pins 9, 10 and 11 of decoder 164. The strobe input pin 7 of decoder 164 is connected by line $\overline{GA13}$ to the output pin 15 of bistable latch 64 shown in FIG. 4.

The first or second car control signals to be received by the group processor GPU (FIG. 4) are applied along lines $\overline{GD\phi}$, $\overline{GD1}$ . . . $\overline{GD7}$ from the pair of tri-state quadruple 2-data selector units 156 and 158, FIG. 8, to the bidirectional bus drivers 54 and 56 shown in FIG. 4. Lines GRCE and G8B respectively connect the output control pins 15 and data select input pins 1 of data selector units 156 and 158 to the output pin 8 of Nand gate 174C (FIG. 9A) and the output pin 9 of data selector unit 200 (FIG. 9B) to be hereinafter described.

Shown in FIG. 9A is a simplified schematic diagram of that portion of the group logic circuitry referred to hereinafter as the group suspension signal generator. Line $\overline{GD5}$ connects the output pin 6 of bidirectional bus driver unit 56 (FIG. 4) to the input pin 1 of hex inverter 170A and to the K input pin 16 of J-K flip-flop 172A forming one section of a dual J-K master-slave flip-flop of the Signetics type 7476. The preset input pin 2 of J-K flip-flop 172A is connected to a binary one level signal represented by means of line L10. Clock input pin 1 of J-K flip-flop 172A is connected to output pin 4 of inverter 170B which has its input pin 3 connected to output pin 6 of a three input positive Nand gate 174B.

Nand gate 174B has its input pin 3 connected by line $G\phi 1$ to the 800K HZ oscillator 50 (FIG. 4). A second input 4 of Nand gate 174B is connected to output pin 12 of a hex inverter 176F which has its input pin 13 connected to the output pin 14 of group processor GPU (FIG. 4) by means of line GSYNC. The third input pin 5 of NAND gate 174B is connected to output pin 3 of a pair of two input Nand gate 178A and arranged with Nand gate 178C as a set reset flip-flop.

Output pin 3 of Nand gate 178A is also connected to input pin 9 of Nand gate 178C which has its second input pin 10 connected by means of line $\overline{GT2}$ to output pin 14 of three to eight line decoder unit 70 (FIG. 5). Output pin 8 of Nand gate 178C is connected to input pin 2 of Nand gate 178A which has its second input pin connected by means of line $\overline{GT1}$ to output pin 13 of the 3-to-8 line decoder unit 70.

Input pin 3 of the J-K flip-flop 172A (FIG. 9A) and input pin 2 of J-K flip-flop 180A (Signetics type 7476) are connected to output pin 12 of a three input Nand gate 174A. Line GSYNC connects input pin 1 of NAND gate 174A and clock input pin 1 of J-K flip-flop 180A to the output pin 14 of group processor GPU (FIG. 4). The remaining two input pins 2 and 13 of Nand gate 174A are connected to the Q output pins 15 and 11 respectively of the two sections 180A and 180B of a dual J-K master slave flip-flop of the Signetics type 7476 arranged as a toggle flip-flop. As shown the Q output pin 15 of J-K flip-flop 180A is also connected to the clock input pin 6 of J-K flip-flop 180B. In addition the Q output pin 11 of J-K flip-flop 180B is connected to input pin 11 of Nand gate 174C and by means of line GCDT to the select input pins 1 of the pair of data selectors 100 and 102 in FIG. 7 and to the select input pin 1 of data selector 200 shown in FIG. 9B.

Clear input pins 3 and 8 of the two J-K flip-flops 180A and 180B are connected to output pin 11 of two input Nand gate 178D. As shown Nand gate 178D has one of its input pins 12 connected to $\overline{Q}$ output pin 14 of J-K flip-flop 172A and its second input pin 13 connected by line $\overline{GA13}$ to output pin 15 of bistable latch 64 (FIG. 4). Line GSUS connects the $\overline{Q}$ output pin 14 to input pin 17 of group processor GPU (FIG. 4). The J-K input pins 4 and 16 of J-K flip-flop 180A, the J-K and preset input pins 9, 12 and 7 of J-K flip-flop 180A and preset input pin 2 of J-K flip-flop 172A are maintained at a binary one level represented by line L10.

Nand gate 174C has its input pins 11 connected to Q output pin 11 of J-K flip-flop 1808. Line GA13 connects its input pin 10 to output pin 14 of bistable latch 64 (FIG. 4). Line GRX connects its input pin 9 to output pin 3 of And gate 80A (FIG. 5).

The upper half of FIG. 9B shows a simplified schematic diagram representation of that portion of the group logic circuitry hereinafter referred to as car suspension signal generator. Lines GA8, GA9 and GA10 are connected from output pins 1, 14 and 11 respectively of bistable latch unit 60 (FIG. 4) to input pins 1, 2 and 3 respectively of high speed one of eight binary decoder 190 of the Intel type 3205. Decoder 190 has three enable input pins, two of which, pins 4 and 5, are connected by means of line $\overline{GA13}$ to output pin 15 of bistable latch 64 (FIG. 4). The third enable input pin 6 is connected to a binary one level signal represented by means of line L10.

Output pins 15, 14, 13 and 12 of unit 190 are connected to the input pin 3, 6, 10 and 13 of a quadruple 2-input data selector/multiplexer 192 of the Signetics type 74158. The remaining four output pins 11, 10, 9 and 7 of decoder 190 are connected to input pins 3, 6, 10 and 13 of a second data selector 194 of the Signetics type 74158. Both data selector units 192 and 194 have their second set of input pins 2, 5, 11 and 14 connected to ground potential represented by the line HL1. Both units 192 and 194 have their strobe input pins 15 connected by means of line $\overline{GA13}$ to output pin 15 of bistable latch 64 (FIG. 4) and their data select input pins 1 connected by means of line GA11 to output pin 8 of bistable latch 60 (FIG. 4). Output pins 4 and 7 of data selector 192 are connected to common input pins 9, 10 and 7, 6 respectively of dual differential line driver 196A and 196B of the Fairchild type 9614. Similarly output pins 9 and 12 of data selector 194 are connected to common input pins 9, 10 and 7, 6 of a second dual differential line driver 198A and 198B of the Fairchild type 9614.

Output pins 9 and 12 of data selector 192 and pins 7 and 9 of data selector 194 are similarly connected to another two dual differential line drivers (not shown) in the same manner described above. Output pins 13 and 14 of differential line driver unit 196A are individually connected to dual differential line receiver 210(*a*) (FIG. 10) associated with car "*a*" of the elevator system by lines XCRDY(*a*) and $\overline{\text{XCRDY}(a)}$. It is to be understood that the remaining output pins of each of the dual differential line drivers are similarly separately connected to circuitry similar to that shown in FIG. 10 individual to each of the additional cars of the elevator installation.

Shown in the lower half of FIG. 9B is the remaining portion of the group logic circuitry illustrated by the rectangular block G/C in FIG. 1A. Line GSYNC connects output pin 14 of group processor GPU (FIG. 4) to input pin 2 of data selector 200 of the Signetics type 74157. Two additional input pins 11 and 14 of data selector 200 are maintained at a binary one level as indicated by the line L10. Input pin 5 and input pin 10 of data selector 200 are shown connected to the output pin 6 of two input Nand gate 202B. Nand gate 202B has its first input pin 4 connected to output pin 7 of decoder 190 (FIG. 9B) and its second input pin 5 connected by line $\overline{\text{GA11}}$ to output pin 9 of bistable latch 60 (FIG. 4). Bistable latch 62 is connected by lines GA14 and $\overline{\text{GA14}}$ to input pins 13 and 6 respectively of data selector 200. Line GWX connects the last input pin 3 of data selector 200 to the Q output pin 11 of J-K flip-flop 78B shown in FIG. 5.

Output pins 4 and 7 of data selector 200 are respectively connected to input pins 9 and 7 of a pair of differential line drivers 204A and 204B of the Fairchild type 9614. Lines GTP, $\overline{\text{GTP}}$ and GDC, $\overline{\text{GDC}}$ connect the output pins of the pair of line drivers to the input pins of dual differential line receiver 216(*a*) (FIG. 10) of the AMD type AM2615.

Output pin 9 of data selector 200 is connected to input pin 5 of inverter 170C which has its output pin 6 connected to the select input pins 1 of data selectors 116 and 118 shown in FIG. 7. In addition line G8B connects output pin 9 of data selector 200 (FIG. 9B) to the select input pins 1 of data selectors 156 and 158 shown in FIG. 8. Data selector 200 also has its output pin 12 connected by line GCTE to input pins 7 and 10 of dual differential line drivers 122 through 130 shown in FIG. 7.

FIG. 10 is a simplified schematic representation of the circuitry of the group processing means associated with car "*a*" and illustrated in FIG. 1A by the rectangular block C/G(*a*). It is to be understood that although this circuitry is considered part of the group logic circuitry it is individually associated with car "*a*" and that similar circuitry to that shown in FIG. 10 is provided for each of the additional cars of the elevator system.

As mentioned earlier signal lines XCRDY(*a*) and $\overline{\text{XCRDY}(a)}$ connect output pins 14 and 13 of dual differential line driver 196A (FIG. 9B) to the input pins 9 and 11 respectively of dual differential line receiver 210(*a*) (FIG. 10) of the AMD type AM2615. Dual differential line receiver 210(*a*) is connected by line CSUS(*a*) to input pin 17 of car processor unit CPU(*a*) shown in FIG. 11 and to input pin 9 of inverter 212D(*a*) (FIG. 10). Inverter 212D(*a*) has its output pin 8 connected to the clear input pins 3 and 8 of a pair of J-K flip-flops 214A(*a*) and 214B(*a*) of the Signetics type 7476 arranged as a toggle flip-flop. Both flip-flops 214A(*a*) and 214B(*a*) have their present input pins 2 and 7, their J input pins 4 and 9 and their K input pins 16 and 12 connected to a binary one level signal represented by line L10. Clock input pin 1 of J-K flip-flop 214A(*a*) is connected to output pin 2 of dual differential line receiver 216(*a*) of the AMD type AM2615.

Q output pin 15 of J-K flip-flop 214A(*a*) is connected to clock input pin 6 of J-K flip-flop 214B(*a*) and input pin 1 of a 3-input Nand gate 218A(*a*). Nand gate 218A(*a*) has its second input pin 2 connected to output pin 2 of dual differential line receiver 216(*a*) and its third input pin 13 connected to the $\overline{\text{Q}}$ output pin 10 of J-K flip-flop 214B(*a*). Output pin 12 of Nand gate 218A(*a*) is connected to input pin 3 of inverter 212A(*a*) which has its output pin 4 connected to clock input pin 13 of a quadruple bistable latch 222(*a*) and clock input pins 4 and 13 of a pair of quadruple bistable latches 224(*a*) and 226(*a*) all three latches being of the Signetics type 7475.

As shown in the lower right hand corner of FIG. 10 output 11 of J-K flip-flop 214B(*a*) is connected to input pin 10 of a two input And gate 220C(*a*) which has its second input pin 9 connected to output pin 2 of dual differential line receiver 216(*a*). And gate 220C(*a*) is connected by line GWD to input pins 5 and 11 of data selector 416(*a*) shown in FIG. 13. Output pin 11 of J-K flip-flop 214B(*a*) is also connected to the input pin 5 of And gate 220B(*a*) which has its second input pin 4 connected to output pin 14 of dual differential line receiver 216(*a*). Output pin 6 of And gate 220B(*a*) is connected to control pin 10 of dual differential line driver 228(*a*) of the Texas Instrument type 75113.

Output pin 14 of dual differential line receiver 216(*a*) is also connected to input pin 2 of quadruple bistable latch 222(*a*) which has output pin 16 connected to input pin 1 of And gate 220A(*a*). And gate 220A(*a*) has its second input pin 2 connected to output pin 6 of And gate 220B(*a*) described above, and its output pin 3 connected to control input pins 10 and 7 of a plurality of dual differential line drivers of the Texas Instrument type 75113 or equivalent shown as rectangular blocks 230(*a*), 232(*a*) and 234(*a*) in the upper left hand corner of FIG. 10.

Lines CGD$\phi$(*a*), CGD1(*a*) . . . CGD7(*a*) connect input pins 11 and 5 of the four dual differential line drivers 228(*a*), 230(*a*), 232(*a*) and 234(*a*) to the output pins of a pair of quadruple 2-input positive And gates 412(*a*) and 414(*a*) (FIG. 13). Output pins 13, 14, 3 and 2 of the dual differential line receivers are connected to lines DT$\phi$(*a*), $\overline{\text{DT}\phi(a)}$, DT1, $\overline{\text{DT1}}$ . . . DT7 and $\overline{\text{DT7}}$ to apply data signals from the circuitry associated with car "*a*" to the group processor as will be hereinafter described.

Lines DT$\phi$(*a*), $\overline{\text{DT}\phi(a)}$, and DT1 and $\overline{\text{DT1}}$ are connected to the input pins 11, 9, 5 and 7 respectively of a dual differential line receiver 236(*a*) of the Fairchild type 9615. The remaining lines DT2, $\overline{\text{DT2}}$ . . . $\overline{\text{DT7}}$ are connected in a similar fashion to the input pins of three additional dual differential line receivers shown as rectangu;ar blocks 238(*a*), 240(*a*) and 242(*a*) in FIG. 10. Lines GCB$\phi$(*a*), GCB1(*a*) . . . GCB7(*a*) connect the output pins 14 and 2 of the differential line receivers 236(*a*), 238(*a*), 240(*a*), 242(*a*) to the D input pins 7, 6, 3 and 2 of a pair of bistable latches 224(*a*) and 226(*a*) of the Signetics type 7475.

Lines GCA$\phi$(*a*), GCA1(*a*), GCA2(*a*), GCA3(*a*) connect the Q output pins 9, 10, 15 and 16 of bistable latch 224(*a*) to input pins 2, 5, 11 and 14 respectively of a quadruple two input data selector 408 (FIG. 13) of the Signetics type 74157. Lines GCA4(*a*), GCA5(*a*), GCA6(*a*) and GCA7(*a*) similarly connect the output pins 9, 10, 15 and 16 of bistable latch 226(*a*) to input pins 2, 5, 11 and 14 of a second quadruple 2-input data selector 410(a) (FIG. 13) of the Signetics type 74157.

Lines $\overline{\text{GCB}\phi(a)}$, $\overline{\text{BCB1}(a)}$ . . . $\overline{\text{GCB7}(a)}$ connect the output pins of dual differential line receivers 236(*a*), 238(*a*), 240(*a*) and 242(*a*) to input pins 2, 5, 11 and 14 of a pair of quadruple 2-input data selectors 400(*a*) and 402(*a*) (FIG. 13) of the Signetics type 74158.

Line DTS connects the $\overline{Q}$ output pin 10 of J-K flip-flop 214B(*a*) (FIG. 10) to apparatus to be described later in connection with FIG. 13.

FIGS. 11, 12 and 13 combined show a simplified schematic representation of that portion of the circuitry of the car processing means and the car program storage means associated with car "*a*" illustrated by the rectangular blocks CPU(*a*), CR(A), SW(A), CRAM(*a*) and CROM(*a*) FIG. 1B. The additional circuitry of the car processing means and the car control equipment associated with car "*a*" and shown as rectangular blocks CESC(*a*) and CCE(A) respectively in FIG. 1B will be described hereinafter with reference to the simplified schematic diagrams of FIGS. 14, 15, 16 and 17. The equipment illustrated in block diagram form in FIG. 1B for car "*a*" is required for each of the additional cars of the elevator installation. Consequently it is to be understood that the following circuit description specifically directed to the circuitry associated with car "*a*" as so referenced by the suffix character (a) appended to the reference characters of the circuitry of FIGS. 11 through 17 is also applicable to similar circuitry required for the remaining cars of the installation but not shown herein in the interest of brevity.

A visual comparison of the simplified schematic diagrams of FIGS. 4 and 5 previously described and of the circuitry shown in FIGS. 11 and 12 discloses that the schematic representation of the circuit elements and their interconnections are identical. A further comparison indicates that the distinguishing characteristic between the two figures rests only in that the prefix "G" is affixed to the reference characters shown in FIGS. 4 and 5 while the prefix "C" is affixed to the same characters shown in FIGS. 11 and 12. It is of course understood that the additional appended bracket numerals indicative of the interconnections of signals lines between various figures are also different. However the interconnections between the various pieces of equipment shown on FIGS. 11 and 12 are identical to the interconnections between the corresponding pieces of equipment on FIGS. 4 and 5.

That portion of the program storage means associated with car processor CPU(*a*) (FIG. 11) and identified in FIG. 1B as the car program storage means CROM(*a*) is shown in FIG. 13 as a pair of read only memory units 392(*a*) and 394(*a*) is connected to apparatus in FIG. 11 in the same manner as the corresponding group program storage means of FIG. 6 is connected to the corresponding apparatus of FIG. 5. It is understood that the number of read only memory units varies with the complexity of the stored program and although not shown the disclosed embodiment of the invention utilizes twelve 2048 Bit Electrically Programmable Read Only Memory Units of the Intel Silicon Gate MOS type 1702A.

Shown in the upper portion of FIG. 13 is that portion of the car logic circuitry hereinafter referred to as the car data storage means and the car data switching means. Lines $\overline{CD\phi(a)}$, $\overline{CD1(a)}$, $\overline{CD2(a)}$ and $\overline{CD3(a)}$ connect the first set of input pins 3, 6, 10 and 13 of data selector unit 400(*a*) to the output pins 3, 6, 10 and 13 of bidirectional bus driver 354(*a*) (FIG. 11) and lines $\overline{CD4(a)}$, $\overline{CD5(a)}$, $\overline{CD6(a)}$ and $\overline{CD7(a)}$ connect the first set of input pins 3, 6, 10 and 13 of a second data selector unit 402(*a*) (FIG. 13) to the output pin 3, 6, 10 and 13 of bidirectional bus driver 356(*a*) (FIG. 11). In addition lines $\overline{GCB\phi(a)}$, $\overline{GCB1(a)}$ . . . $\overline{GCB7(a)}$ connect the second set of input pins 2, 5, 11 and 14 of the two data selector units 400(*a*) and 402(*a*) to the output pins 1 and 15 of the four dual differential line receivers 236(*a*), 238(*a*), 240(*a*) and 242(*a*) shown in FIG. 10. The data selector units 400(*a*) and 402(*a*) have their output pins 4, 7, 9 and 12 connected to the data input pins 9, 11, 13 and 15 of a pair of 1024 bit (256 × 4) Static MOS RAM units 404(*a*) and 406(*a*) of the Intel type 8101.

Lines CA$\phi$(*a*), CA1(*a*) . . . CA7(*a*) are connected to the first set of input pins 3, 6, 10 and 13 of a second set of data selector units 408(*a*) and 410(*a*) of the Signetics type 74157. The connections by lines GCA$\phi$(*a*), GCA1(*a*) . . . GCA7(*a*) to units 408(*a*) and 410(*a*) have been described previously with respect to FIG. 10. These units have their output pins 4, 7, 9 and 12 connected to address input pins 4, 3, 2, 1, 21, 5, 6, and 7 of RAM units 404(*a*) and 406(*a*).

The two sets of quadruple data output pins 10, 12, 14 and 16 of the data storage units 404(*a*) and 406(*a*) are connected by lines CDO$\phi$(*a*), CDO1(*a*) . . . CDO7(*a*) to input pins 2, 5, 11 and 14 of a pair of data selector units 366(*a*) and 368(*a*) (FIG. 11) to transmit first and second car control signals or group control signals from the car data storage means to the car processor unit CPU(*a*) (FIG. 11). In addition output pins 10, 12, 14 and 16 of data storage units 404(*a*) and 406(*a*) are connected to the input pins 1, 4, 9 and 12 of a pair of quadruple 2-input positive And gates 412(*a*) and 414(*a*) of the Signetics type 7408. Output pins 3, 6, 8 and 11 of And gates 412(*a*) and 414(*a*) are connected by lines CGD$\phi$(*a*), CGD1(*a*) . . . CGD7(*a*) to apparatus described in connection with FIG. 10.

Strobe input pins 15 of the pair of data selectors 408(*a*) and 410(*a*) (FIG. 13) hereinafter referred to as the car address switching means and the chip enable input pins 19 of a pair of 1024 bit (256 × 4) static MOS RAMS 404(*a*) and 406(*a*) (FIG. 13) with separate I/O of Intel type 8101 are connected to the output pin 4 of quadruple 2-input data selector/multiplexer 416(*a*) (FIG. 13) of Signetics type 74157. The read write pins 20 of the pair of RAM units 404(*a*) and 406(*a*) and the strobe input pins 15 of the pair of data selectors 400(*a*) and 402(*a*) of the Signetics type 74157 hereinafter referred to as the car data input switching means are connected to the output pin 4 of inverter 418B(*a*) of the Signetics type 7404 or equivalent which has its input pin 3 connected to the output pin 7 of data selector 416(*a*). The output disable pins 18 of both RAM units 404(*a*) and 406(*a*) are shown connected to the third output pin 9 of data selector 416(*a*). Line L10 connects the chip enable pins 17 of the data storage units 404(*a*) and 406(*a*) to a binary one level signal.

As shown line DTS(*a*) connects the $\overline{Q}$ output pin 10 of J-K flip-flop 214B(*a*) (FIG. 10) to the select input pins 1 of the two data selector units 400(*a*) and 402(*a*), the two address selector units 408(*a*) and 410(*a*) and a control signal selector unit 416(*a*) of the Signetics type 74157. The line DTS(*a*) is also connected to the input pin 1 of inverter 418A(*a*) which has its output pin 2 connected to the four input pins 2, 5, 10 and 13 of quadruple And gate units 412(*a*) and 414(*a*).

The control signal selector 416(*a*) has its strobe input pin 15 and its input 2 maintained at a binary zero level by line HL1. Line GWD(*a*) connects input pins 5 and 11 of control signal selector 416(*a*) to the output pin 8 of And gate 220C(*a*) (FIG. 10). Input pins 3 and 10 of control signal selector 416(*a*) are connected by line CSS(*a*) to the output pin 10 of data selector 374(*a*) (FIG. 12). Line CWX(*a*) connects the Q output pin 11 of J-K flip-flop 378B(*a*) (FIG. 12) to the input pin 6 of the control signal selector unit 416(*a*).

FIGS. 14 and 16 comprise a schematic representation of the car control equipment signal selection circuitry associated with car "*a*" and illustrated in FIG. 1B by the rectangular block CES(*a*). The car control equipment selection circuitry connects the car operating apparatus CCE(*a*) to be hereinafter described to the car processor CPU(*a*) and operates in response to its associated car processor to selectively transmit binary signals indicative of the car operating apparatus to the car processor. In addition the car control equipment selection circuitry operates in response to its associated processor to transmit first car control signals to its associated car operating apparatus to cause it to control the operation of car "*a*" in an independent manner and second car control signals to the associated operating apparatus to cause it to control the operation of car "*a*" as a member of a supervised group.

Line $\overline{CD\phi(a)}$ connects output pins 5 of three data selector/multiplexer units 430(*a*), 432(*a*) (FIG. 14) and 434(*a*) (FIG. 16) of the Signetics type 74S251 to pin 3 of bidirectional bus driver 354 (FIG. 11). The car call selection units 430(*a*) and 432(*a*) and the car status signal selection unit 434(*a*) operate in response to the application of a binary zero level signal to their respective strobe input pins 7 and a 3-bit binary signal applied along lines CA$\phi$(*a*), CA1(*a*) and CA2(*a*) from the output pins 1, 14 and 11 of bistable latch 358(*a*) (FIG. 11) to their data select pins 11, 10 and 9 respectively to cause the selected unit to apply one of eight signals applied to its input pins 4, 3, 2, 1, 15, 14, 13 and 12 along line $\overline{CD\phi(a)}$. The selection apparatus which applies the binary zero level signal to the strobe input pin 7 of the selected unit will be described hereinafter.

In addition three-to-eight bit addressable latch units 438(*a*), 440(*a*) (FIG. 14) and 444(*a*) (FIG. 16) of the Fairchild type 9334 or equivalent have their data input pins 13 also connected to lines $\overline{CD\phi(a)}$ and their address input pins 1, 2 and 3 connected to lines CA$\phi$(*a*), CA1(*a*) and CA2(*a*). In response to the three bit binary applied to their address input pins and a binary zero level signal applied to the strobe input pin 14 of a selected one of the three units 438(*a*) 440(*a*) and 444(*a*), that unit applies a binary zero signal from one of its output pins 4, 5, 6, 7, 9, 10, 11 and 12 which corresponds to the signal on line $\overline{CD\phi(a)}$. The apparatus which applies the binary zero level signal to the strobe input pin 14 of a selected unit will be described hereinafter.

As shown the strobe input pins 7 of the pair of car call selection units 430(*a*) and 432(*a*) are respectively connected to the output pins 6 and 7 of dual 2-to-4 line decoder or chip selection device 446(*a*) (FIG. 14) of the Signetics type 74155. Two additional output pins 11 and 12 of chip selection device 446(*a*) are respectively connected to the strobe input pins 14 of the call reset selection units 440(*a*) and 438(*a*). Line $\overline{CEX\phi(a)}$ connects the strobe input pins 2 and 14 of chip selection device 446(*a*) to the output pin 15 of 3-to-8 line decoder 372(*a*) shown in FIG. 12. A read or write signal is applied along lines CRX(*a*) or CWX(*a*) from the output pin 3 of And gate 380A(*a*) (FIG. 12) or the Q output pin of J-K flip-flop 378B(*a*) (FIG. 12) to the input pins 1 or 3 of the chip selection device 446(*a*). Two additional signal lines CA3(*a*) and HL1 connect input pins 13 and 15 of the chip selection device 446(*a*) respectively to the output pin 8 of bistable latch 358(*a*) (FIG. 11) and to a binary zero level signal represented by line HL1.

The strobe input pin 7 of car status signal selection circuit 434(*a*) (FIG. 16) is shown connected to output pin 8 of a three input Nand gate 442C(*a*). Lines $\overline{CA3(a)}$, and CRX(*a*) respectively connect the input pins 9 and 11 of Nand gate 442C(*a*) to the output pin 9 of bistable latch 358(*a*) (FIG. 11), and pin 3 of And gate 380A(*a*) (FIG. 12). Line $\overline{CEX3(a)}$ connects output pin 12 of 3-to-8 line decoder 372(*a*) (FIG. 12) to input pin 1 of inverter 448A(*a*) which has its output pin 2 connected to the third input pin 10 of Nand gate 442C(*a*).

The strobe input pin 14 of the car output signal selection device 444(*a*) (FIG. 16) is connected to the output pin 6 of three input Nand gate 442B(*a*). Lines $\overline{CA3(a)}$ and CWX(*a*) respectively connect the input pins 3 and 5 of Nand gate 442B(*a*) to output pin 9 of bistable latch 358 (FIG. 11) and to the Q output pin 11 of J-K flip-flop unit 378B(*a*) (FIG. 12). Line $\overline{CEX4(a)}$ connects output pin 11 of 3-to-8 line decoder 372(*a*) (FIG. 12) to input pin 3 of inverter 448(*a*) which has its output pin 4 connected to the third input pin 4 of Nand gate 442B(*a*).

A simplified schematic diagram of the car call registration circuits utilizing the well-known cold cathode gas tube touch button of the RCA type 1C21 or equivalent is shown in FIG. 15 for the main landing and landings, 2, 6, 7, 11, 12 and T of the building in which the system is installed. It is understood that additional car call registration circuits for the remaining landings are connected between the broken lines shown in FIG. 12 in a fashion similar to the circuits shown therein.

The anode of each gas tube 1C(*a*), 2C(*a*) . . . TC(*a*) has a potential of 135 volts referenced to line BO applied to it along line B+ from power supply PS1 (FIG. 3) previously described and has its cathode connected to an associated cathode register RCL1, RCL2 . . . RCLT which has its second side connected to line BO of power supply PS1. Lines C1(*a*), C2(*a*) . . . CT(*a*) connect the cathode of their associated tube to individual solid line rectangular blocks identified by the reference characters 18A representing an optical coupler and level converter to be described hereinafter. The optical couplers and level converters are also connected to lines BO and AC1 of power supply PS1 (FIG. 2) to enable the gas tube touch button to be operated.

The car call registration signals for the circuits shown in FIG. 15 are applied along lines 1CS(*a*), 2CS(*a*), 6CS(*a*), 7CS(*a*), 11CS(*a*), 12CS(*a*) and TCS(*a*) to the input pins 12, 13, 2 and 3 of call selection unit 430(*a*) (FIG. 14) and pins 14, 15 and 4 of call selection unit 432(*a*) (FIG. 14). It is to be understood that the corresponding pins of the optical couplers and level converters which are not shown but associated with the additional car call registration circuits which are not shown are similarly connected to the remaining input pins of the call selection units.

Call reset signals for each of the call registation circuits shown are applied from the output pins 12, 11, 6 and 5 of call reset selection unit 438(*a*) (FIG. 14) and output pins 10, 9 and 4 of call reset selection unit 440(*a*) (FIG. 14) along lines 1CR(*a*), 2CR(*a*), 6CR(*a*), 7CR(*a*), 11CR(*a*), 12CR(*a*) and TCR(*a*) to the reset pins R of the optical couplers and level converters 18A (FIG. 15).

A simplified schematic representation of the control apparatus associated with car "*a*" for use with the control system of the present invention is shown in FIG. 17. As shown elevator car 10(*a*) and counterweight 11(*a*) are suspended by hoist ropes 12(*a*) from sheave 13(*a*).

Car 10(*a*) serves sixteen landings Ll-Lt as do all the cars in the group (not shown).

Sheave 13(*a*) is mounted on the shaft of armature MA(*a*) of a direct current hoisting motor which also houses a typical elevator brake BR(*a*). Motor armature MA(*a*) is connected across both generator armature GA(*a*) and its series field GSEF(*a*) of the direct current generator of a motor generator set. The motor field MF(*a*) and the generator field GF(*a*) are both connected to receive current from a self excited generator having its armature EA(*a*) also connected to the shaft common to the motor generator set (not shown).

Two series connected normally closed door zone contacts D1Z(*a*) and D2Z(*a*) connect the line V2(*a*) to one side of the coil of door open switch DO(*a*). Line $\overline{DO}$(*a*) connects the second side of the door open switch coil DO(*a*) to the terminal O2 of relay driver circuit shown as rectangular block 18C(*a*) (FIG. 16) which has its input terminal I3 connected to the output pin 4 of relay selection device 444(*a*) (FIG. 16).

The coil of start switch ST(*a*) is also connected to line V2(*a*) and to line $\overline{GO}$(*a*) which is similarly connected to the terminal O2 of a second relay driver circuit shown as rectangular block 18C(*a*) (FIG. 16) which has its input terminal I3 connected to the output pin 7 of relay driver selection device 444(*a*) (FIG. 16). Relay selection device 444(*a*) (FIG. 16) as shown has two additional pins 5 and 6 respectively connected to the input terminals I3 of an additional pair of relay drivers shown as rectangular blocks 18C(*a*) (FIG. 16) which are connected by lines $\overline{AU}$ and $\overline{AD}$ to one side of the set coil and one side of the reset coil of direction hold switch DG(*a*) (FIG. 17).

Series connected gate contacts GS(*a*) and door contacts DS(*a*) operate to their closed position whenever the car or hoistway gates are closed and apply the voltage on line V2(*a*) along line DFC to the input terminal of optical I2 of optical coupler and level converter circuit represented by rectangular block 18B(*a*) (FIG. 16). The converter circuit has its output terminal O1 connected to the input pin 14 of signal selection device 434(*a*) (FIG. 16). Another door switch OL(*a*) which engages its contacts when the elevator doors are fully open is shown connecting line V2(*a*) on line DFO(*a*). This latter line is connected to input terminal I2 of optical coupler and level converter 18B(*a*) (FIG. 16) which has its output terinal O1 connected to the input pin 13 of signal selection device 434(*a*) (FIG. 16).

The car operating apparatus associated with car "*a*" includes a pair of advanced floor position brushes FPU(*a*) and FPD(*a*) and an actual floor position brush FPB(*a*) mounted on the synchronous panel of a typical floor selector unit arranged to contact the floor position contacts FPC1(*a*), FPC1(*a*) . . . FPCT(*a*) connected to matrix assembly shown as rectangular block MT(*a*) to produce binary signals representing the advanced car position and actual car position. As shown the actual floor position brush is connected by normally closed running switch contacts H2(*a*) to line V2(*a*) whenever car "*a*" is located at a floor to cause the matrix assembly to apply a binary coded signal representing the actual car position to car position signal lines CP1(*a*), CP2(*a*), CP4(*a*), CP(*a*) and CP16(*a*). These lines are connected to the input terminals I2 of five optical coupler and level converter circuits 18B(*a*) (FIG. 16) having their respective output terminals O1 connected to the inputs 15, 1, 2, 3 and 4 of signal selection device 434(*a*) (FIG. 16).

Normally opened running switch contacts H1(*a*) connect line V2(*a*) to line V3(*a*) which is also connected to line RUN(*a*) which connects it to the input terminal I2 of optical coupler and level converter 18B(*a*) having its output terminal connected to input pin 12 of car status selection unit 434(*a*) (FIG. 16).

Floor position brushes U1S(*a*), D1S(*a*) and D2S(*a*) of the aforementioned selector are set to engage their associate series connected floor position contacts 1SC(*a*) and 2SC(*a*) when the car is at predetermined distances from these landings.

The hall call and car call registration circuits described previously are connected to rectangular blocks 18A representing optical coupling and level converting drivers which are shown schematically in FIG. 18A. Each of these circuits operates in response to the registration of its corresponding call to produce a binary zero on its "S" output. To reset the call a binary zero is applied to the "R" input which causes the signal on line AC1 to be applied to terminal I1.

The input signal circuits shown as rectangular blocks 18B(*a*) FIG. 16 are each illustrated schematically in FIG. 18B. In response to an input signal applied to its terminal I2 each of these optical couplers and level converters apply a binary zero signal to its terminal O1.

The four relay driver circuits shown in FIG. 16 as rectangular blocks 18C(*a*) are each schematically illustrated by the circuit shown in FIG. 18C. In response to a binary zero signal applied to its input terminal I3 each of these relay drivers applies a sufficient enough ground to its O2 terminal to cause an appropriate relay to be energized.

In order to understand how the control system of the disclosed invention operates to cause each of the cars of an elevator installation to operate as a member of a supervised group a description will be provided of how the group processing means GPM receives first car control signals from the car processing means CPM and applies group control signals to the car processing means which produces second car control signals in response thereto and applies those signals to the car operating apparatus associated with each of the cars of the elevator installation to cause them to operate as members of a supervised group. It will be assumed that the car processing means CPM of the elevator installation includes a separate car processor and associated car logic circuitry both individual to each car of the installation and that car processor sequentially performs a first set of operations by following in any well-known manner a car program of instructions to produce first car control signals in response to car call signals and car position signals which are applied to the car operating apparatus of the associated car to cause the associated car to operate in a particular manner. It should be understood that the car processor and its associated car logic circuitry individual to each car operate in the same manner and consequently the description of the transfer of the first car control signals and group control signals between the car processor CPU(*a*) and its associated car logic circuitry individual to a single car, car "*a*", and the group processing means will be understood to be equally applicable to signal transfer between the car processors and their associated car logic circuitry individual to the additional cars of the elevator installation and the group processing means.

It will also be assumed that the group processing means includes a group processor GPU and its associated group logic circuitry and that the group processor sequentially performs a second set of operations by following in any well-known manner a group program of instructions to receive hall call signals from group control equipment GCE (FIG. 2) and first car control signals and to apply group control signals to selected car processors and their associated car logic circuitry.

U.S. Pat. No. 3,614,995 discloses apparatus operable to control a plurality of elevator cars as a supervised group. Apparatus is also disclosed by which each individual car can operate in response to the registration of car calls therein and to signals signifying the position of the car to cause the associated car to operate in a particular manner. For example, when the car is located stopping distance away from a landing for which a car call is registered, the car is caused to initiate a stopping operation for that landing. A skilled programmer or system analyst would understand how to program the apparatus disclosed herein to produce a similar result.

In doing this in the constructed embodiment, the step-by-step sequence of instructions comprising the car program includes a subroutine which causes the transfer of information indicating the registration of a car call for a particular landing to the associated car's processor, say for car "*a*" CPU(*a*) (FIG. 11). Similarly, information indicating the location of car "*a*" at stopping distance from the landing for which the call is registered is also transferred to car processor CPU(*a*).

In generating information for the registration of a car call in car "*a*", say one for the 7th landing, a signal is generated by the optical coupler and level converter 18A associated with car "*a*" (FIG. 15) and with the 7th landing causing it to produce a binary zero signal. This signal is applied to car call selection device 430 (*a*) (FIG. 14).

The subroutine by which car processor CPU(*a*) receives the 7th landing car call information from car call selection deviced 430 (*a*) is initated by the program counter internal to car processor CPU(*a*) (FIG. 11). As is well known, a count is added to the program counter at the completion of each T1 timing state of operation of the car processor to enable it to operate in its step-by-step manner and to receive the next instruction from its car program storage means CROM(*a*) (FIG. 13).

Under the assumed conditions, the instruction that is received from the car program storage means CROM(*a*) directs the car processor CPU(*a*) to receive the signal applied along line 7CS(*a*) to car call selection device 430(*a*). In order to move the information from line 7CS(*a*) to the processor, as is well known, the car processor CPU(*a*) must contain in addition to an 8-bit operational code or instructions received from its program storage means CROM(*a*), a 16-bit address code. This latter code identifies pin No. 3 of call selection device 430(*a*) to which line 7CS(*a*) is connected and enables the signal along line 7CS(*a*) to be transmitted to the car processor CPU(*a*).

The address code contained in car processor CPU(*a*) cause registers 358(*a*), 362(*a*), 360(*a*) and 364(*a*) to apply sixteen corresponding signals along lines CA$\phi$(*a*) through CA15(*a*) in the next well known T1 and T3 timing states of the processor. The signals along lines CA0(*a*), CA1(*a*) and CA2(*a*) are applied to pins 11, 10 and 9 of call selection device 430(*a*) (FIG. 14) to select the signal applied thereto along line 7CS(*a*) and to apply a corresponding signal to its output pin 5. The signals along lines CA10(*a*), CA13(*a*), CA14(*a*) and CA15(*a*) are such as to cause decoder 374(*a*) (FIG. 12) to produce a binary zero at its output pin 9. This is applied to deocder 372(*a*) which in response to the operation of the address contained in the signals along lines CA4(*a*), CA5(*a*) and CA6(*a*) produces a binary zero signal along line $\overline{\text{CEX}\phi}$(*a*). The address signal applied along line CA3(*a*) and the binary zero signal along line $\overline{\text{CEX}\phi}$(*a*) are applied to multiplexer 446(*a*) and upon receipt of a binary one signal along line CRX(*a*) and a binary zero signal along line CWX(*a*) this multiplexer will apply a binary zero signal to input pin 7 of call selection device 430(*a*). A binary one signal is applied along line CRX(*a*) during the T3 timing state because during its preceding T2 timing state, a binary zero signal was applied along line $\overline{\text{CT2}}$(*a*) to flip-flop 376(*a*) to cause it to apply a binary one signal to And gate 380(*c*) from its pin 5 output. During the first half of the T3 timing state a binary one signal is applied along line CSYNC by processor CPU(*a*) (FIG. 11). This produces a binary one signal along line $\overline{\text{CT3A}}$(*a*) which in combination with the binary one signal applied along line $\overline{\text{CA14}}$(*a*) as the complement of the operational code signal along line CA14(*a*) causes And gate 380A(*a*) to produce a binary one signal on line CRX(*a*). A binary zero signal is applied along line CWX(*a*) because the processor is performing a "reading" operation and at the beginning of the T3 timing state the binary one signal applied along line C$\phi$1(*a*) reset flip-flop 378B(*a*) causing it to apply the binary zero signal along line CWX(*a*).

Upon the receipt of the binary zero signal at input pin 7, call selection device 430(*a*) applies a binary zero signal along line $\overline{\text{CD}\phi}$(*a*) for application to pin 3 of bidirectional bus driver 354(*a*) (FIG. 11). Since the processor is in a T3 timing state and a "reading" operation is taking place, binary zero and binary one signals are applied along lines (CCS(*a*) and $\overline{\text{CDIEN}}$(*a*) respectively, for reasons which will be clear from the hereinafter described manner in which comparable signals are generated along lines $\overline{\text{GCS}}$(*a*) and $\overline{\text{CDIEN}}$(*a*) (FIG. 4) when the gorup processor GPU(*a*) is operating to recieve data from the car data storage means CRAM(*a*) of car "*a*". These signals along lines $\overline{\text{CCS}}$(*a*) and $\overline{\text{CDIEN}}$(*a*) cause the complement of the signal along line $\overline{\text{CD}\phi}$(*a*) signifying the registration of the 7th landing car call to be applied to the car processor CPU(*a*) for temporary storage therein.

From the foregoing, it should be understood how other signals signifying other information relative to the elevator car are transferred from the car control equipment to the car processor CPU(*a*). For example, information indicative of elevator car "*a*" being located at stopping distance away from the 7th landing is transmitted through brush FPU(*a*) or FPD(*a*) (FIG. 17) depending upon the direction of travel of the car and contact FP7(*a*) to matrix MT(*a*). Binary signals indicative of this information are transmitted along output lines CPl(*a*) through CP16(*a*) from matrix MT(*a*). These binary signals are applied to their associated selection devices 18B(*a*) (FIG. 16). Output signals from selection devices 18B(*a*) are transmitted along line CD$\phi$(*a*) to the car processor unit CPU(*a*) (FIG. 11) in a manner in which the signal indicative of the registration of the 7th landing car call was transmitted thereto.

The car processing unit CPU(*a*) FIG. 11) uses signals indicating that the car is located stopping distance away from the 7th landing and that a 7th landing car call is in registration to control the car to cause it to stop at the 7th landing. It does this by operating in response to their simultaneous existence to generate a signal that a stop is to be initiated. In so responding it provides a signal along line $\overline{CD\phi}(a)$ to pin 13 of decoder 444 for application to output pin 7 thereof, in order to have the associated relay driver 18C(a) produce a binary one signal along line $\overline{GO}(a)$. This signal upon application to coil ST(a) (FIG. 17) will release the associated stopping switch to cause the car to stop in a desired manner in response to the consequent release of switches FE(a), E2A(a), E1A(a), H(a) and U(a) or D(a) depending upon the direction of travel of the car.

It is desirable to store the signal along line $\overline{CD\phi}(a)$ which caused the generation of the binary one signal along line $\overline{GO}(a)$ in the car data storage means CRAM(a) (FIG. 13) in order to have it available for later use. This is accomplished because the processor in its -step-by-step operation receives an eight bit "move" instruction to store the signal in this manner. This instruction is retained in the car processor CPU(a) and indicates that a signal corresponding to that along line $\overline{GO}(a)$ should be moved to car data storage means CRAM(a). In addition a sixteen bit address code is also contained in the car processor CPU(a).

The first eight of these latter sixteen signals are applied along lines CAϕ(a) – CA7(a) to data selectors 408(a) and 410(a) in preparation of addressing the car data storage means CRAM(a). These signals upon application to the car data storage means will enable it to store a signal corresponding to that along line $\overline{GO}(a)$ in the location therein corresponding to the address indicated by the signals applied along lines CAϕ(a) – CA7(a).

The last eight of the latter sixteen signals are applied along lines CA8(a) – CA15(a). These signals are such as to enable the apparatus of FIG. 12 to produce a binary zero on line CRSE(a) and a binary one on line CWX(a). The former of these signals exists as a result of the part of the code applied along lines CA10(a), CA11(a), CA13(a), CA14(a) and CA15(a) which although now is changed from that previously described in that the signal along line CA14(a) is a binary one. The latter signal along line CWX(a) is a binary one during the third timing state T3 of the car processor unit because during that period the signal on line $\overline{CT3}(a)$ is a binary zero and during a "storing" operation the signal on line $\overline{CPCW}(a)$ is also a binary zero since the code signals CA14(a) and CA15(a) are both binary ones. The binary zero signals along lines $\overline{CT3}(a)$ and $\overline{CPCW}(a)$ cause flip-flop 378B(a) to produce a binary one along line CWX(a).

The signals along lines CSS(a) and CWX(a) are applied to selector switch 416(a) (FIG. 13) and with the binary one signal then existing on line DTS (a) cause that switch to operate to produce output signals in preparation for the car processor unit CPU(a) to "write information into" i.e., to store signals indicative of information in, the car data storage means CRAM(a). A binary one signal is applied along line DTS(a) as a result of the binary zero signal along line GA13 of the operational code of the group processor which is always a binary zero except when the car processor GPU (FIG. 4) is to communicate with the car equipment as will be explained hereinafter. This causes line driver 196A (FIG. 9B) to apply a binary zero signal along line XCRDY(a) to receiver 210(a) (FIG. 10). This produces a binary zero at pins 3 and 8 of flip-flop 214A and 214B resetting them and causing a binary one signal along line DTS(a).

The binary one signal along line DTS(a) together with the output signals from switch 416(a) enable selectors 408(a) and 410(a) to transmit to car data storage means CRAM(a) the address signals applied along lines CAϕ(a) – CA7(a) in preparation for the later transmission of the signal corresponding to that along line $\overline{GO}(a)$ to the car data storage means through data selectors 400(a) and 402(a). The signal corresponding to that along line $\overline{GO}(a)$ is transmitted along line $\overline{CD\phi}(a)$ through selector 400(a) in the next sequence of operation. This takes place because car processing unit CPU(a) is actuated by the eight bit "move" signal to transfer this signal out through line CDϕ(a) immediately after having transmitted the "address" signals. As a consequence, the signal corresponding to that along line $\overline{GO}(a)$ flows along line $\overline{CD\phi}(a)$ into data selector 400(a) and through that unit into the location in the car data storage means CRAM(a) identified by the eight "address" bits previously transmitted by the car processing unit CPU(a).

The retrieval of stored information from the car data storage means CRAM(a) by the car processing unit CPU(a) is similar to the operation by which the car processing unit stores information in the car data storage means. The difference between the operation of storing and the operation of retrieval is that during the latter operation the 16 bit address signal must be such as to cause the apparatus of FIG. 12 to change the status of the signal along line CWX(a) to a binary zero signal from the binary one produced during a "storing" operation. This binary zero signal is applied along line CWX(a) in the same manner as was previously explained during the operation of transferring the signal corresponding to that along line GO(a) to the car processor unit CPU(a). The change in status takes place after the T3 timing state ends when the signal along line CT3(a) and the signal along line Cϕ1(a) become binary zero signals whereupon a binary zero is applied to pin 8 of flip-flop 378B(a). The signal along line CWX(a) is not changed to a binary one state during the T3 timing state of a "reading" operation as occurred during a storage operation because during the "reading" operation the signal along line CPCW(a) is not a binary zero signal as it is during a storage operation. As a consequence, flip-flop 378B(a) remains in its reset condition during the "reading" operation and continues to apply a binary zero signal along line CWX(a). This enables the "reading" of information from car data storage means CRAM(a) (FIG. 13); i.e., the car data storage means produces outpu signals along lines COOϕ(a) – CD07(a) during the retrieval or "reading" cycle, in contrast to its receiving signals from the car processor unit CPU(a) applied thereby along lines CDϕ(a) – CD7(a) during the "writing" or storage cycle.

Also, the operational signals are such as to change the status of the signal along line CSS(a) to a binary zero in a manner which will be clear from the hereinafter explanation of how a binary zero signal is applied along line GSS when the group processor GPU(a) is receiving data. This binary zero signal along line CSS(a) enables the signals along lines CDOϕ(a) through CDO7(a) to be transmitted by data selectors 366() and 368(a).

It is to be understood that car processor unit CPU(a) can be controlled by instructions stored in car program storage means CROM(a) (FIG. 13) and received therefrom by way of lines CIOϕ(a) – CIO7(a) in a well known manner so that upon the initiation of the stopping operation in response to the 7th landing car call the processor CPU(a) can transmit signals to cancel the call. This procedure would constitute a "writing" operation and would be performed in a manner similar to that by which the processor "read" the 7th landing car call for the transmission thereto of a signal indicative thereof as has been explained. The difference between the "writing" operation and the "reading" operation is that the address code causes the generation of a binary one signal along line CWX(*a*) during the T3 timing state as opposed to causing the generation of a binary one signal along line CRX(*a*). Also, during the "writing" operation a binary zero signal is transmitted along line $\overline{CD\phi}(a)$ to pin 13 of car call reset selector 438(*a*) as opposed to the "reading" operation during which a binary zero signal is transmitted along line $\overline{CD\phi}(a)$ from pin 5 of car call selector 430(*a*), as previously explained.

In response to the binary zero signal applied to pin 13 of selector 438(*a*) and the code corresponding to the 7th landing along lines CA$\phi$(*a*), CA1(*a*) and CA2(*a*) and the binary one signal along line CWX(*a*), selector 438(*a*) generates a signal along line 7CR(*a*) which is applied through the associated level converter 18A (FIG. 15) to cause the extinguishment of the 7th landing car call tube 70(*a*) and accordingly the cancellation of the call.

It will now be assumed that a car call for the 7th landing is not registered in car "*a*" but that the car processor CPU(*a*) (FIG. 11) has performed operations in accordance with a car position subroutine whereby the position of car "*a*" as being located at stopping distance below the 7th landing as indicated by brush FPU(*a*) (FIG. 17) engaging contact FPC7(*a*) is stored in a defined location in the car data storage means CRAM(*a*). Also that the car processor CPU(*a*) has operated to established the up direction of travel for car "*a*". As a consequence a binary zero signal is applied along line $\overline{AU}(a)$ to the set coil SDG(*a*) whereby the direction relay is energized to maintain the up direction as the established direction of travel. Also assume that the group processor GPU (FIG. 4) has performed operations in accordance with a hall call subroutine and has received a signal indicative of the registration of an up hall call for the 7th landing. Also assume that in proceeding in its step-by-step manner the group processor has operated to receive the car position information of car "a" stored in its respective car data storage means CRAM(*a*) and has generated a signal to be transmitted to the car data storage means of car "*a*" to cause it to stop for the registered 7th landing up hall call.

In order to understand how the group processor unit GPU (FIG. 4) operates to receive signal directly from and to store signals directly into car data storage means CRAM(*a*) it will now be explained how the car position information of car "*a*" is received by the group processor unit and how a signal to cause car "*a*" to initiate a stop for a 7th landing hall call is transmitted from the group processor unit GPU (FIG. 4) to car data storage means CRAM(*a*).

The subroutine by which the group processor receives car position information from the car data storage means is initiated by the program counter internal to the group processor. As is well known a count is added to the program counter at the completion of each T1 timing state of operation of the group processor to enable the group processor operating in its step-by-step manner to receive the next instruction from its group program storage means GROM (FIG. 6). After receipt of this eight bit instruction in the well known manner the group processor uses it and the sixteen bit address code signals including those indicating the location in car cata storage means CRAM(*a*) in which the data of interest is stored to acquire that data.

The address code signals in group processor GPU (FIG. 4) are transmitted through bus drivers 54 and 56 along lines $\overline{GD\phi}$ to $\overline{GD7}$ for storage in registers 58, 62, 60 and 64 in two timing cycles T1 and T2, in the standard manner explained by the manufacturer's specification for the processor.

During the last quarter of the T1 timing state, the binary zero signal along line $\overline{GT1}$ (FIG. 9A) causes Nand gate 178A to produce a binary one signal at its output. During the second half of the T2 timing state, a binary one signal is applied along line G$\phi$1 and a binary zero signal is applied along line SGYNC. As a result Nand gate 170B applied a binary one signal to pin 1 of flip-flop 172A. At the same time, a binary zero signal is applied along line $\overline{GD5}$ to pin 16 and to complement is applied to pin 4. When the last quarter of T2 timing state begins, a binary zero signal is applied along line $\overline{GT2}$ to cause the output of gate 178A to transfer to a binary zero signal. As a consequence, a binary zero signal is also applied to pin 1 of flip-flop 172A and it produces a binary zero signal along line GSUS.

The signal along line GSUS is applied to pin 17 of group processor GPU to cause it to suspend its standard sequence of operations at the end of the timing state T2. This suspension continues for four WAIT states before the processor is permitted to enter its T3 timing state. In this way, regardless how out of synchronism the group and car processor may be, the group processor waits a sufficient time period to ensure that before it enters its T3 state the operation of the car processor has been suspended at the end of one of its T2 timing states as will be explained.

In the meantime, in response to the application of the address code signals along lines $\overline{GD\phi}$ to $\overline{GD7}$ outputs are produced along lines GA$\phi$ through GA15 and $\overline{GA8}$ through $\overline{GA15}$, the signals along the latter being the complements of the signals along lines GA8 and GA15. These signals are produced by registers 58, 60, 62 and 64 in the standard manner described by the manufacturer's specification. The binary one signal on line GA13 causes dual two to four line decoder 74 and And gate 80D to produce a binary one signal along line GRSE and line GSS. These signals are applied to pins 18 and 19 of group data storage means GRAM (FIG. 6) 6) and prevents the group memory from responding to the address signals along lines GA$\phi$ - GA7.

Since group processor GPU is to receive signals from car data storage means CRAM(*a*) of car "*a*" ) the three signals along lines GA8, and GA9 and GA10 are coded to identify car "*a*" as the car selected to provide signals. These three signals together with the binary one signals along lines GA11 and GA13 and the binary zero signal along line $\overline{GA13}$ cause three to eight line decoder 190 (FIG. 9B), data selectors 192 and 194 and line driver 196A to operate to produce a binary one signal along line XCRDY(*a*). This signal is applied to differential line receiver 210 (FIG. 10) and causes it to produce a binary zero signal along line CSUS(*a*) which is applied to pin 17 of car processor CPU(*a*) (FIG. 11) of car *a*" causing it to suspend its operation at the end of its next T2 timing state.

Prior to the production of the binary zero signal along line GSUS (FIG. 9A) which caused the suspension of group processor GPU (FIG. 4), the signals along line GSUS was of the opposite state. At that time, that signal and a similar signal along line $\overline{GA13}$(FIG. 9A)

(the signal along line $\overline{GA13}$ is always a binary one except when the group processor is in communication with car equipment) caused the application of binary zero signals to pins 3 and 8 of J-K flip-flop 180A and 180B. This produced a binary zero along line GCDT. While this signal continues and after the signal on line $\overline{GA13}$ becomes a binary zero, the address signals along lines GA1 - GA7 (FIG. 4) are transmitted by data selectors 100 and 102 along lines GCD1 - GCD7 to the four differential drivers 126, 128, 130 and 132 shown in FIG. 7.

At this time, a binary zero signal is applied along line G8B (FIGS. 7 and 9B) because the binary zero signals along lines $\overline{GA13}$ and GCDT (FIG. 9B) cause the binary one signal applied along line L10 to input pin 11 of data selector 200 to be applied to line G8B and its complement to line $\overline{G8B}$. Similarly, the signal applied along line L10 to input pin 14 is applied to line GCTE.

As a consequence of the binary zero signals applied along lines $\overline{GA13}$ and $\overline{G8B}$, the signal from pin 4 of selector 100 (FIG. 7) which is applied to pin 3 of selector 116 and pins 2, 5, 11 and 14 of both selectors 116 and 118 is transmitted along lines GCD$\phi$(*a*) - GCD$\phi$(*h*). These signals are applied to the input pins of the dual differential line drivers 122, 123, 124 and 125 shown in FIG. 7. In response to these signals and the binary one signal applied along line GCTE these line drivers apply corresponding and complementary signals along lines DT$\phi$(*a*) and $\overline{DT\phi}$(*a*) to DT$\phi$(*h*) and $\overline{DT\phi}$(*h*).

In response to the signals applied along lines GCD1 - GCD7 and the binary one level signal applied along line GCTE dual differential line drivers 126, 128, 130 and 132 apply signals along lines DT1 and $\overline{DT1}$ - DT7 and $\overline{DT7}$ to the second set of dual differential line receivers 236, 238, 240 and 242 shown in FIG. 10. It is to be understood that the signal lines DT1, $\overline{DT1}$, DT2 . . . $\overline{DT7}$ are common to the dual differential line receivers associated with car "*a*" shown in FIG. 10 as well as those line receivers associated with additional cars (not shown) but similar to those of FIG. 10 and provided for each additional car. Of course, lines DT$\phi$(*a*) and $\overline{DT\phi}$(*a*) - DT$\phi$(*h*) and $\overline{DT\phi}$(*h*) of each of these cars are connected only to the line receivers associated with their individual cars.

The dual differential line receivers 236(*a*), 238(*a*), 240(*a*) and 242(*a*) transmit an 8-bit binary signal corresponding to the address signal along lines GCB$\phi$(*a*) - GCB7(*a*) to the input pins of a pair of bistable latches 224(*a*) and 226(*a*) shown in FIG. 10. The corresponding equipment for the other cars operates similarly and will not be discussed further.

During the time interval in which the 8-bit address signals are being transferred from the bistable latches 58 and 62 shown in FIG. 4 to the bistable latches 224(*a*) and 226(*a*) shown in FIG. 10 as described, group processor GPU continues to apply signals along the line GSYNC to pin 2 of selector 200 (FIG. 9B). In response to each of these pulses, a similar pulse is applied along line GTP from line driver 204A. The second of these pulses causes line receiver 216(*a*) (FIG. 10) and flip-flops 214A(*a*) and 214B(*a*) to apply binary one signals to their associated inputs of Nand gate 218A(*a*). As a 212A(*inverter 212(a)*) applies a binary one signal to latches 224(*a*) and 226(*a*) to enable them to store the eight bit address signal applied to their input pins. This causes these latches to apply the eight bit address signals representing the address of the location in the car data storage means CRAM(*a*) along line GCA$\phi$(*a*)–GCA7(*a*) to the pair of data selectors 408(*a*) and 410(*a*) shown in FIG. 13.

In the meantime, the binary zero signal along line $\overline{GA11}$ (FIG. 9B) has caused Nand gate 202B, selector 200 and line driver 204B to produce a binary one signal along line GDC. This is applied through receiver 216(*a*) (FIG. 10) to pin 2 of latch 222(*a*) in which it is stored as a result of the binary one signal produced by inverter 212A(*a*) as previously described. At the end of the pulse along line GTP which caused inverter 212A(*a*) to produce the binary one signal, flip-flop 214B(*a*) (FIG. 10) produces a binary zero signal along line DTS(*a*). At the same time, a binary one is produced at pin 11 of flip-flop 214B(*a*). This together with the binary one along line GDC causes And gate 220B(*a*) to produce a binary one signal. (The end of the pulse along line GSYNC which causes the pulse along line GTP to cease also caused flip-flop 180B (FIG. 9A) to transfer the signal along line GCDT to a binary one. This caused the binary one signal produced along line GDC (FIG. 9B) by the binary one signal along line $\overline{GA11}$ to cease. However, it is replaced by a binary one signal produced as a result of the binary one signal along line $\overline{GA14}$).

The binary one signal from gate 220B(*a*) is applied to pin 10 of line driver 228(*a*) and to one input of And gate 220A(*a*). The other input is also receiving a binary one signal and as a result, input pins 7 and 10 of drivers 230(*a*), 232(*a*) and 234(*a*) and input pin 7 of driver 228(*a*) also receives binary one signals. Each of drivers 228(*a*), 232(2) and 234(*a*), consequently are prepared to transmit along lines DT$\phi$(*a*) and $\overline{DT\phi}$(*a*)–DT7(*a*) and $\overline{DT7}$(*a*) signals applied to them along lines CGD$\phi$(*a*) - CGD7(*a*).

The signal on line DT$\phi$(*a*), as shown is applied to the input pin of dual differential line receiver 160 which applies that signal to 3-to-8 line decoder 164 shown in FIG. 8. The c-bit binary coded signal applied along the lines GA8, GA9 and GA10 causes the 3-to-8 line decoder 164 to select the binary signal applied along line $\overline{CGB\phi}$(*a*) to its input pin 4 and to apply a corresponding signal from its output pin 5 along line $\overline{CGB\phi}$to input pin 3 of data selector 156 (FIG. 8). (If another car was the selected one the signals along lines GA8, GA9 and GA10 would select the signal for that car to be applied along line $\overline{CGB\phi}$). In addition, the signals on lines DT1 to DT7 are applied along line $\overline{CGB1}$ to $\overline{CGB7}$ to the input pins of data selectors 156 and 158 (FIG. 8). Signals corresponding to the signals applied along lines $\overline{CGB\phi}$to $\overline{CGB7}$ to the input pins 3, 6, 10 and 13 will be applied to the output pins 4, 7, 9 and 12 respectively of the pair of data selectors 156 and 158 in a manner to be described. As shown, the output pins of the pair of data selectors 156 and 158 are connected by lines $\overline{GD\phi}$to $\overline{GD7}$ to pins of the bidirectional bus drivers 54 and 56 shown in FIG. 4 to apply the binary signals representing the data stored in the data storage means CRAM(*a*) to the data bus pins of group processor GPU.

At this time flip-flop 78B (FIG. 5) is producing a binary zero signal along line GWX. This is the result of the flip-flop having been reset at the end of the last T3 timing state of group processor GPU (FIG. 4) by the binary one signals along line $\overline{GT3}$ and G$\phi$1. The binary zero signal along line GWX together with the previously mentioned binary one signal along line GCDT (FIG. 9B) produces a binary zero along line GTP. This maintains the output from And gate 220C(*a*) (FIG. 10) along line GWD(*a*) at a binary zero.

The binary zero signals along lines DTS(*a*), GWD(*a*) and HL1 cause data selector 416(*a*) (FIG. 13) to produce binary zero outputs at its pins 4, 7 and 9. These cause data selectors 408(*a*) and 410(*a*) to apply the address signals along lines GCA$\phi$(*a*) to GCA7(*a*) to car data storage means CRAM(*a*). As a result of the output signals from data selector 416(*a*) the car data storage means CRAM(*a*) produces the signals stored in the memories addressed by the address along lines CDO$\phi\lambda$(*a*)-CDO7(*a*). These signals while applied to the car equipment of FIG. 11 are ineffective to produce a result at least because the car processor unit is in a WAIT state and will not accept signals even if applied thereto and because latches 358(*a*), 362(*a*), 360(*a*) and 364(*a*) are rendered inoperable by binary zero signals applied along lines CT1(*a*) and CT2(*a*).

The signals along lines CDO$\phi$(*a*) to CDO7(*a*) are also applied to And gates 412(*a*) and 414(*a*) (FIG. 13). As a result of the binary zero signal applied along line DTS(*a*) these gates apply these signals to lines CGD$\phi$(*a*) and CGD7(*a*). These signals are transmitted to line drivers 228(*a*), 230(*a*), 232(*a*) and 234(*a*) (FIG. 10) and applied to lines DT$\phi$(*a*) to DT7(*a*).

Group processor unit GPU (FIG. 4) continues to produce pulses along line GSYNC. At the end of the first of these to be produced after the application of the binary zero signal along line DTS(*a*) flip-flops 180A and 180B (FIG. 9A) apply binary one signals to input pins 2 and 13 of Nand gate 174A. Upon the production of the next pulse along line GSYNC, Nand gate 174A applies a binary zero signal to pin 3 of flip-flop 172A. This causes a binary one signal to be produced on line GSUS which is applied to group processor GPU (FIG. 4) to enable it to leave its WAIT state and advance to a T3 timing state.

Before group processor GPU (FIG. 4) entered its WAIT state and at the end of its proceding T2 timing state a binary zero signal, as is well known, was applied along line $\overline{GT2}$ (FIG. 5) to pin 3 of flip-flop 76A causing it to produce a binary one signal at its pin 5. This signal is combined in gate 80C with the pulse applied along line GSYNC when the group processor enters its T3 timing state to produce a binary one signal along line $\overline{GT3A}$. This signal together with the binary one signal of the operational code along line $\overline{GA14}$ of the complement of the signal of the operational code along line GA14 causes gate 80A to produce a binary one along line GRX. This signal is applied to input pin 9 of Nand gate 174C (FIG. 9A). In addition Nand gate 174C receives binary one level signals applied to it along lines GA13 and GCDT from pin 11 of flip-flop 180B and produces a binary zero level signal. This is applied along line GRCE to the enable input pins 15 of the pair of data selectors 156 and 158 (FIG. 8) to enable the data selectors to operate.

The binary one signal along line GCDT also causes the binary one signal applied to input pin 6 of selector 200 (FIG. 9B) to be applied along line G8B. This input signal and consequently the signal along line G8B are binary one signals as a result of the binary one signal of the operational code along line GA14. The binary one level signal applied along line G8B actuates the pair of data selectors 156 and 158 (FIG. 8) so that the signals applied to input pins 3, 6, 10 and 13 are transmitted to the output pins 4, 7, 9 and 12 respectively. Consequently, in response to the binary zero signal to them along line GRCE the data selectors 156 and 158 (FIG. 8) apply binary signals representing the data to be received by the group processor along lines $\overline{GD\phi}$ to $\overline{GD7}$ to the bidirectional data bus pins of the bidirectional bus drivers 54 and 56 shown in FIG. 4. The bidirectional bus drivers transmit the complements of the signals applied to them along lines $\overline{GD\phi}$ to $\overline{GD7}$ to the input pins of the group processor upon receipt of a binary one signal applied along line $\overline{GDIEN}$ in conjunction with the binary zero applied along line $\overline{GCS}$.

The signal along line $\overline{GCS}$ at this time is a binary zero because at the end of the last T2 timing state a binary zero pulse was applied along line $\overline{GT2}$ to pin 11 of flip-flop 76B (FIG. 5) and caused a binary zero to be applied along line $\overline{GCS}$. The binary one signal along line $\overline{GDIEN}$ is produced in response to the binary one level signal from And gate 80C (FIG. 5) being combined with the binary one level signal from the output pin 7 of three to eight line decoder 74 applied along line $\overline{GPCW}$ to produce a binary one level signal along line $\overline{GDIEN}$. The signal along line $\overline{GPCW}$ is a binary one because a "reading" operation is being undertaken and as the manufacturer's specification teaches during such time the signals along line GA14 and GA15 are to be in the binary zero and binary one states, respectively. With the binary zero along line HL1 it is well known that these signals will produce a binary one along line $\overline{GPCW}$ from decoder 74.

As a result of the application of the binary one signal along line $\overline{GDIEN}$ and the binary zero signal along line $\overline{GCS}$ the data signal indicative of the position of car "a" has now been transmitted to group processor GPU. Car processor CPU(*a*) can now be restored to operation. This is accomplished because during the next T1 and T2 timing states of group processor GPU a binary zero signal is applied along line GA13. This causes line driver 196A (FIG. 9B) to produce a binary zero signal along line XCRDY(*a*) which is applied to receiver 210(*a*) (FIG. 10). As a result, a binary one signal is applied along line CSUS(*a*) to pin 17 of car processor CPU(*a*). (FIG. 11) relieving it from its WAIT state. Simultaneously, inverter 212D (FIG. 10) applies a binary zero signal to reset pins 3 and 8 of flip-flops 214A(*a*) and 214B(*a*) to produce a binary one signal along line DTS(*a*) to enable the car processor CPU(*a*) to communicate with its car data storage means CRAM(*a*) once again. At the same time a binary zero signal is produced along line GCDT in response to binary one signals along lines GSUS and $\overline{GA13}$ as previously described.

From the foregoing, it is to be understood that group processor GPU can employ the information concerning the location of car "*a*" to determine whether the car should be stopped in response to registered hall calls. It can do this by acquiring information concerning the registration of such calls from the equipment of FIGS. 3A and 3B in a manner similar to that explained in which car "*a*" acquired the information concerning the registration of the car call for the 7th landing from the equipment of FIG. 14. Also, group processor GPU would acquire information concerning the direction of travel of car "*a*" in a manner similar to that explained in which it acquired the information concerning the location of car "*a*". Upon determining that the location of car "*a*" and that its direction of travel was proper for causing it to stop in response to a registered hall call that information can be transmitted to the car data storage means of car "*a*" in order for its processor unit CPU(*a*) to use it to initiate the stopping of car "*a*" in a manner to that explained for initiating the stopping of car "a" in response to the 7th landing car call. To do this, a signal must be transmitted by group processor GPU to a particular location in car data storage means CRAM(a) (FIG. 13). This is performed in a manner similar to that explained by which group processor GPU obtained information from car data storage means CRAM(a).

The operation of "storing" or "writing" data in car data storage means CRAM(a) proceeds in the same manner as the previously described operation of "retrieving" or "reading" data therefrom up to the transmittal of the address of interest of the data storage means along lines GCAϕ(a)–GCA7(a) to selectors 408(a) and 410(a) (FIG. 13). Because this operation comprises the "storing" of data the signal along line GA14 of the address code is a binary one as opposed to the binary zero it was during the described "reading" operation. Consequently, the complement along line $\overline{GA14}$ (FIG. 9B) is a binary zero signal. This, instead of a binary one signal being applied along line GDC (FIG. 9B) subsequent to the application of a binary one signal along line GCDT to selector 200, a binary zero signal is applied along that line. Gates 220B(a) and 200A (a) (FIG. 10), therefore do not produce binary one signals to enable drivers 228, 230; 232 and 234 to operate as described in the "retrieving" operation. Instead binary zero signals are applied to the pins 7 and 10 inputs to prevent the operation of these drivers which prevents these drivers from interferring with the "retrieve" operation.

Also, the binary one signal along line GA14 produces a binary one signal along line GCTE during the group processor WAIT state to enable drivers 122 through 130 to operate during the "storing" operation in contrast to the binary zero signal which had been produced along line GCTE during the "retrieving" operation to prevent these drivers from operating and interferring with that operation.

Also, the binary zero signal along line $\overline{GA14}$ causes the production of a binary zero signal along line GRX (FIGS. 5 and 9A) during the "storing" operation as opposed to the binary one produced therealong during the "retrieve" operation. As a consequence of this change a binary one signal is applied along line GRCE (FIG. 9A). This disables selectors 156 and 158 (FIG. 8) from applying signals along lines $\overline{GD\phi}$ – $\overline{GD7}$ and interferring with the "storing" operation.

Consequently, when group processor GPU enters its T3 state, as previously explained for the "retrieve" operation, it not places the data signals to be transmitted to car data storage means CRAM(a) on bus lines $\overline{GD\phi}$ – $\overline{GD7}$ (FIG. 4) in typical fashion since it is performing a "storing" operation. These signals are transmitted through selectors 100, 102, 116 and 118 (FIG. 7) onto lines GCDϕ(a) – GCDϕ(h) and GCD1 – GCD7 to drivers 122 – 130. (Since only car "a" is to receive these signals only its equipment will be hereafter referred to.) These drivers transmit corresponding signals along lines DTϕ(a) and $\overline{DT\phi}$(a) – DT7 and $\overline{DT7}$ to receivers 236(a)–242(a) (FIG. 10). Corresponding signals are applied along lines $\overline{GCB\phi}$(a)–$\overline{GCB7}$(a) by these receivers to data selectors 400(a) and 402(a) (FIG. 13).

Since the binary one signal along line GA14 has produced a binary zero signal along line $\overline{GPCW}$ (FIG. 5), when the T3 timing state reaches its last quarter, the binary zero signal along line $\overline{GT3}$ (FIG. 5) causes flip-flop 78B to produce a binary one signal along line GWX. This signal causes selector 200 (FIG. 9B) to produce a binary one signal along line GTP for application to receiver 216(a) (FIG. 10). In the meantime, during the WAIT state as previously explained for the "retrieve" operation, flip-flop 214B(a) (FIG. 10) has produced a binary one signal from its pin 11. This in combination with the binary one signal produced from pin 2 of receiver 216(a) as a result of the signal applied along line GTP causes gate 220C(a) to produce a binary one signal along line GWD(a).

The binary zero signal along line DTS(a) (FIG. 13) which was produced during the WAIT state as explained for the "retrieve" operation in combination with the binary one signal along line GWD(a) causes selector 416(a) to apply a binary one signal to inverter 418B(a) (FIG. 13). This causes a binary zero signal to be applied to pins 20 if the car data storage means CRAM(a) and pins 15 of selectors 400(a) and 402(a). In the meantime, during the WAIT state the binary zero signal along line DTS(a) in combination with the binary zero signal along line HL1 has caused selectors 408(a) and 410(a) to apply the address signal to car data storage means CRAM(a). As a consequence the data signals on lines $\overline{GCB\phi}$(a) and $\overline{GCB7}$(a) are transmitted into car data storage means CRAM(a) for storage therein.

The car processor CPU(a) is released from its suspended state in the same manner as explained for its release from that state after the "retrieval" operation. It should be understood from the foregoing how the information that the car is to initiate a stop in response to a hall call can be employed by car processor CPU(a) to have the car control equipment perform such an operation and consequently for purposes of brevity this operation will not be described.

As described the group processor GPU operating in accordance with its group program of instructions is operable to cause the suspension of its sequence of operations and the sequence of operations of a single selected car processor CPU(a) in order to receive car data signals from or to transmit group data signals to its associated car data storage means CRAM(a). It is to be understood, however, that in the constructed embodiment the group processor does not operate to transmit 8-bits of useful information simultaneously to a single car's data storage means. Rather, only that information contained in a particular one of the 8-bits is useful to a given car. When it is desired to transmit information to car "a" that information is placed along line $\overline{GD\phi}$ which will result in a signal corresponding to that information being applied along line DTϕ(a). Similarly, information for car "b" is placed along line $\overline{GD1}$ resulting in a signal on line DTϕ(b), and so forth.

Also, in the constructed embodiment, the group processor operates in a manner similar to the manner described with respect to car "a" but causes the simultaneous suspension of the sequence of operation of all car processors in order to receive car data signals from or to transmit group data signals to associated car data storage means CRAM(a) (FIG. 13) and CRAM(b) through CRAM(h) (not shown). Since the operation in which the group processor receives car data signals from or transmits group data signals to the car data storage means CRAM(a) is similar to the operation in which it simultaneously receives car data signals from or transmits group data signals to each of the car data storage means only the differences between these two operations will hereinafter be described.

It will be assumed that the group processor receives an instruction to receive car data signals from the car data storage means associated with each car. The group processor operating in accordance with this instruction applies an address code signal to latches 58, 62, 60 and 64 in the manner previously described which causes the group processor to suspend its sequence of operations. In accordance with this assumed instruction latch 60 applies a binary zero signal along line GA11 and a binary one signal along line $\overline{GA11}$ as opposed to the binary one and zero signals applied therealong signifying data transmmission between the group processor and the car data storage means associated with a single car as previously described.

The binary zero signal on line GA11 causes data selectors 192 and 194 (FIG. 9B) to apply the complements of the signal applied to their input pins 2, 5, 11 and 14 to drivers 196A, 196B, 198A and 198B and to the additional drivers associated with cars *c* through *g* (not shown). As a result driver 196A applies a binary one signal along line XCRDY(*a*) to receiver 210(*a*) (FIG. 10) to cause it to apply a suspension signal to car processor CPU(*a*) (FIG. 11) as previously described. Similarly binary one signals are simultaneously separately applied along lines XCRDY(*b*) through XCRDY(*h*) to the circuitry similar to that shown in FIG. 10 associated with each car to cause that circuitry to apply a suspension signal to the car processor with which it is associated.

Subsequent to the application of the suspension signal to each car processor the address signals are to be applied along bidirectional signal transmission lines DT$\phi$(*a*), $\overline{DT\phi}$(*a*), through DT$\phi$(*h*), $\overline{DT\phi}$(h) and DT1, $\overline{DT1}$ through DT7 and $\overline{DT7}$ to the equipment associated with each of the cars in the manner in which the address signals were applied along lines DT$\phi$(*a*), DT$\phi$(a) and DT1, DT1 through DT7 and DT7 to the circuitry associated with car "*a*". However before these address signals can be transmitted the drivers associated with each car processor which are similar to drivers 228(*a*), 230(*a*), 232(*a*) and 234(*a*) associated with car "*a*" shown in FIG. 10 must be prevented from interferring with those address signals. Consequently, signals on lines GA8, GA9 and GA10 are chosen to cause decoder 190 (FIG. 9B) to apply a binary one level signal to Nand gate 202B(*a*). In response to this signal and the binary one signal on line $\overline{GA11}$ Nand gate 202B(*a*) causes a binary zero signal to be applied from pin 7 of selector 200 to driver 204B(*a*). As a result driver 204B(*a*) applies a binary zero signal along common line GDC instead of the binary one signal previously described. This binary zero signal is applied to receiver 216A(*a*) (FIG. 10) which applies it to register 222(*a*) for storage therein which Nand gate 218A (*a*) causes a binary one signal to be applied thereto as previously described. In addition the binary zero signal is also stored in registers similar to register 222(*a*) associated with each car. As a result register 222(*a*) shown in FIG. 10 for car "*a*" and similar registers apply a binary zero signal to And gate 220A(*a*) and simiar gates associated with the other cars to prevent drivers 228(*a*), 230(*a*), 232(*a*) and 234(*a*) associated with car "*a*" and similar drivers from interferring with the signals on lines DT1, $\overline{DT1}$ through DT7 and $\overline{DT7}$. In addition the binary zero signal on line GDC causes a binary zero signal to be applied to And gate 220B(*a*) and similar gates, not shown, to prevent driver 228(*a*) and similar drivers associated with the remaining cars from interferring with the address signals to be transmitted to the circuitry associated with each car.

As previously described in the "reading operation" the address signals are applied through data selectors 100 and 102 (FIG. 7) to data selectors 116 and 118 and along lines GCD1 through GCD7 to drivers 126, 128, 130 and 132. At this time the least significant bit (LSB) of the first eight bits of the address signal is applied through selectors 116 and 118 along lines GCD$\phi$(*a*) through GCD$\phi$(*h*) to drivers 122, 123, 124 and 125. Drivers 122 through 125 apply the LSB of the first eight bits of the address along lines DT$\phi$(*a*) and $\overline{DT\phi}$(*a*) individually to receiver 236(*a*) shown in FIG. 10 and along lines DT$\phi$(*b*), $\overline{DT\phi}$(*b*) through DT$\phi$(*h*) and $\overline{DT\phi}$(*h*) individually to similar receivers associated with each car. Drivers 126, 128, 130 and 132 apply the seven most significant bits of the address along lines DT1, $\overline{DT1}$ through DT7 and $\overline{DT7}$ to receivers 236(*a*), 238(*a*), 240(*a*) and 242(*a*) and to similar receivers associated with each car. As a result in view of the prior description in which the address signals are applied to the car data storage means CRAM(*a*) it is to be understood that the similar circuitry associated with each of the cars operates in the same manner to apply the first eight bits of the address signal to the car data storage means CRAM(*b*) through CRAM(*h*) (not shown).

It will now be assumed that the data stored in the locations of each car data storage means identified by the address signal applied thereto is to be received by the group processor. As previously described this is also known as a "reading" operation and as previously described during a "reading" operation the drivers 122 through 130 (FIG. 7) are prevented from interferring with signals applied along lines DT$\phi$(*a*), $\overline{DT\phi}$(*a*) through DT$\phi$(*h*) and $\overline{DT\phi}$(*h*) and DT1 through $\overline{DT1}$ through DT7 and $\overline{DT7}$.

During this reading operation a single bit of data will be received by the group processor from the car data storage means associated with each car processor as opposed to the reading operation previously described in which up to eight bits of data were received by the group processor from the car data storage means CRAM(*a*) associated with car processor CPU(*a*). The single bit of data to be received from the circuitry associated with each car is to be transmitted along lines DT$\phi$(*a*) $\overline{DT\phi}$(*a*) through DT$\phi$(*h*) and $\overline{DT\phi}$(*h*) to the receivers 160, 161, 162 and 163 shown in FIG. 8. Although the following description is directed to the circuitry associated with car "*a*" which applies the single bit of data along lines DT$\phi$(*a*) and $\overline{DT\phi}$(*a*) it is also applicable to the circuitry associated with the remaining cars (not shown) which apply a single bit of data along lines DT$\phi$(*b*), $\overline{DT\phi}$(*b*) through DT$\phi$(*h*) and $\overline{DT\phi}$(*h*).

As previously described during a "read" operation selector 200 (FIG. 9B) applies the binary one signal on line $\overline{GA14}$ to driver 204B which transmits that signal along common line GDC to receiver 216(*a*) (FIG. 10). In response to the binary one signals from receiver 216(*a*) and flip-flop 214B(*a*) And gate 220B applies a binary one signal to pin 10 of driver 228(*a*) which transmits the signal it receives from the car data storage means CRAM(*a*) along lines DT$\phi$(*a*) and $\overline{DT\phi}$(*a*) to receiver 160 (FIG. 8). The circuitry associated with the additional cars similarly transmits the data signals along lines DT$\phi$(*b*), $\overline{DT\phi}$(*b*) through DT$\phi$(*h*) and $\overline{DT\phi}$(*h*) to receivers 160, 161, 162 and 163. These data signals are applied along lines $\overline{CGB\phi}$(*a*) through $\overline{CGB\phi}$(*h*) to selectors 156 and 158. At this time selector 200 applies the binary one signal from Nand gate 202B (FIG. 9B) along line G8B to selectors 156 and 158 which operate to apply the signals applied thereto along lines $\overline{CGB\phi}$(*a*) through $\overline{CGB\phi}$(*h*) to lines $\overline{GD\phi}$ through $\overline{GD7}$ connected to bidirectional bus drivers 54 and 56 (FIG. 4) for transmission to group processor GPU.

If the address code is such as to cause the group processor unit to transmit a single bit of data to each car the first eight bits of the address are first applied to the car data storage means associated with each car, as described. During the time period T3 of the group processor the data is applied along lines $\overline{GD\phi}$ to $\overline{GD7}$ through selectors 100 and 102 (FIG. 7) to selectors 116 and 118. At this time the binary one signal from And gate 202B (FIG. 9B) is inverted and applied along line $\overline{G8B}$ to data selectors 116 abd 118 (FIG. 7) to cause them to apply signals corresponding to the signal on pin 4 of data selector 100 along lines GCd$\phi$(*a*) through GCD$\phi$(*h*) to drivers 122, 123, 124 and 125. The remaining circuit operation is similar to that described during a "write" operation in which data is transferred to the car data storage means CRAM(*a*) associated with car "*a*".

It is understood that various modifications to the above described arrangement of the invention will become evident to those skilled in the art and that the arrangement described herein is for illustrative purposes and is not to be considered restrictive.

What is claimed is:

1. A control systemm for use in an elevator installation having a plurality of cars serving a plurality of floors, said installation having group control equipment common to said plurality of cars including hall call registration means producing hall call signals and car control equipment individual to each of said cars for controlling its associated car, each said car control equipment including car operation apparatus, car call registering means and car position signifying means, the latter two producing car call and car position signals, respectively, said control system connected to both said car control equipment and said group control equipment for receiving therefrom car call and car position signals and hall call signals, said control system comprising:

program storage means storing control programs of instructions therein including a car program of instructions for each car and a group program of instructions;

car processing means connected to said program storage means, said car processing means sequentially performing a first set of operations by following in a step-by-step manner each car program of instructions to produce first car control signals in response to said associated car call and car position signals and to apply said first car control signals to the associated car operating apparatus to cause it to operate its associated car in a particular manner; and group processing means connected to said program storage means and to said car processing means, said group processing means sequentially performing a second set of operations by following in a step-by-step manner said group program of instructions to produce group control signals in response to selected first car control signals and hall call signals and to apply said group control signals to said car processing means;

said car processing means operating to produce second car control signals in response to said group control signals and to apply said second car control signals to said individual car operating apparatus to cause said car operating apparatus to operate said associated cars in response to said hall call signals as a supervised group.

2. A control system according to claim 1, wherein said car processing means includes a separate car processor and separate car logic circuitry associated with each of said cars, said separate car logic circuitry connecting each car processor to said program storage means, said group processing means and the car control equipment individual to its associated car, each car processor performing in accordance with the car program of instructions for its associated car to produce said first and second car control signals in response to said car call and car position signals and said group control signals and to apply said first and second car control signals through said connected car logic circuitry to said associated car operating apparatus to cause it to operate said associated car as a member of the supervised group.

3. A control system according to claim 2, wherein aid group processing means includes a group processor and group logic circuitry connecting said group processor to said program storage means, said group control equipment and through said separate car logic circuitry to each said car processor, aid group processor in sequentially performing said second sequence of operations in accordance with the group program of instructions producing group control signals in response to said hall call signals and selected first car control signals from each said car processor, said group control signals being applied to said group control equipment and through said group logic circuitry to each said car processor to control the operation of said associated car as a supervised group.

4. A control system according to claim 3, wherein said group logic circuitry includes a group suspension signal generator connected to said group processor, said group processor in sequentially performing said second set of operations receiving a particular group instruction that it is to receive a first or second car control signal from or that it is to transmit a group control signal to a particular car processor, said group processor operating in response to said particular group instruction and causing said group suspension signal generator to produce a group suspension signal which is applied to said group processor to cause it to suspend the sequential performance of its second set of operations.

5. A control system according to claim 4, wherein said group logic circuitry includes a car suspension generator connected to each said car processor, when said group processor receives said particular group instruction it contains an address code including a car selection signal identifying a selected car, said group processor applying said car selection signal to said car suspension signal generator to cause it to produce a car suspension signal for said selected car, said car suspension signal generator applying said car suspension signal to said selected car processor to cause it to suspend the sequential performance of its first set of operations.

6. A control system according to claim 5, wherein each said logic circuitry includes associated car data storage means for receiving and storing associated first and second car control signals and group control signals, and wherein said group logic circuitry includes a separate data transfer signal generator associated with each car, each data transfer signal generator connected to its associated car's logic circuitry and to said car suspension signal generator, each said data transfer signal generator operating in response to a car suspension signal for its associated car to produce a data transfer signal signifying that said associated car logic circuitry is conditioned so that a first or second car control signal can be supplied from aid associated car data storage means to said group processor or that said group processor can transmit a group control signal to said associated car data storage means.

7. A control system according to claim 6, wherein each car's logic circuitry includes car data switching means, each connecting its associated car processor to its associated car data storage means to enable said associated car processor to apply first and second car control signals to said associated car data storage means for storage therein and to retrieve said stored first and second car control signals therefrom, each said car data switching means operating in response to its associated data transfer signal to disconnect its associated car data storage means from its associated car processor and to connect said storage means to said group processor to enable a first and second car control signal to be supplied from said associated car data storage means to said group processor or to enable said group processor to transmit a group control signal to said associated car data storage means.

8. A control system according to claim 7, wherein when said particular group instruction is received by said group processing means it contains address signals identifying a location in said selected car's data storage means in which is stored a particular first or second car control signal that said group processor is to retrieve or in which a particular group control signal is to be stored, said address signals being transmitted from said group processor to said car data storage means through said car data switching means in response to the connection and disconnection operation caused by the generation of the associated data transfer signal.

9. A control system according to claim 8, wherein said particular first or second car control signal is retrieved from or said particular group control signal is stored in said car data storage means by said group processor by transmission through said car data switching means in response to the connection and disconnection operation caused by the generation of the associated data transfer signal.

10. A control system according to claim 9, wherein when said group processor receives said particular group instruction that address code it contains can identify a plurality of cars as being selected, and said group processor can retrieve a first or second car control signal from the car data storage means of each of said selected cars simultaneously or store the same group control signal in the car data storage means of all of said cars simultaneously.

11. A control system according to claim 6, wherein aid program storage means includes a group storage means storing said group program of instructions and a plurality of car program storage means each storing a car program of instructions for an associated car, each said car program storage means including instructions for the associated car processor to store first and second car control signals in identified locations in its associated car data storage means for retrieval by said group processor, and said group program storage means including instructions for the group processor to store group control signals in identified locations associated car data storage means for retrieval by the associated car processor, said group program storage means also including instructions for the group processor to retrieve first and second car control signals from associated car data storage means.

12. A control system according to claim 5, wherein said group logic circuitry includes a group register, said group processor applying said address code including said car selection signal to said group register for storage therein, said car register operating to apply said car selection signal to said car suspension signal generator until said group processor in operation in response to the sequential performance of said second set of operations applies another address code to said group register.

* * * * *